US009528302B2

(12) United States Patent
Loughlin et al.

(10) Patent No.: US 9,528,302 B2
(45) Date of Patent: Dec. 27, 2016

(54) SECURITY LINK

(71) Applicants: Robert Loughlin, Stanton, NJ (US); John Loughlin, Lebaon, NJ (US)

(72) Inventors: Robert Loughlin, Stanton, NJ (US); John Loughlin, Lebaon, NJ (US)

(73) Assignee: Stanton Concepts, LLC., Stanton, NJ (US)

( * ) Notice: Subject to any disclaimer, the term of this patent is extended or adjusted under 35 U.S.C. 154(b) by 352 days.

(21) Appl. No.: 14/074,917

(22) Filed: Nov. 8, 2013

(65) Prior Publication Data

US 2014/0137611 A1 May 22, 2014

Related U.S. Application Data

(63) Continuation of application No. 11/351,136, filed on Feb. 9, 2006, now abandoned, which is a (Continued)

(51) Int. Cl.
*E05B 65/48* (2006.01)
*E05B 67/38* (2006.01)
(Continued)

(52) U.S. Cl.
CPC ..... *E05B 67/383* (2013.01); *E05B 67/003* (2013.01); *E05B 67/36* (2013.01); *E05B 67/38* (2013.01);
(Continued)

(58) Field of Classification Search
CPC ..... E05B 67/003; E05B 67/36; E05B 67/38; E05B 67/383; E05B 2067/386; E05B 73/00; E05B 73/0005; E05B 73/007;E05B 73/0094; E05B 73/02; E05C 19/00; E05C 19/186
See application file for complete search history.

(56) References Cited

U.S. PATENT DOCUMENTS 62,636 A 5/1867 Kelly
1,487,258 A 3/1924 Menger et al. ..... 70/15
(Continued)

OTHER PUBLICATIONS

"PCT International Search Report—PCT/US05/33533", (Apr. 28, 2006),2 pgs.

(Continued)

*Primary Examiner* — Christopher Boswell
(74) *Attorney, Agent, or Firm* — Chiesa Shahinian & Giantomasi PC

(57) ABSTRACT

A device adapted to connect a first securing member to a second securing member, the device comprising a link with a base having an interrupted raised lip forming an internal cavity, the base having a hasp extending into the internal cavity, the hasp having a through hole, and the raised lip having interrupted areas, a first securing element associated with the base at a first interrupted area, the first securing element securing a first securing member, a second securing element associated with the base at a second interrupted area, the second securing element securing a second securing member, a lock having a shackle and a body, the lock fitting within the internal cavity such that the shackle may be inserted through the through hole of the hasp with the body inhibiting the first and second securing members from being disassociated with the first and second securing elements.

13 Claims, 63 Drawing Sheets

Related U.S. Application Data continuation-in-part of application No. 11/231,210, filed on Sep. 20, 2005, now Pat. No. 7,543,466.

(60) Provisional application No. 60/611,369, filed on Sep. 20, 2004, provisional application No. 60/651,414, filed on Feb. 9, 2005.

(51) Int. Cl.

| | |
|---|---|
| ***E05B 73/00*** | (2006.01) |
| ***E05B 67/00*** | (2006.01) |
| ***E05B 67/36*** | (2006.01) |
| ***E05C 19/18*** | (2006.01) |
| *E05B 13/00* | (2006.01) |
| *E05B 83/10* | (2014.01) |

(52) U.S. Cl.

CPC ..... *E05B 73/0005* (2013.01); *E05C 19/186* (2013.01); *E05B 13/002* (2013.01); *E05B 83/10* (2013.01); *Y10T 70/409* (2015.04); *Y10T 70/491* (2015.04)

(56) References Cited

U.S. PATENT DOCUMENTS

| | | | | |
|---|---|---|---|---|
| 1,689,437 | A | 10/1928 | Hurd | 70/15 |
| 1,788,396 | A | 1/1931 | Johnson | 70/15 |
| 1,792,403 | A | 2/1931 | Stone | 70/33 |
| 1,814,356 | A | 7/1931 | Solomon | 70/15 |
| 1,845,354 | A | 2/1932 | Soref | 70/15 |
| 2,104,981 | A | 1/1938 | Falk | |
| 2,825,218 | A | 3/1958 | O'Brien | 70/7 |
| 3,017,678 | A | 1/1962 | Christensen | 292/317 |
| 3,101,695 | A * | 8/1963 | Honeyman, Jr. | B63B 21/54 114/230.29 |
| 3,664,164 | A | 5/1972 | Zaidener | 70/14 |
| 3,769,821 | A | 11/1973 | Randel | |
| 3,808,847 | A * | 5/1974 | Vesely | E05B 67/003 70/18 |
| 3,817,064 | A | 6/1974 | Sallee | 70/58 |
| 3,835,675 | A | 9/1974 | Lippisch | |
| 3,901,058 | A | 8/1975 | Best | |
| 3,939,677 | A | 2/1976 | Drayton | 70/18 |
| 4,043,159 | A | 8/1977 | Malacheski et al. | 70/38 R |
| 4,057,982 | A | 11/1977 | Drayton | 70/18 |
| 4,102,162 | A | 7/1978 | Miller | |
| 4,112,716 | A | 9/1978 | Wippich | 70/38 C |
| 4,118,961 | A * | 10/1978 | Lee | B60R 25/023 70/18 |
| 4,183,235 | A | 1/1980 | Coralli et al. | |
| 4,269,048 | A | 5/1981 | McDorman | 70/13 |
| 4,286,444 | A | 9/1981 | Grudich | 70/13 |
| 4,347,720 | A | 9/1982 | Kenyon | 70/18 |
| 4,372,136 | A | 2/1983 | Mickelson | 70/14 |
| 4,389,862 | A | 6/1983 | Hastings | 70/18 |
| 4,694,667 | A | 9/1987 | Hodge | 70/49 |
| 4,704,881 | A | 11/1987 | Sloop, Sr. | 70/158 |
| 4,754,626 | A | 7/1988 | Siegel | 70/32 |
| 4,779,432 | A | 10/1988 | Frontera-Mariani | 70/18 |
| 4,956,982 | A | 9/1990 | Valley | 70/18 |
| 4,977,763 | A | 12/1990 | Sewell | 70/54 |
| 4,998,423 | A | 3/1991 | Hsu et al. | |
| 5,070,712 | A | 12/1991 | Fox | 70/18 |
| 5,145,222 | A | 9/1992 | Meyer | |
| 5,146,771 | A | 9/1992 | Loughlin | |
| 5,219,384 | A * | 6/1993 | Elsfelder | E05B 67/38 70/18 |
| 5,284,036 | A | 2/1994 | Rosenbaum | 70/56 |
| D351,984 | S | 11/1994 | Victor | |
| 5,419,165 | A | 5/1995 | Perkins | 70/19 |
| 5,442,941 | A | 8/1995 | Kahonen et al. | |
| 5,469,722 | A | 11/1995 | Ellefsen | 70/56 |
| 5,481,888 | A | 1/1996 | Perry | 70/18 |
| 5,775,747 | A | 7/1998 | Navarsky | |
| 5,953,941 | A | 9/1999 | Freund | |
| 5,956,980 | A * | 9/1999 | Jenkins, Jr. | E05B 73/0005 24/598.5 |
| 6,012,739 | A | 1/2000 | Weiss et al. | 70/18 |
| 6,092,402 | A * | 7/2000 | Porcelli | E05B 67/383 70/18 |
| 6,244,614 | B1 | 6/2001 | Bonvillain et al. | |
| 6,263,709 | B1 | 7/2001 | Kemery et al. | 70/18 |
| 6,467,317 | B1 | 10/2002 | Hillabush et al. | |
| 6,755,054 | B2 | 6/2004 | Burmesch et al. | 70/49 |
| 6,766,671 | B2 | 7/2004 | Haczynski et al. | |
| 6,823,701 | B1 | 11/2004 | Gogel | |
| 6,829,916 | B1 | 12/2004 | Devecki | 70/18 |
| 6,834,896 | B2 | 12/2004 | Smith | |
| 6,915,670 | B2 | 7/2005 | Gogel | |
| 6,925,842 | B1 | 8/2005 | Hillabush et al. | |
| 6,983,629 | B1 | 1/2006 | Gogel | |
| 6,997,420 | B2 | 2/2006 | Yudis et al. | |
| 7,047,774 | B1 | 5/2006 | Gogel | 70/32 |
| 7,096,696 | B2 | 8/2006 | Devecki | |
| 7,272,962 | B2 | 9/2007 | Benda et al. | |
| 7,520,151 | B1 | 4/2009 | Harmon | |
| D627,632 | S | 11/2010 | Elmer et al. | |
| 7,891,219 | B1 | 2/2011 | Gogel | |
| 8,020,414 | B2 * | 9/2011 | Pitisethakarn | E05B 67/383 292/218 |
| 8,181,496 | B2 * | 5/2012 | McDaid | E05B 17/2084 70/227 |
| 8,245,546 | B2 * | 8/2012 | Olsson | E05B 67/38 292/1 |
| 8,851,535 | B2 * | 10/2014 | Miskel | E05C 19/186 292/258 |
| 2005/0099018 | A1 | 5/2005 | Witchey | |
| 2006/0107707 | A1 | 5/2006 | Vaughn et al. | |
| 2006/0272365 | A1 | 12/2006 | Copus | |
| 2007/0234764 | A1 * | 10/2007 | Weinberger | E05B 67/36 70/2 |
| 2011/0120197 | A1 * | 5/2011 | Molesan | E05B 73/0005 70/58 |
| 2011/0174023 | A1 * | 7/2011 | George | E05B 67/383 70/19 |

OTHER PUBLICATIONS

"PCT Written Opinion—PCT/US05/33533", (Apr. 28, 2006),7 pages.
www.tranportsecurity.com/adjustable-lock.asp.
www.saundersonsecurity.co.uk/itmidxbullcontainerlock.shtml.
www.sealock.com/sealock_model_ru2004.html, 2 pages.
www.sealock.com/the_sealock_solution.html, 2 pages.
Navalock MK-IIIA and Navablock for Trailer Security, www.cgmsecuritysolutions.com/sw/swchannel/productcatalogcf_v2/Internet/model.asp/Product Mast, 4 pages.
Ranger Deadbolt, Advertisement for PUCKBOLT: The Ultimate to Keep Doors Tightly Closed.
Transport Security Inc., 'The Enforcer Product Line' catalog, 6 pages.
www.rangerdeadbolt.com/TrailerDoors.html, 3 pages.
Pictures of Ranger Deadbolt, 4 pages.
"PCT International Search Report—PCT/US05/33533", (Apr. 28, 2006), 2 pgs.
"PCT Written Opinion—PCT/US05/33533", (Apr. 28, 2006), 7 pages.
www.rangerdeadbolt.com, 3 pages.

* cited by examiner

SECURITY LINK

CROSS-REFERENCE TO RELATED APPLICATIONS

This application is a continuation of U.S. patent application Ser. No. 11/351,136 filed on Feb. 9, 2006, which is a continuation-in-part of U.S. patent application Ser. No. 11/231,210 filed Sep. 20, 2005, now U.S. Pat. No. 7,543,466, which claims the benefit of the filing date of U.S. Provisional Patent Application No. 60/611,369 filed Sep. 20, 2004, and U.S. Provisional Patent Application No. 60/651,414, filed Feb. 9, 2005. The disclosures of each of the foregoing applications are hereby incorporated herein by reference as if fully disclosed herein.

BACKGROUND OF THE INVENTION

The present invention relates in general to padlock enhancement systems. Such systems may be utilized to secure objects that may conventionally be secured by a padlock, but include features to compensate for inherent weaknesses in the conventional padlock design.

The systems included in the present application may be utilized for securing objects such as chain, cable, or other flexible or non-flexible elements, or conventional barn-door style intermodal container or trailer locking systems with shackle padlocks of various configurations. Such attachments may accept links of chain or similar engaging elements to provide relatively great resistance to forced attack while maintaining ease of use, flexibility in application, and cost effectiveness. The attachments also provide provisions for association with conventional barn-door style locking systems for added security.

It is well known that the "weak link" in a chain or cable-lock system is often the lock itself, and therefore the lock is a common attack point. For example, in the most basic system, a U-shackle type padlock may secure a length of chain. Depending on the padlock used, the chain is often much stronger than the lock itself. Thus, the lock may be attacked either by applying a torque to the shackle, or simply applying a tension force to the shackle by pulling on the chain. The present invention provides means to combat these common attack methods by providing novel attachment means for a lock to attach to a locking system. In accordance with certain aspects of the present invention, and to further provide security, the shackle of the lock may be completely hidden, such that attack upon the shackle is extremely difficult.

In barn-door style locking systems, it is well known that common attack points are the rivets that secure the locking system to the doors, or the rivets that secure the pivoting handle to the vertical rod. In accordance with certain aspects of the present invention, a link system may be employed to protect these vulnerable areas, in addition to protecting the lock itself.

Additionally the present invention permits the exploitation of the following advantages:

(A) Hockey Puck Style Locks: The conventional well known "shackleless" cylindrical padlocks with hidden straight shackles generically referred to as hockey puck locks are in common use today. Hockey puck locks are shown in U.S. Pat. No. 3,901,058 issued to Best, U.S. Pat. No. 3,769,821 issued to Randel, and U.S. Pat. No. 6,766,671 issued to Haczynski et al. These examples each provide a recess within the lock to accept a specific attachment, hasp, or staple of a generic hasp of appropriate dimension to fit and provide for the engagement of the straight shackle which passes through the recess. The resulting assembly provides a hidden shackle and hasp or attachment protected from forced attack by the surrounding body of the padlock.

Heretofore, such hockey puck style locks have typically been employed directly to locking systems of doors, such as doors of cargo vans. Aspects of the present invention provide means for the engagement of chain, cable, or chain like elements by means of a novel attachment device, which engages within the recess of the cylindrical padlock body. The hidden straight shackle of the padlock may then pass through the hole provided in the device to result in the secure assembly of chain, attachment, and padlock. Such an assembly can broaden the use of conventional hockey puck style locks, and can provide for security levels heretofore unachievable by convention locking systems.

Aspects of the present invention may also provide for a shielding element to protect the vulnerable bottom of the hockey puck style padlock. These aspects may include facility for mounting the novel attachment device to an object or structure to provide a system of security including padlock, chain (or other flexible or non-flexible element), item to be secured, and a fixed structure.

(B) Straight Shackle Style Padlocks: Straight shackle padlocks in which the shackle is not hidden and is readily visible are also in use today. Locks of this type are shown in U.S. Pat. No. 2,104,981 issued to Falk, U.S. Pat. No. 4,183,235 issued to Coralli, or U.S. Pat. No. 5,442,941 issued to Kahonen. These examples also offer a recess to accept the attachment for chain, cable, or chain like flexible elements that would be engaged by the straight shackle to provide the secure assembly of attachment, chain and padlock. Additionally the well-known ring shackle, or circular shackle, padlocks generically referred to as disc padlocks provide features similar to the straight shackle padlocks described above. Locks of this sort are shown in U.S. Pat. No. 62,636 issued to Kelly, U.S. Pat. No. 1,788,396 issued to Johnson, and U.S. Pat. No. 4,998,423 issued to Hsu. These examples also accept attachments contemplated by the present invention.

Aspects of the present invention provide for the engagement of chain, cable, or other flexible or non-flexible elements with a specific attachment device, which engages within the exposed recess of the padlock and provides sufficient structure to protect both the shackle and the elements of the attachment device from forced attack.

(C) The conventional well-known U-shackle padlocks, which are provided with a shield or shroud, are in limited use today. Locks of this sort are shown in U.S. Pat. No. 3,835,675 issued to Guillermo, U.S. Pat. No. 4,102,162 issued to Miller, or U.S. Pat. No. 5,146,771 issued to Loughlin, an inventor herein. These examples also offer a recess to accept the attachment for chain, cable, or chain like elements that would be engaged by a protected U-shackle to provide the secure assembly of attachment, chain and padlock. The most common U-shackle padlocks may also accept the attachment contemplated by the present invention when configured with the appropriate and compatible dimensions.

Aspects of the present invention provide for the engagement of chain, cable or other flexible or non-flexible elements with a specific attachment device, which engages within the recess of the shrouded padlock or conventional padlock and provides sufficient structure to protect both the shackle and the elements of the attachment, chain and padlock.

These and other aspects of the present invention will be discussed more fully below. However, it is noted that it would be advantageous to provide a chain attachment for shackle padlocks which aids in securing a chain/cable-type lock system in a manner not heretofore envisioned. It would also be advantageous to provide a similar system for use with barn-door style container/trailer doors. Each of these systems provide for security levels heretofore unimagined.

SUMMARY OF THE INVENTION

The chain attachment for shackle padlocks of the present invention is designed to overcome the deficiencies of the prior art. Several objectives and advantages of this invention follow from the novel method by which the attachment mechanism is utilized in conjunction with a chain/cable system.

In general, the security link of the present invention is designed to work in conjunction with a shackle lock, such as a straight shackle lock, hockey puck lock, padlock, or cylinder lock, such that securing elements of the link, typically posts or ears, secure securing members, such as chain, cable, or other flexible or non-flexible securing members, in a manner heretofore unrealized. In this regard, the link is designed to withstand potential forces exerted on the securing member, rather than the lock, as is known.

In other aspects of the invention, the novel link, in conjunction with a strap system, may be added to security systems of the type having a vertical lockrod and hinged handle, typically found on container and truck doors.

More specifically, in accordance with one aspect of the present invention, the invention may include a link for connecting at least one securing member with a locking device having a body and a shackle, the link comprising a base having a through hole adapted to receive the shackle of a locking device, and a first securing element associated with the base, the first securing element being adapted to receive a first securing member, wherein the through hole of the base and the first securing element are arranged so that when the shackle of the locking device is inserted through the through hole of the base, the locking device is arranged to block the first securing member from being separated from the securing element.

The link may further comprise a second securing element associated with the base, the second securing element adapted to receive a second securing member, wherein the through hole of the base and the second securing element are arranged so that when the shackle of the locking device is inserted through the through hole of the base, the locking device is arranged to block the second securing member from being separated from the second securing element.

The securing member may be one of a chain or a cable.

The securing element may be one of an ear or a post.

Where the securing element is an ear, the ear may be one of C-shaped, J-shaped, or U-shaped. The ear may include an end adapted to be located in close proximity to the body of the locking device when the shackle of the locking device is inserted through the through hole to prevent the securing member from being unsecured through a gap created between the securing element and the body of the locking device.

Where the securing element is a post, the locking device may be adapted to rest atop a portion of the post to block the securing member from being unsecured when the shackle of the locking device is inserted through the through hole.

The link may further comprise a channel adapted to receive a second securing member. The first and second securing members may be portions of a single securing member. The channel may include a ratcheting device adapted to permit the second securing member to move through the channel in only one direction.

The link may include additional features, such as an anti-rotation step, apertures to permit mounting thereof, a raised lip partially surrounding the lock, a cutout in lip permitting use of the keyed cylinder of the lock, or a generally circular shape in registration with a lock. In addition, the locking device may be a hockey puck lock. Where the locking device is not a hockey puck lock, the link may also include a plate adapted to permit use of a shackle lock, such as a padlock, or straight shackle lock. The plate may be thick such as portions of the plate block the securing member from being freed of the link, or may be thin in the case where the plate rests on the securing member, yet may still block the securing member from being freed from the link. The plate may include an aperture through which the post may penetrate. Finally, the plate may also include an anti-rotation step which may be placed in registration with the anti-rotation step of the link.

The ears or parts of the link may also be provided with magnets to help temporarily retain ferrous metal securing elements during installation.

In accordance with further aspects of the present invention, there is disclosed a device adapted to connect a first securing member to a second securing member, where the device comprises a body having an aperture and first and second securing elements, the aperture adapted to receive the shackle of a lock and the first and second securing elements adapted to receive the first and second securing members. The first securing element may be inserted through the first securing member, the second securing element may be inserted through the second securing member, and the shackle of the lock may be inserted through the aperture such that the lock inhibits the securing members from being disassociated with the first and second securing elements.

The first securing member may be one of a chain link or the looped end of a cable.

The link may further comprise a second aperture adapted to receive the shackle of a lock, wherein the second aperture permits use of locks with shackles of a size different from the size of the shackle of the lock adapted to be inserted through the first aperture.

The link may include additional features. For example, the link may be generally triangular in shape. In such configuration, an aperture may be configured in one corner with the first and second securing elements in each of the other corners. The securing elements may be C-shaped, J-shaped, or the like. The link may be made from ferrous or non-ferrous metals or alloys, and may be coated for protection, such as from outdoor elements.

In accordance with still further aspects of the invention, a system for securing a locking device having a handle hinged to a vertical lockrod may comprise a strap having a first end and a second end, the first end may be adapted to associate with the vertical lockrod of a locking device such that the strap may rotate around the first end, the second end having an aperture therethrough, a link having a passage therethrough, the link adapted to be slid onto the handle of the locking device such that the handle passes through the passage, the link having a raised portion, the raised portion having a through hole, the raised portion adapted to extend through the aperture of the strap such that a lock may be secured through the through hole of the raised portion to prevent the handle from being manipulated in such a manner as to unlock the locking device.

Where the device further includes a hasp adapted to bind the handle, the strap may further comprise an aperture permitting the hasp to extend therethrough for use.

The device may include additional features. For example, the strap may include features, such as extension features, to cover the rivets securing either or both of the hasp or the hinge. The first end of the strap may comprise at least one hook. The at least one hook may be U-shaped to substantially surround the vertical rod. The strap may be configured in non-planar sections to fit closely with the handle. Finally, the apertures at the second end of the strap may be crescent shaped, to accept the interrupted raised lip of the link.

In accordance with additional aspects of the present invention, a system is disclosed for providing additional protection to a locking device of the type having a handle hinged to a vertical lockrod and a hasp adapted to bind the handle when in a locked position, where the system comprises a strap having a first end adapted to wrap at least partially around the vertical lockrod and a second end adapted to be placed adjacent to the handle when the handle is in the locked position, the second end including a notch, a link comprising a base having an aperture, the aperture adapted to permit entry of the handle and the second end of the strap, the link further comprising a post having a post through hole, the post through hole being adapted to accept the shackle of a lock, a plate configured to fit against the link, the plate comprising a plate with a plate through hole, the plate through hole configured to register with the post through hole, and a pin, the pin adapted to enter the notch when the plate through hole is in registration with the post through hole such that the interference between the pin and the notch prevents the link from being slid and removed from the handle and the strap.

The link may further comprise a spring adapted to bias the plate toward a position wherein the pin is not within the notch.

The system may include additional features. For example, the springs may be permanently attached to the link. The strap may include features, such as extension features, to cover the rivets securing either or both of the hasp or the hinge. The first end of the strap may comprise at least one hook. The at least one hook may be U-shaped to substantially surround the vertical rod. The strap may be configured in non-planar sections to fit closely with the handle.

In accordance with yet an additional aspect of the present invention, a locking device may comprise a link having a first hook and a post extending therefrom, the first hook adapted to be secured around a first object and the post adapted to accept a lock, a second hook having a straight portion with at least one aperture, the second hook adapted to be secured around a second object with the straight portion placed over the post, whereby the post may accept a lock such that the first object and the second object may be secured together.

The at least one aperture may be a plurality of apertures and the length of the locking device may be adjusted by positioning the second hook over the post through different apertures.

The locking device may include additional features, such as being of a thickness to fit between the vertical lockrod and door of a typical container locking system.

In accordance with an additional aspect of the present invention, where a link system for connecting at least one securing member with a locking device having a body and a shackle is disclosed, the link may comprise a base having a post with a through hole adapted to receive the shackle of a locking device, a plate adapted to fit against the base, the plate comprising an aperture through which the post of the base may be inserted, a first securing element associated with the base, the first securing element adapted to receive a first securing member, wherein the base and the plate are constructed and arranged so that the shackle of a lock may be inserted through the through hole of the post after the plate is fitted against the link such that the plate blocks the first securing member from being separated from the securing element and the shackle blocks the plate from being released from against the base.

The link system may therefore be adapted for use with a U-shackle padlock, straight shackle padlock, circular shackle padlock, or the like.

In accordance with additional aspects of the present invention, a device may be adapted to connect a first securing member to a second securing member, the device may comprise a link having a base with an interrupted raised lip forming an internal cavity, the base having a hasp extending into the internal cavity, the hasp having a through hole, and the raised lip having interrupted areas. A first securing element may be associated with the base at a first interrupted area, the first securing element may be adapted to secure a first securing member. A second securing element may be associated with the base at a second interrupted area, the second securing element may be adapted to secure a second securing member. The device may also include a lock having a shackle and a body, the lock may be adapted to be fitted within the internal cavity such that the shackle may be inserted through the through hole of the hasp with the body inhibiting the first and second securing members from being disassociated with the first and second securing elements.

The internal cavity may be circular and the lock may be a hockey puck style lock.

The first securing element may be one of a post or an ear.

The device may further comprise a lock retention component associated with the raised lip, the lock retention component retaining the lock within the internal cavity and arranged such that the lock may move between a first position in which the lock is positioned against the lock retention component and the first and second securing members are free to be associated or disassociated with the first and second securing elements, and a second position in which the lock is positioned against the base such that the body of the lock inhibits the first and second securing members from being associated or disassociated with the first and second securing members.

The lock retention component may be one of a pin or a retaining ring.

The device may further comprise a retaining mechanism for retaining the first securing member to the link when the lock is in the first position. The retaining mechanism may be a set screw.

In accordance with further aspects of the present invention, a link may be adapted to secure an attachment mechanism having a straight segment, the straight segment having an engagement element for engagement with the link, where the link may comprise a base having a raised lip forming an internal cavity, the base having a hasp extending into the internal cavity, the hasp having a through hole, the base also having a shaft extending into the base from the internal cavity and an aperture extending through an external wall of the base, the aperture being in communication with the shaft, and the aperture adapted to receive the straight segment of the attachment mechanism. The device may also comprise a plate having an aperture through which the hasp may be fitted, the plate further comprising a pin adapted to fit within the shaft of the base when the plate is against the base, wherein a lock having a shackle may be positioned within the cavity such that the plate is against the base and the pin is within the shaft the pin associating with the engagement element of the attachment mechanism to prevent translation of the attachment mechanism through the aperture.

The engagement element of the attachment mechanism may be one of a notch or a channel.

The link may further comprise a spring recess adjacent to the shaft and a spring adapted to fit within the spring recess when compressed, the spring may be adapted to lift the plate off the surface of the base when uncompressed.

The straight segment of the attachment mechanism may completely penetrate through the link, the straight segment having an end with a restrictive element preventing the attachment mechanism from being withdrawn completely from within the base. The restrictive element may be removable to permit the attachment mechanism to be withdrawn completely from within the base.

The link may further comprise a mechanism to impair movement of the shackle when the shackle is within the cavity regardless of the position of the pin. The mechanism to impair movement may comprise a channel formed within the base, a spring having two ends positioned within the channel and a displaceable element associated with one end such that the displaceable element may engage the engagement element of the attachment mechanism to impair translation of the attachment mechanism. The displaceable element may be a ball bearing.

In accordance with other aspects of the present invention, a system for securing a spaced-apart door locking device having a pair of vertical lockrods hinged to a pair of handles adapted to rotate the lockrods to unlock a pair of doors, may comprise a strap with a cover and a base, the base having a base main portion with a hasp and a base finger portion with a pair of spaced-apart fingers, the fingers being curved back toward the base main portion, the cover having a cover main portion with an aperture and a cover finger portion with a pair of spaced-apart fingers, the fingers being curved back toward the cover main portion, wherein the fingers of the base may be wrapped at least partially around a first of the vertical lockrods such that the base main portion is adjacent to the doors and the fingers of the cover may be at least partially wrapped around a second of the vertical lockrods such that the cover main portion sandwiches the base main portion between the cover main portion and the door, the hasp penetrating the aperture.

The system may further comprise a third finger associated with the main portion of the base, the third finger adapted to fit within the spaced-apart fingers of the cover to engage the second vertical lockrod.

The system may further comprise a stop-block associated with the finger portion of the base, the stop block adapted to prevent bending of the first vertical lockrod. A straight finger may be associated with the finger portion of the base, the straight finger positioned between the spaced-apart fingers.

The main portion and the finger portion of the base may be separate components, and the overall length of the base may be adjustable. The finger portion of the base may further comprise a grooved segment and the main portion may comprise a corresponding grooved segment, the grooved segment and the corresponding grooved segment capable of association to fix the overall length of the base.

The cover and the base may be non-linear such that portions of the cover and the base are offset toward the door.

The cover may further comprise a protective shroud covering the hasp of the base when associated with the cover. The protective shroud may comprise a generally open end and a generally closed end, the generally open end adapted to permit entry of a lock having a body and a shackle and the generally closed end permitting entry of the shackle. The protective shroud may include a permanently mounted therein.

In accordance with additional aspects of the invention, a system is disclosed for further securing a door locking mechanism having a handle hinged to a vertical lockrod and a hasp connected to the door, where the system may comprise a link having a base with a raised lip forming an internal cavity, the base having an aperture through which the door hasp may extend, an extension member associated with the base, the extension member having an oversized aperture adapted to permit passing of the handle, wherein the handle may be passed through the aperture and a lock may be inserted into the internal cavity and engaged with the hasp to secure the handle. The link may include a groove-within which the hasp of the door may fit to permit the base to be flush with the door.

In each of these aspects, various features have been disclosed. It will be appreciated that many of the features are interchangeable between the various aspects, and that they may be utilized in various combinations to achieve the inventive results. Accordingly, various combinations of disclosed features may be included in the above aspects of the invention, or additional aspects not specifically described herein, but which are included in this disclosure.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

In regard to the drawings.

FIG. 15 depicts a perspective view of a conventional locking assembly used on barn-style doors of intermodal containers, trailers, and the like;

FIG. 52 depicts a perspective view of another conventional locking assembly used on barn-style doors of intermodal containers, trailers, and the like;

DETAILED DESCRIPTION

Figure 1:
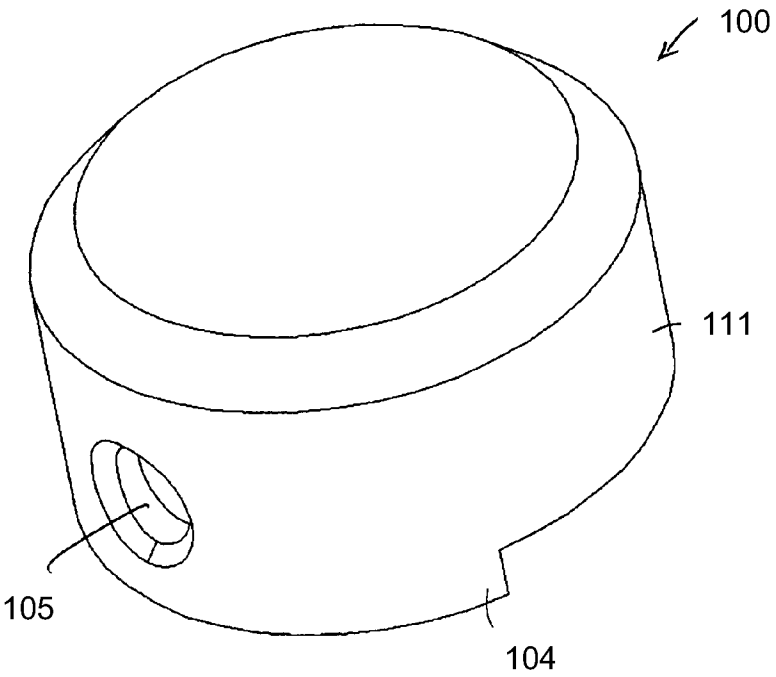
FIG. 1 (prior art)
FIG. 1 depicts a top perspective view of a conventional hockey puck lock.

The following describes the preferred embodiments of the multiple function lock in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

It will become evident to one skilled in the art that several objectives and advantages of this invention follow from the novel aspects of the present invention by which the traditional security functions are achieved using multiple security elements in combination.

Throughout this disclosure, the term shackle shall be construed broadly to include the portion of a lock which extends from the body and which is typically moveable to engage with securing members such as hasps, chain, cable or the like.

FIG. 1 depicts a perspective view of a conventional cylindrical, hidden shackle pad lock, commonly referred to as a hockey puck lock 100. The hockey puck style lock 100 includes an outer casing 111 which is shaped in a manner similar to that of a hockey puck, thus giving the lock its name.

Figure 2:
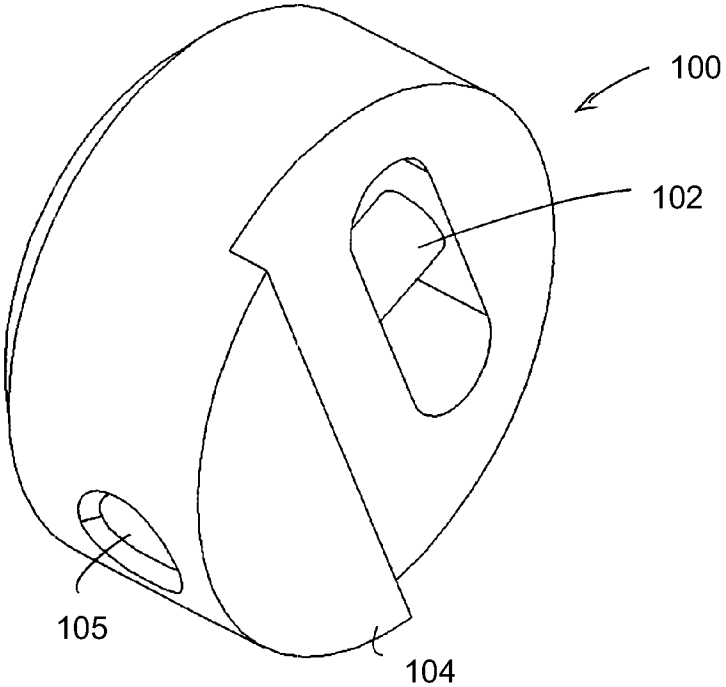
FIG. 2 (prior art)
FIG. 2 depicts a bottom perspective view of the conventional hockey puck lock of FIG. 1.

Shown in FIG. 2 is a bottom perspective view of a conventional hockey puck lock 100. The drawing figure shows shackle 102 and anti-torque step 104. The step 104 is typically part of the standard form factor of a conventional hockey puck lock 100, and is a built-up shoulder area formed as part of outer casing 111. Other embodiments may have a flat bottom. However, if provided, the step 104 may cooperate with associated appurtenances to prevent the hockey puck lock 100 from rotating. This reduces the ability of a malfeasant from placing a torque or twisting force on the shackle 102 in an attempt to compromise the shackle and thus the security of the lock 100. Even with the step 104 in place, the bottom of the conventional hockey puck lock 100 is still generally vulnerable to attack, particularly where the shackle 102 is exposed.

The hockey puck lock 100 utilized in the present invention may be operated in the conventional manner. For example, the shackle 102 may be manipulated by a keyed cylinder 105, as is known in the industry.

Figure 3:
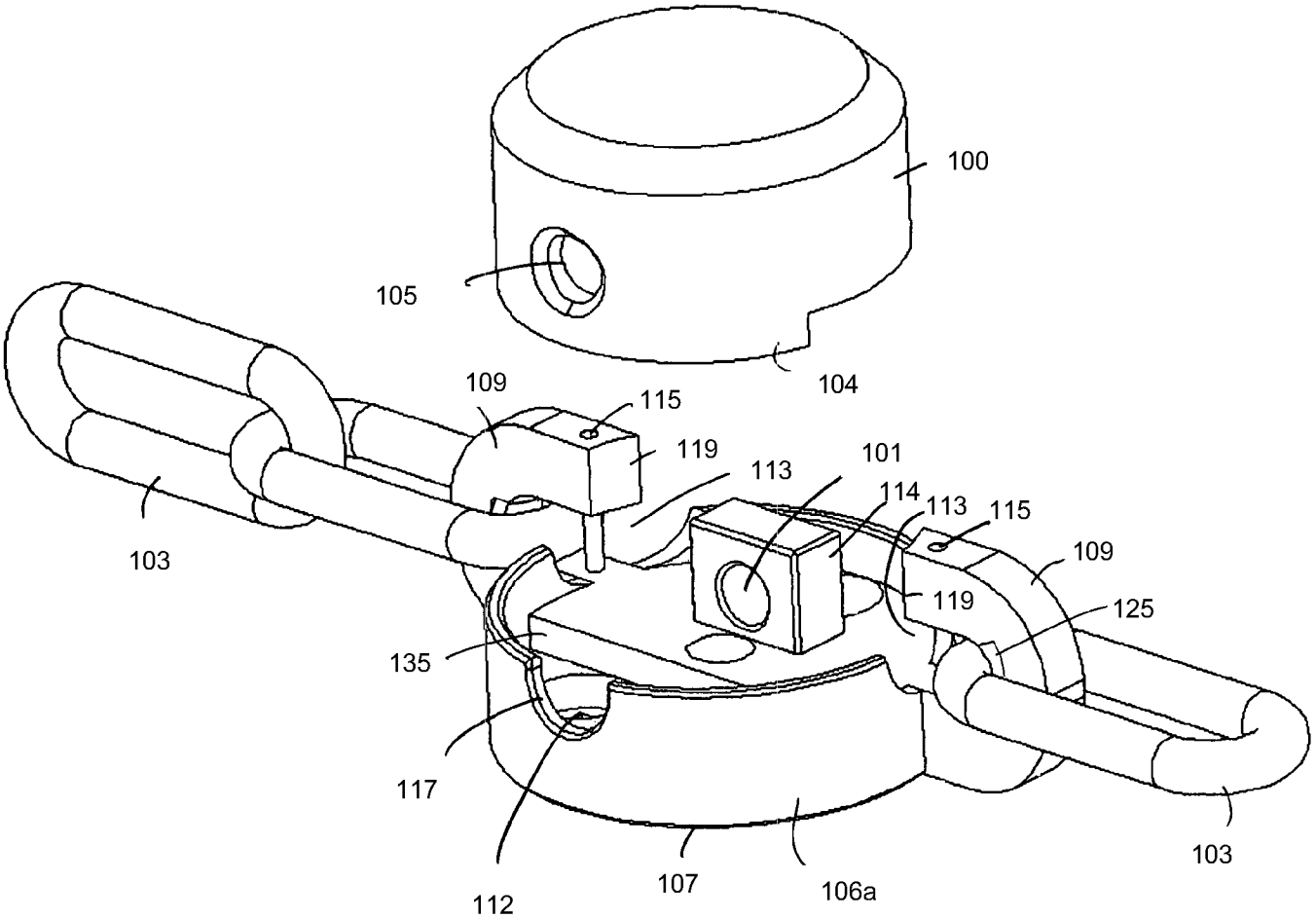
FIG. 3 depicts a perspective view of a link system in accordance with certain embodiments of the present invention, with the hockey puck lock detached.

FIG. 3 depicts a partially exploded perspective view of a link **106*a* in accordance with certain aspects of the present invention along with a hockey puck lock 100 and chain 103. In accordance with the aspects of the invention depicted in FIG. 3, a link 106*a* may be compatible with flexible or non-flexible securing devices, such as either chain 103 or cable having end loops. Chain 103 is shown in FIG. 3. For ease of reference, chain 103** will generally be referred to throughout the various aspects of this disclosure. However, it is to be understood that other securing devices may also be utilized, flexible or not.

The link **106*a* may include a base 107 having a pair of extension members, here shown as protruding ears 109. The protruding ears are preferably C-shaped, with openings 113. In other embodiments, the extension members may be U-shaped or J-shaped. The base 107 and ears 109 of the link 106*a* may be configured such that a chain 103 may be placed over and around the ears 109, through opening 113, such that the ears prevent the chain from being pulled from the link. This arrangement is shown in FIG. 3**.

Figure 4:
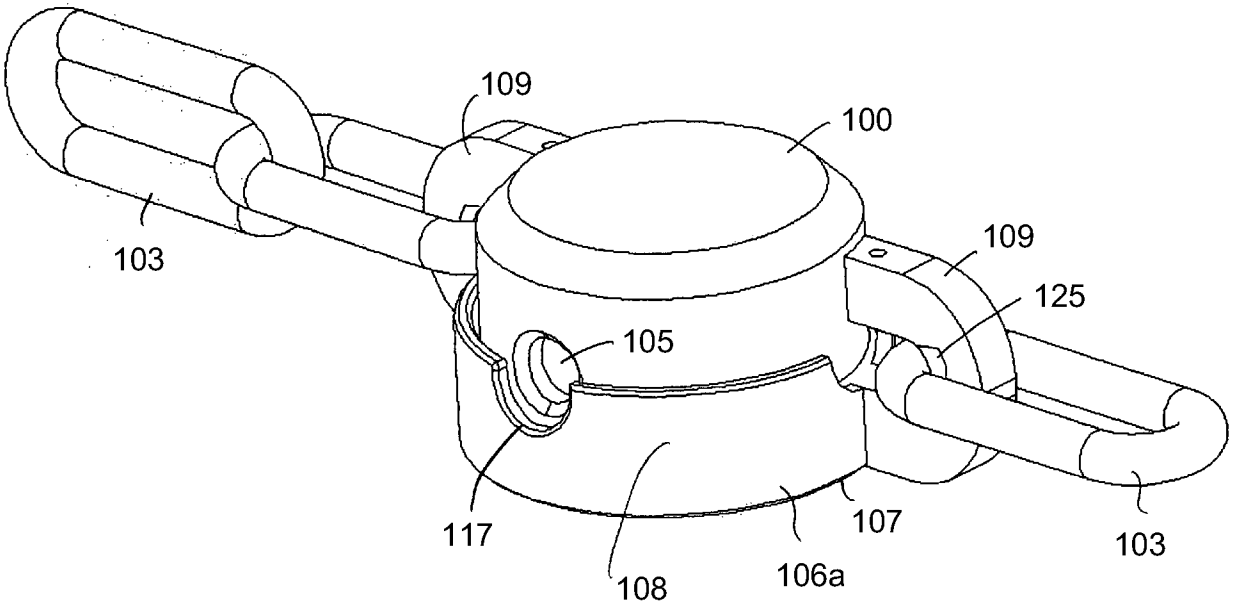
FIG. 4 depicts a perspective view of the link system of claim 3, with the hockey puck lock attached.

After being placed in such an arrangement, the chain 103 may be followed by a conventional hockey puck lock 100, such that the hockey puck lock 100 blocks the chain from being removed from the ears 109 through the opening 113 without prior removal of the hockey puck lock, such as shown in FIG. 4. It will be appreciated that the ears 109 are configured such that the space between the free end 119 of the ears is relatively close to the outer casing 111 of lock 100, or at least close enough that chain 103 may not fit therebetween. In other embodiments, the ears 109 may include pins or posts 115 which may either be installed permanently to secure the chain 103, or may be removable. Typically, only one pin 115 will be permanently installed and the opposite ear 109 will be provided without a pin, such that chain 103 may be attached and detached from the pinless ear. Even if the pins or posts 115 are installed permanently, the hockey puck lock 100 serves to provide an additional level of protection for the link system. The ears 109 may also include embedded magnets 125 to help retain ferrous metal securing devices, such as chain 103, during installation thereof.

Referring back to FIG. 3, it will be appreciated that when installed upon the link **106*a*, the shackle 102 (FIG. 2) of the hockey puck lock 100 engages a through channel 101 extending through the pin or post 114 protruding from the link 106*a***, to secure the hockey puck lock to the link in the conventional manner.

Features of the link **106*a* in accordance with this embodiment may include a raised lip 108 extending from the base 107 to prevent a prying or wedging attack when the conventional hockey puck lock 100 is in place. The lip 108 may be notched with a cutout 117 to allow access to the keyed cylinder 105 of the hockey puck lock 100. Mounting holes 112 may be provided in the bottom of the link 106*a* to allow mounting of the link 106*a* to a surface using carriage bolts or the like. A center mounting hole 112 may be provided to allow the link 106*a* to be mounted to a surface while also permitting the link to be rotated. The link 106*a*** may also be welded to a surface or used un-mounted, so as to be freely transported.

The free end 119 of the ears 109 may be contoured to minimize the gap between the free end of the ears and the lock body 100 when the lock is in place, such as shown in FIG. 4. As previously discussed, the ears 109 may also include a feature, such as a simple post or pin 114, which allows one or both ends of the chain or cable to be retained permanently.

In addition, the link 106*a* may include an anti-rotation step 135 within the raised lip 108. The anti-rotation step 135 may be configured to mate with the step 104 of hockey puck lock 100, such that the lock may not be rotated when installed.

The link 106*a* may be fabricated by machining, casting, welding, molding, forging, etc. Materials utilized may be suitable ferrous or non-ferrous metallic alloys or suitable non-metallic materials, such as plastics. Preferably, the link 106*a* is formed from material which is sufficiently durable to withstand forced attack, while also being capable of long-term external exposure.

It will be appreciated that when the chain 103 is pulled, such as during a forced attack or other tension inducing activity, the loads, or forces applied, to the chain will be transferred through the link 106*a*, and particularly the ears 109. The loads will not be transferred to the shackle 102 of the hockey puck lock 100 as would occur if the hockey puck lock was used without the inventive link 106*a*. This feature enables security levels greater than would be capable if the shackle 102 was required to withstand the load, and is utilized in further embodiments of the invention, as will be discussed. In this regard, the strength of the link 106*a* and ears 109 may be much greater than that of the lock 100, while still being very cost-effective and simple to manufacture.

Figure 5:
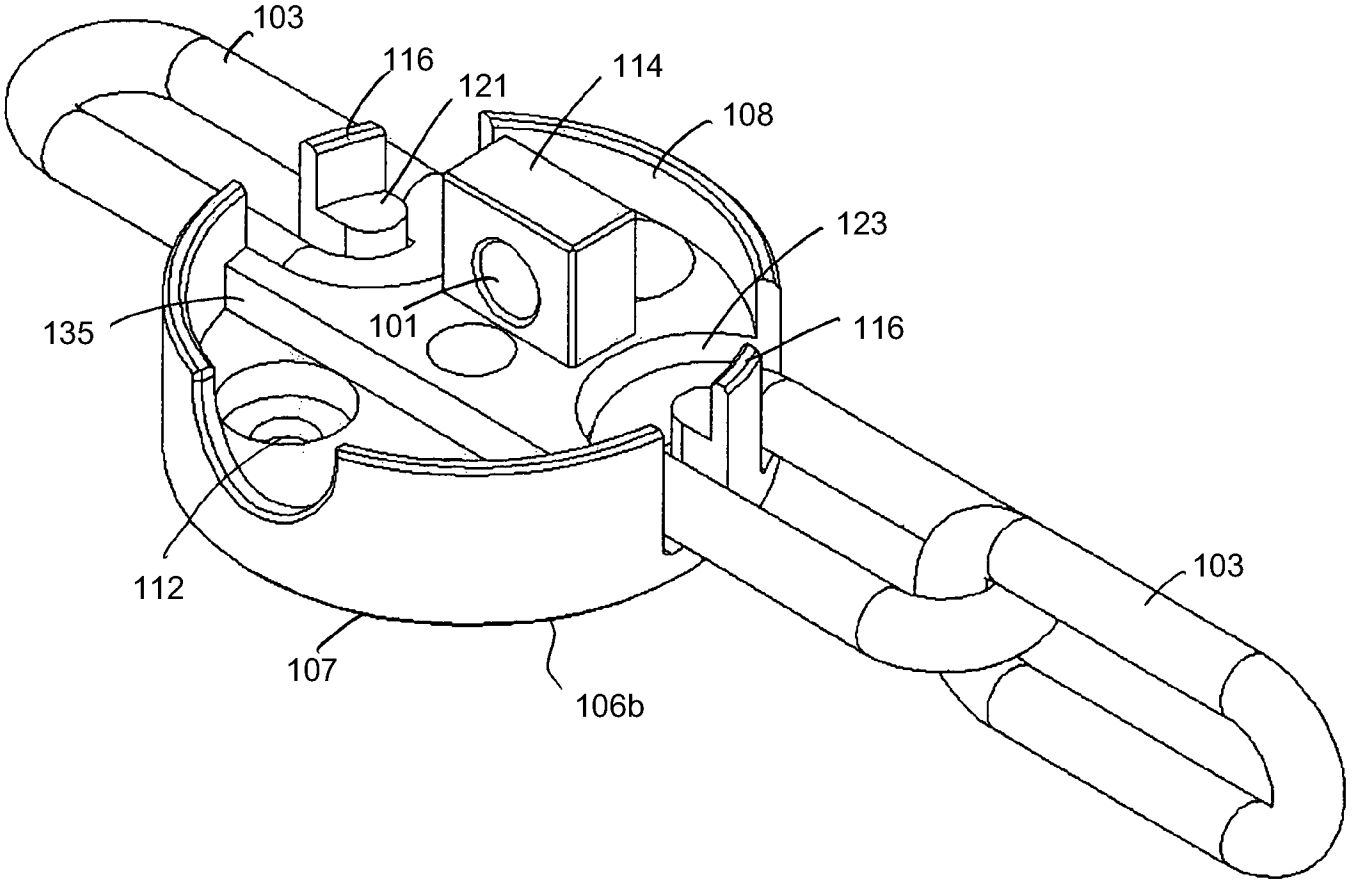
FIG. 5 depicts a perspective view of a link system in accordance with further aspects of the present invention.

FIG. 5 depicts a perspective view of a link 106*b* in accordance with further aspects of the present invention with a chain 103 attached, but without a hockey puck lock 100 in place. The link 106*b* depicted in FIG. 5 includes posts 116 formed from portions of the raised lip 108 of the base 107 rather than ears 109. The posts 116 permit the end or ends of a chain 103 to be assembled onto the link 106*b* by being placed over the posts 116 and into a recess 123. The posts 116 include a stepped portion 121 which is above the level of the recess 123. A hockey puck lock 100 may be placed upon the stepped portion 121 when installed. In this regard, securing of the shackle 102 of the hockey puck lock 100 through the through channel 101 of post 114 places the casing 111 of the hockey puck lock over the chain 103, to secure the chain to the link 106*b*. Unless the hockey puck lock 100 is removed, the chain 103 cannot be released from the link 106*b*.

Although not shown in association with this particular aspect of the invention, it is noted that the recess 123 permits use of a feature that may retain one or both ends of the chain 103 when the hockey puck lock 100 is not in place. Such a feature, not shown, may be a simple-screw threaded into the link 106*b* adjacent to the recess 123 such that the head of the screw may be driven against chain 103 to block the chain from being removed from the recess 123. Other mechanisms, such as rotating blocking gates, or embedded magnets may also be utilized.

It is believed that the link 106*b* shown in FIG. 5 is easier and more cost effective to manufacture than the link 106*a* shown in FIGS. 3 and 4. It is also believed that the link 106*b* shown in FIG. 5 may be more secure than the previous link 106*a* because the ears 109 of the previous link 106*a* may be vulnerable to attack, particularly through prying away of the ears. It is much more difficult to forcibly attack the posts 116 of the link 106*b* shown in FIG. 5, as there is less area for a malfeasant to attack. Even if a malfeasant were capable of prying a post 116 away from its generally vertical orientation, the chain 103 would not readily lift from the post, as the hockey puck lock 100 would still retain the chain. Rather, the entire hockey puck lock 100 would have to be removed or the post 116 severely compromised.

Figure 6:
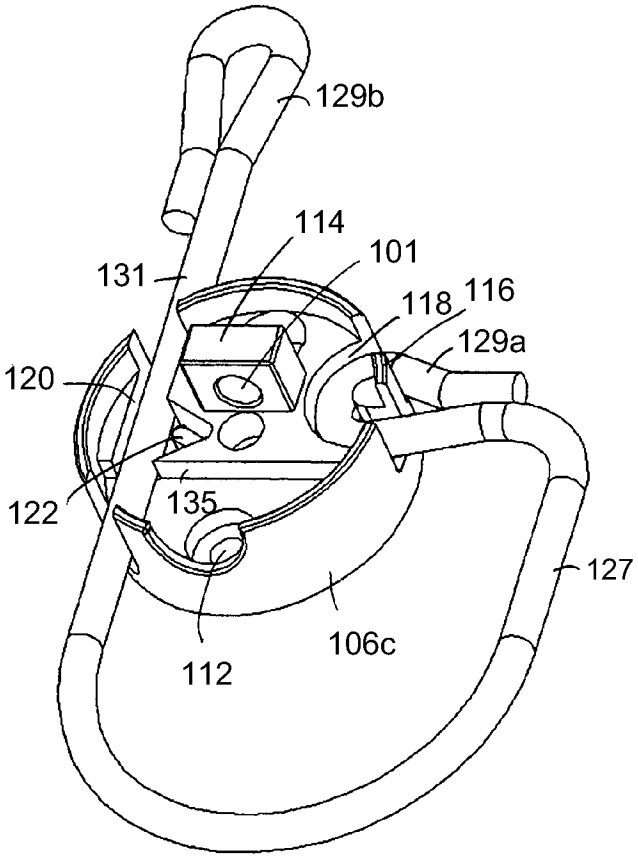
FIG. 6 depicts a perspective view of a link system in accordance with yet another aspect of the present invention.

In accordance with yet another aspect of the present invention, as shown in FIG. 6, a link 106*c* may build on the teachings of the previous link 106*b*. In this regard, the link 106*c* may include a recess (here identified as arched recess 118) and a post 116. This portion of the link 106*c* may secure one end of a cable 127 that includes a looped end 129*a* forming a shape much like a chain's end. Of course, this arrangement may also secure other mechanisms such as simple chain.

The link 106*c* may also be compatible at its other side with a straight portion 131 of cable 127. In this regard, the link 106*c* may include a straight channel 120 in which the straight portion 131 of the cable 127 may lie. The straight channel 120 may be sized to just accept the diameter of the cable 127, such that the looped end 129*b* opposite the post 116 and looped end 129*a* may not pass therethrough. It will be appreciated that other features other than a looped end 129*b* may also be utilized to prevent the cable from being slid through the straight channel 131. For example, the end of the cable 127 may be built-up to a larger diameter than the remainder of the cable, or may include a feature such as a ball at its end.

When the hockey puck lock 100 is not in place, the cable 127 may be nested in the straight channel 120 shown. When the hockey puck lock 100 is in place, the cable 127 is restrained and secured, but may still be able to be slid partially in and out of the link 106*c*, along straight channel 120. The hockey puck lock may simply prevent the cable 127 from being lifted off the link 106*c*.

However, a ratchet device 122 may be provided within the link 106*c* such that once the cable 127 is nested in the straight channel 120, the cable may be cinched up to remove unwanted slack. The cable 127 may be cinched up before or after the hockey puck lock 100 is in place. The ratchet device 122 may be designed such that the cable 127 may be nested into the straight channel 120 from either the direction permitted by the ratcheting device, or from a direction above the link, perpendicular to the channel 120. However, once the hockey puck lock 100 is in place, the ratchet device 122 may only permit cable movement in one direction. In this regard, the ratchet device 122 may include teeth and may be spring loaded to facilitate only one way motion of the cable 127. The ratcheting device 122 may also, include a ratchet-override feature to permit the cable to be moved in a direction otherwise prevented by the ratchet device. Such ratcheting devices are well known in the industry.

Because coated cable 127 is typically preferred, it is generally preferred that the ratchet device 122 be arranged such that it does not mar the coating of the cable upon normal use.

As with the previous links shown and described, the shackle 102 of the hockey puck lock 100 may engage through channel 101 extending through a post 114 protruding from the link 106*c*.

Figure 7:
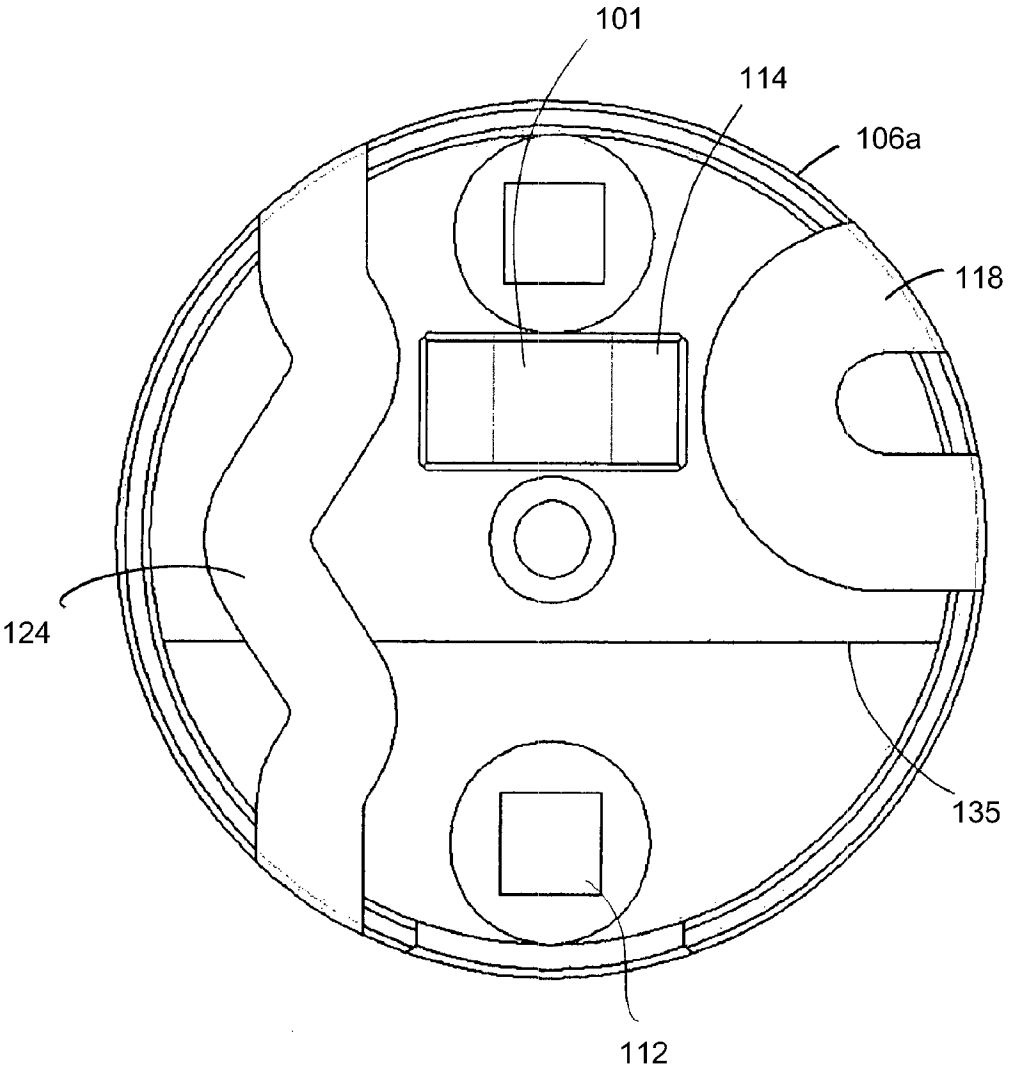
FIG. 7 depicts a top view of a link in accordance with an additional aspect of the present invention.

FIG. 7 depicts a top view of a link 106*d* in accordance with additional aspects of the present invention. As with link 106*c*, link 106*d* is primarily intended for use with a cable. A looped end of the cable (not shown) may be nested into the arched channel 118 as previous discussed with reference to link 106*c*. When the hockey puck lock is not in place, the cable (not shown) may be pushed into the irregular channel 124 shown. This irregular channel 124 is shaped to prevent the cable from being able to move along the long axis of the channel. This may be achieved by friction fit of the cable within the channel 124. Therefore, when the hockey puck lock 100 is in place, the cable is fully constrained and secured. Again, coated cable is preferred. As with the previous links, link 106*d* may be configured with a post 114 and through channel 101 upon which a hockey puck lock 100 may attach.

Another variation of the link 106*d* is to configure a second irregular channel in place of the arched channel 118. This variation would allow the use of cable which is un-looped at both ends, thus expanding the potential uses for the device. Additionally, a link may be provided with two ratcheting devices and channels such as those shown in FIG. 6, so un-looped cable may be used at both ends. Generally, it will be appreciated that many of the features of the various links disclosed herein may be utilized in any one particular link, such that the features may be "mixed-and-matched."

Figure 15:
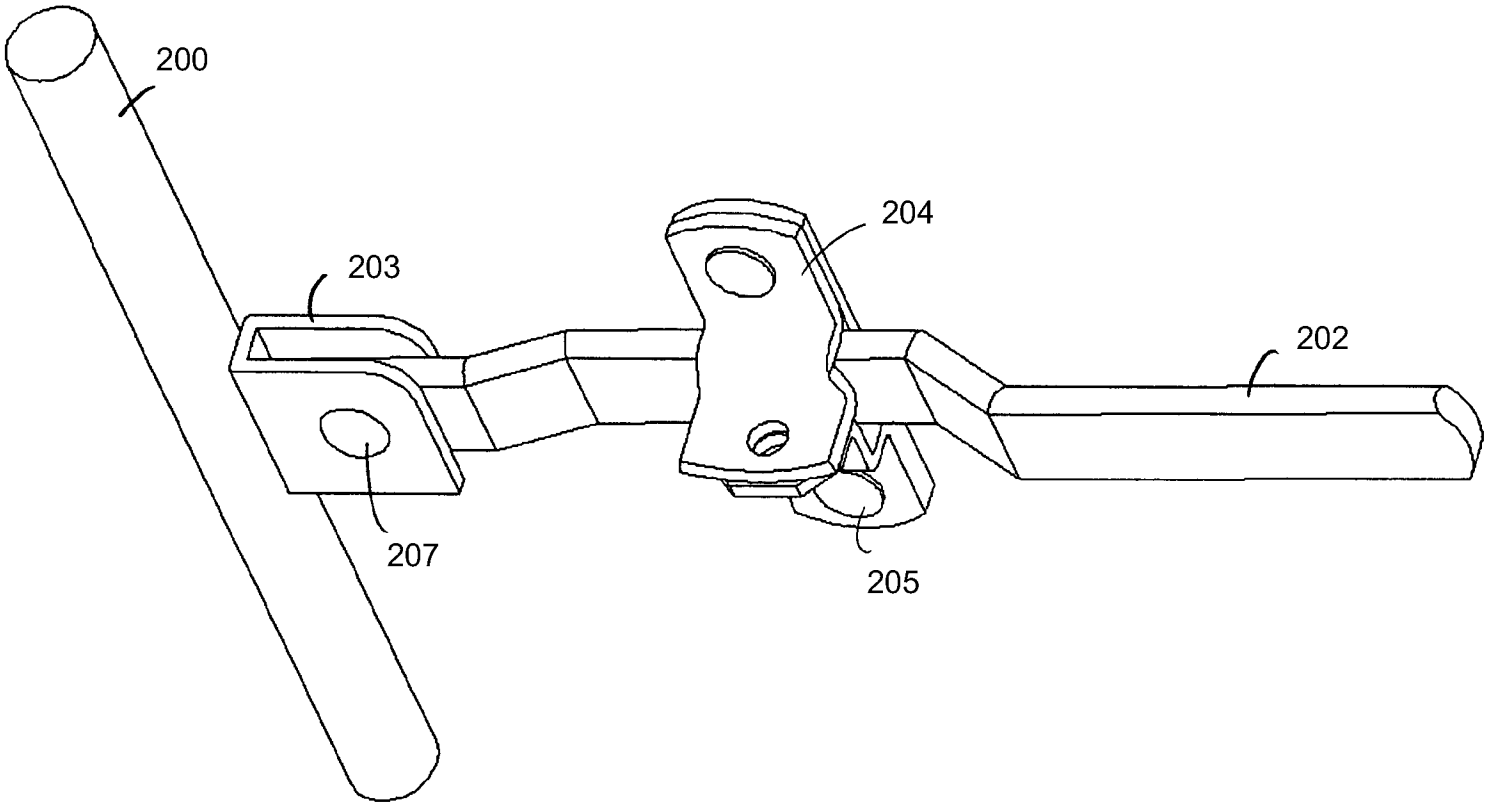

In accordance with additional aspects of the invention, a link may be configured for use with intermodal containers, trucks, rail cars, etc. It is common and well known in the industry that such containers may have a door locking arrangement that utilizes vertical lockrods connected to a lever. The vertical rods may be lifted out of their seat and rotated such that latching elements at the end of the rods are disengaged and released from their mating elements on the door frame. The typical lever arrangement is a well known weak point that is vulnerable to attack. A conventional arrangement of vertical lockrod, lever and latches is shown in FIG. 15, and is described more fully below.

Figure 8:
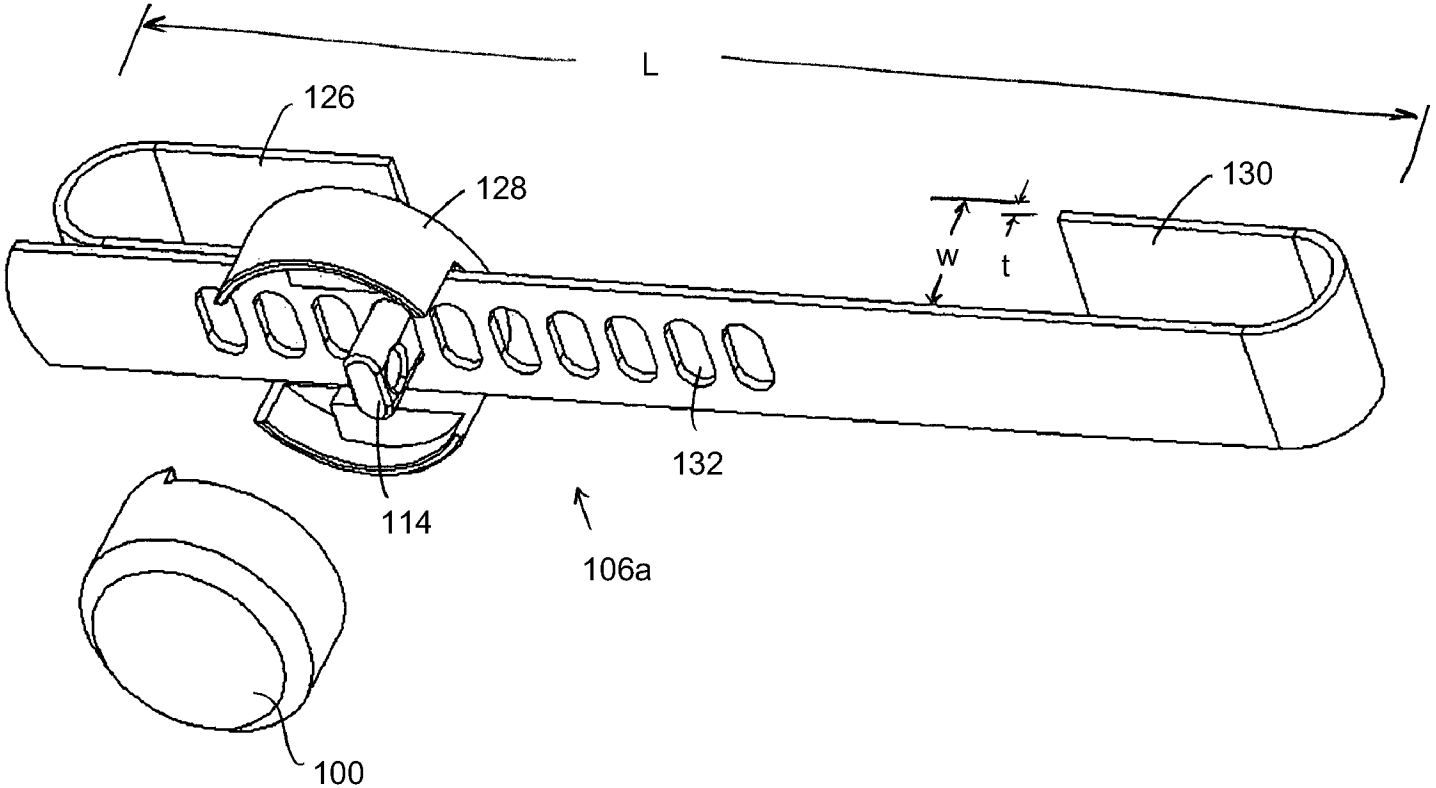
FIG. 8 depicts a perspective view of a link system in accordance with still further aspects of the present invention.

As shown in FIG. 8, link 106*e*, may be designed to fit a wide range of lockrod configurations. Variations in vertical lockrod configurations include, center to center spacing, gap between the vertical lockrod and the door face, and rod diameter. Link 106*e* is comprised of three primary elements: namely, a first hook 126 to hook around one vertical lockrod, an attachment element 128, and a second hook 130 that hooks around the other vertical lockrod. First hook 126 is preferably formed as a single structure with attachment element 128.

The link 106*e* has an array of features that allow adjustability over the typical ranges of lockrods. For example, the hooks 126, 130 are of a thickness (t) that permit them to be used where there is a narrow gap between the rods and the door face. The link 106*e* is also designed to accommodate the typical range of lockrod diameters by incorporating an oversized width (w).

The attachment element 128 is designed to receive a standard hockey puck lock to secure the hooks 126, 130 in place. Also as shown, hook 130 includes a series of apertures 132 arranged adjacent to one another along the length of the hook 130. Depending on the center to center distance of the vertical rods in which the link 106*e* is to be placed, the appropriate aperture 132 may be placed over the post 114 protruding from the attachment element 128, such that the hooks 126, 130 will be retained by the hockey puck lock 100 when installed and the overall length (L) of the link 106*e* will be appropriate for the application.

In addition, the link 106*e* shown in FIG. 8 may also be utilized with chain 103 or the like. For example, the hooks 126, 130 may be hooked around the chain and the link 106*e* locked. The hooks 126, 130 may be made long enough that so long as the chain is left taut, the chain may not be removed from the hooks. Other uses for the link 106*e* may include fence gates, such as chain link fence gates, where the hooks may be used to secure the gate from opening by attaching to the vertical fence gate supports.

Figure 9:
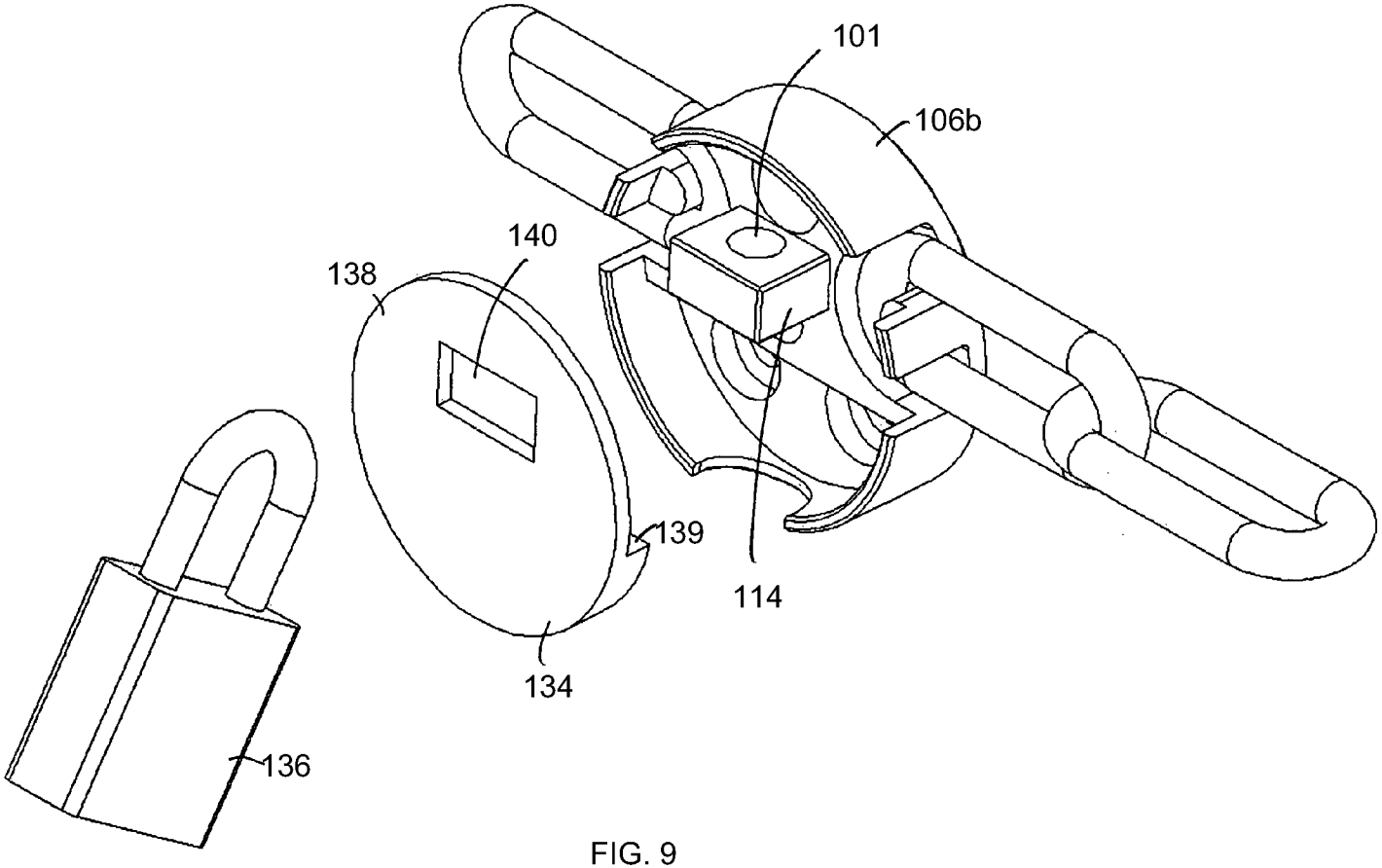
FIG. 9 depicts a perspective view of a link system in accordance with another aspect of the present invention in an unassembled condition.

In accordance with further aspects of the present invention, a link adaptor 134 may be provided for use with a link. FIG. 9 depicts a perspective view of a link system incorporating the link adapter 134 together with a link 106*b*, of the type described previously, and a conventional padlock 136. The link adapter 134 allows the conventional U-shackle padlock 136 or other padlock styles beyond that of the hockey puck locks 100 to be used with the various links of the present invention.

Figure 10:
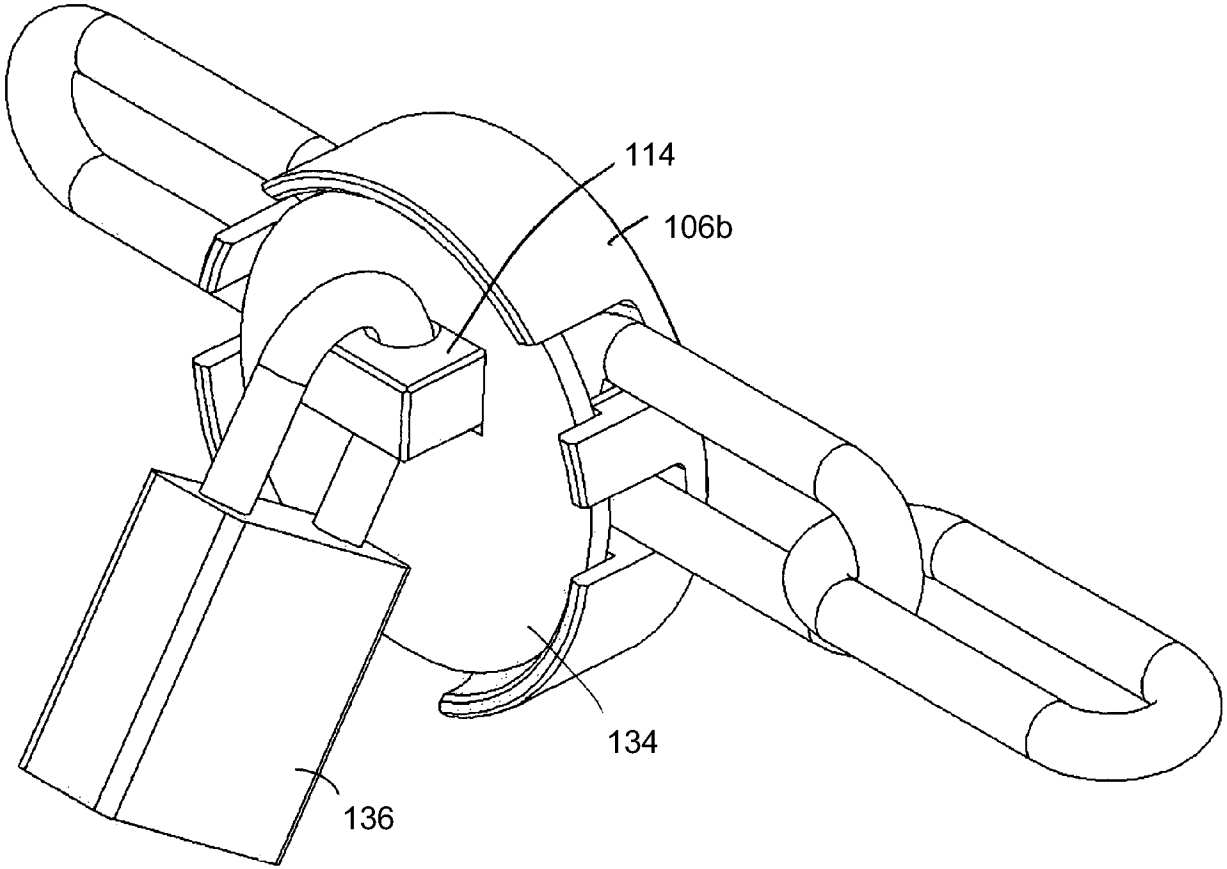
FIG. 10 depicts a perspective view of the link system of FIG. 9 in an assembled condition.

In general, the link adaptor 134 comprises a circular plate 138 with an aperture 140 therethrough. The plate 138 includes a step 139, which acts to prevent rotation of the link adaptor 134 in a similar manner as the step 104 of a conventional hockey puck lock 100. The plate 138 is configured to fit over the link 106*b*, such that the aperture 140 may fit over the post 114. The link adaptor 134, therefore, fixes the chain or cable in place, depending on the embodiment of the link 106*b*, in a similar manner as previously described with respect to the hockey puck type locks. In this regard, the plate 138 may be fairly thick, such as where the link includes ears, or thinner where posts are utilized. Once the link adaptor 134 is placed over the link 106*b*, a conventional padlock 136 may then be utilized to secure the link adaptor in place by being threaded through the through channel 101 of post 114, as shown in FIG. 10.

Figure 11:
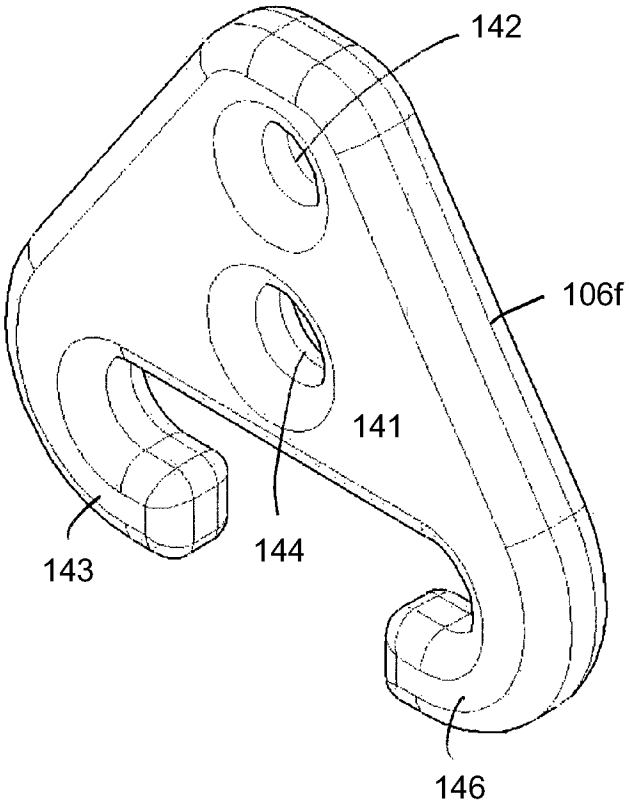
FIG. 11 depicts a perspective view of a link system in accordance with still further aspects of the present invention.

FIG. 11 depicts a perspective view of a link in accordance with yet another aspect of the present invention. As previously discussed, links are elements which allow chain or looped cable (or other securing means) to be secured using conventional padlock devices, while providing a mechanism other than a conventional lock which may sustain forces placed on the system during forced attack. Links are designed to accept common chain, cable, and lock dimensions.

Link 106*f* maintains the utility of the previous links, but in a simpler manner. In accordance with the present invention, a link 106*f*, as shown in FIG. 11, may comprise a body 141 having two through holes, referred to here as apertures 142, 144, adapted to accommodate padlocks of different sizes and configurations, such as straight shackle padlocks, circular shackle padlocks, or U-shackle padlocks. The body 141 of link 106*f* may also comprise a pair of arms 146, 148 which are adapted to thread through standard chain, looped end of cable, or the like, as will be discussed.

Link 106*f* may be machined, stamped, forged, cast, molded, etc. Materials utilized for the link 106*f* may be suitable ferrous or non-ferrous alloys or other suitable material, such as plastics. In addition, the link 106*f* may be coated for protection, such as with a plastic coating from protection from outdoor elements.

Figure 12:
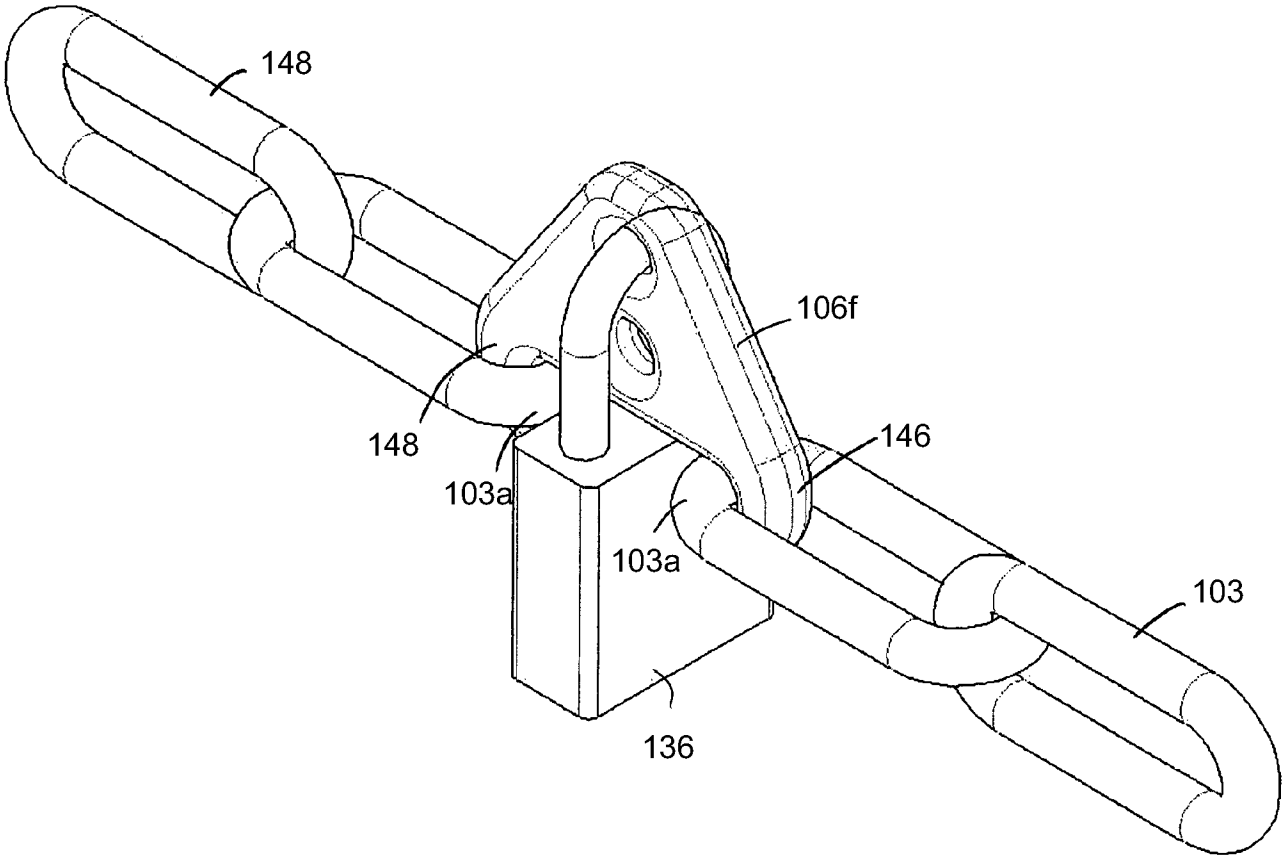
FIG. 12 depicts a perspective view of the link system of FIG. 11 in use with conventional chain and padlock.
Figure 13:
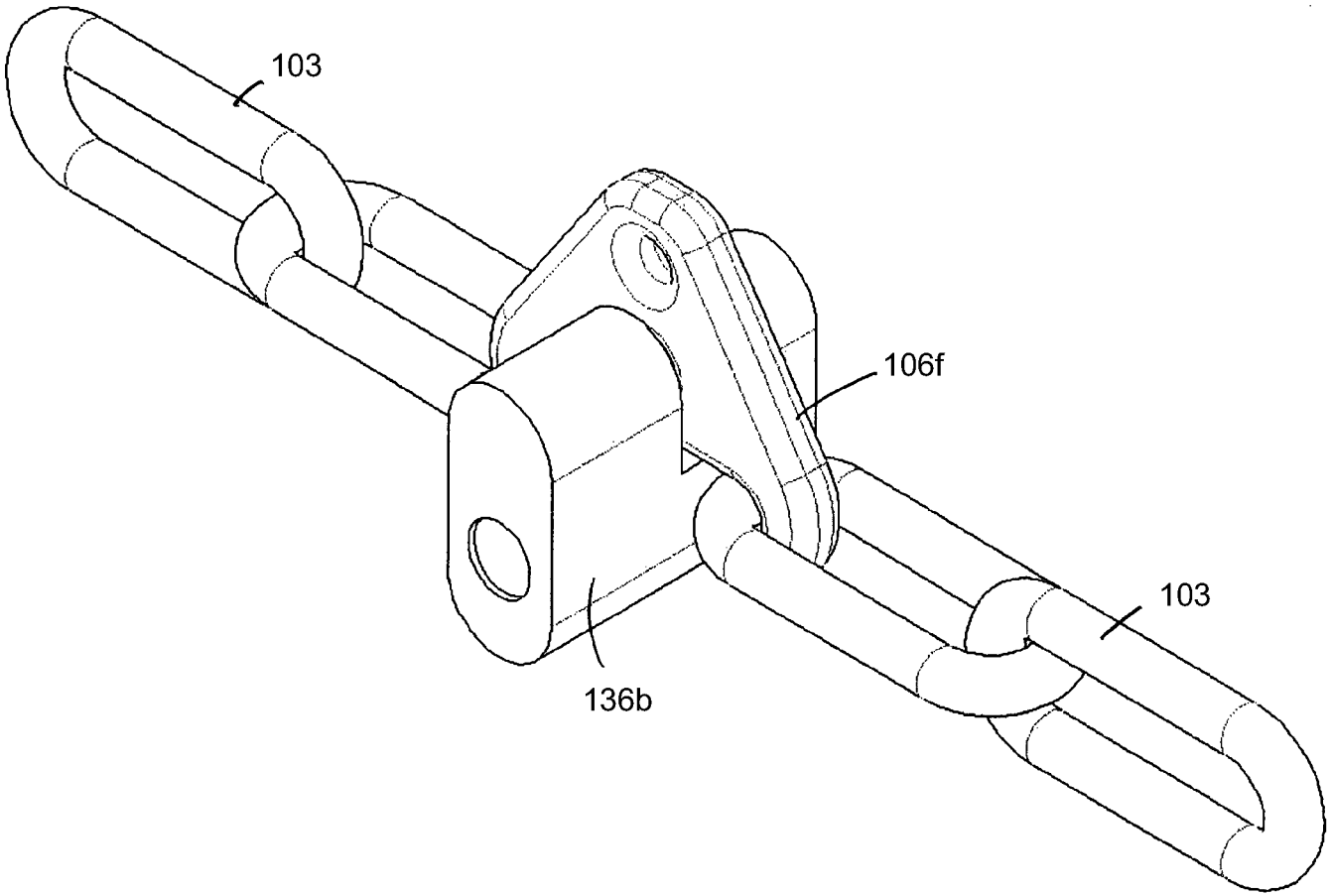
FIG. 13 depicts a perspective view of the link system of FIG. 11 in use with a conventional chain and straight-shackle lock.
Figure 14:
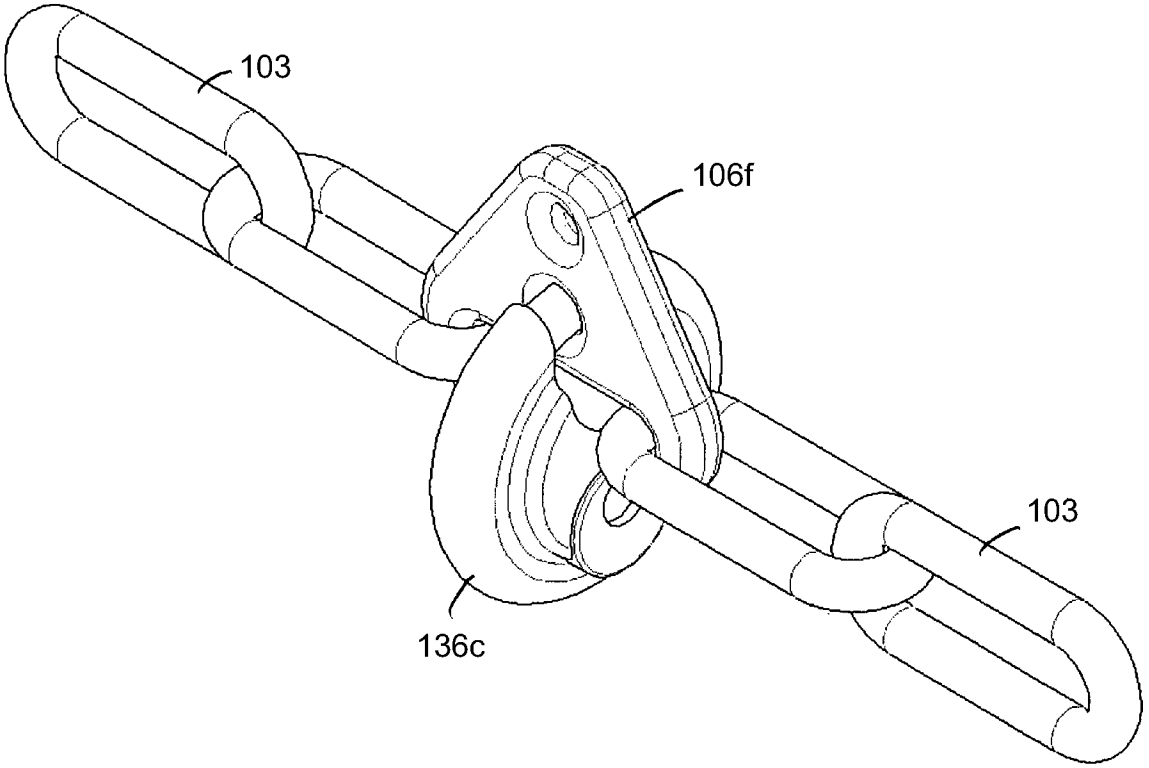
FIG. 14 depicts a perspective view of the link system of FIG. 11 in use with a conventional chain and circular shackle lock.

FIG. 12 depicts a link 106*f* in operation connecting two separate ends 103*a* of chain 103 along with a conventional padlock 136 installed for use. As shown, the link 106*f* comprises a pair of arms 146, 148 around which the respective chain ends 103*a* may be placed. The arms 146, 148 are spaced apart such that a suitable padlock 136 may then be inserted between the arms 146, 148 and chain ends 103*a*, to prevent the ends from being removed from the link 106*f*. In this regard, although it is preferred that the chain ends 103*a* abut the body of the lock 136, it will be appreciated that they need not, and it is merely sufficient that the chain end 103*a* cannot fit between the body of the lock 136 and the respective arm 146, 148. The lock shackle may then be threaded through one of the two apertures 142, 144, depending on the size of the lock, to hold the lock in place. As shown in FIGS. 14 and 15, locks of various configurations, including straight shackle 136*b* and circular shackle 136*c*, may also be utilized. In addition, it will be appreciated that the link 106*f* may include only one aperture, or more than two apertures.

As discussed with regard to other aspects of the invention, the load transferred through the chain 103 will be borne by the link 106*f*, and not by the conventional padlock 136. This novel teaching adds security to any system locked in such a manner, as the tensile strength of the link 106*f* can be made much stronger than that of the pullout strength of a conventional lock 136. Or, in the alternative, a lock 136 with a lesser pullout strength, and thus a likely less expensive lock, may be utilized with a link 106*f* to provide security levels not before capable with the simple and inexpensive lock.

In accordance with further aspects of the invention, a locking device may be incorporated for use with vertical lockrods, latch handles, and hockey puck locks, of a typical intermodal container, trailer, or the like, as discussed with respect to the aspects of the invention shown in FIG. 8 and as discussed herein. FIG. 15 depicts a conventional arrangement of a vertical lockrod 200, handle 202, and hasp mechanism 204, commonly used on intermodal containers and barn door style doors found on truck trailers, where the handle is connected to the lockrod by a hinge 203. Use of these conventional systems is well known in the industry. It is also well known that common attack points for forced entry are the rivets 205 holding the hasp mechanism 204 to the door and the rivets 207 of the hinge 205.

Figure 16:
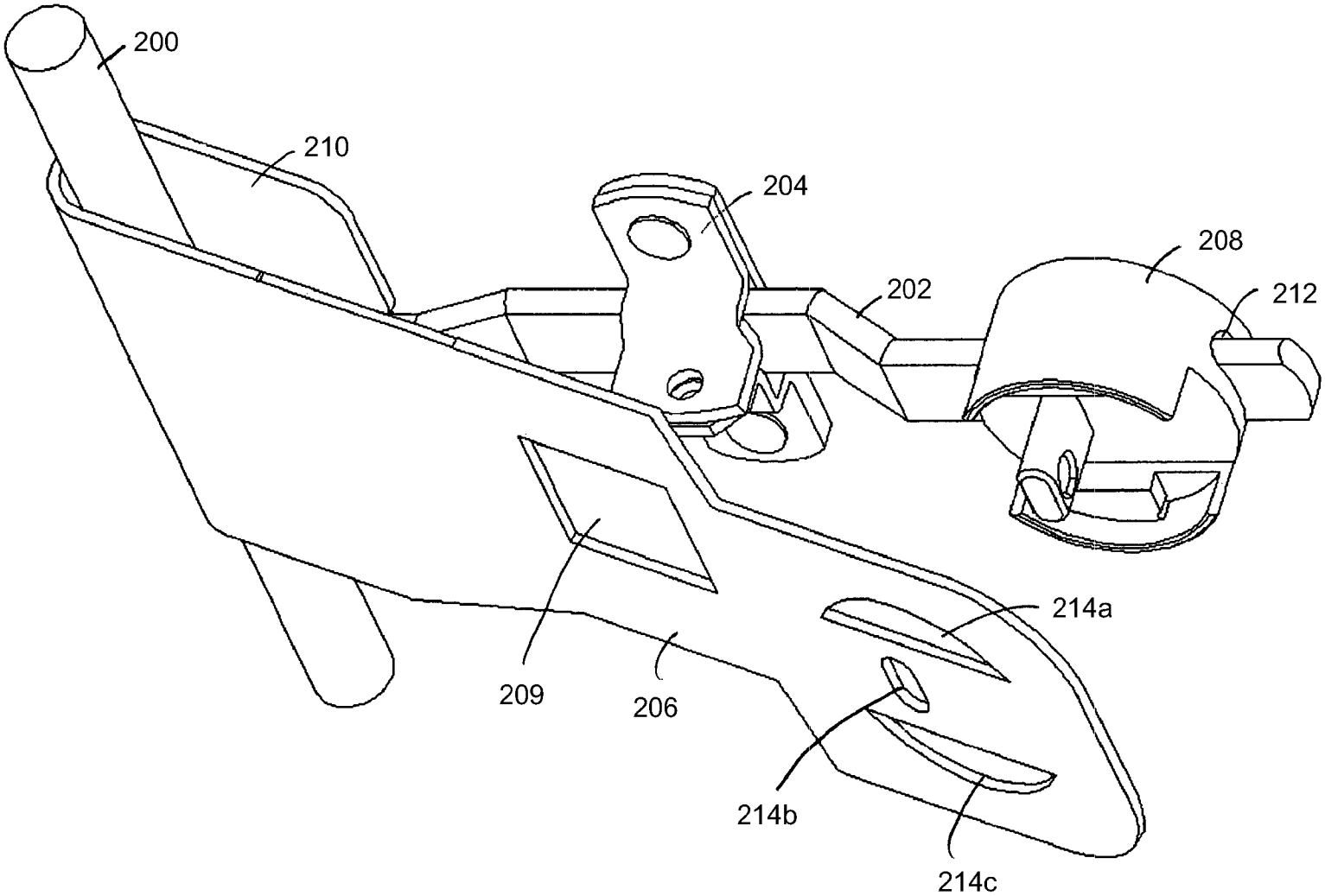
FIG. 16 depicts a frontal perspective view of a link system in accordance with further aspects of the present invention in conjunction with the conventional locking assembly shown in FIG. 15.

FIG. 16 depicts a perspective view of a security link system in accordance with further aspects of the present invention. Included in this embodiment is a strap 206 hooked around a vertical lockrod 200 and an embodiment of a security link 208*a* slipped onto the latch handle 202. The strap hook 210 is configured to allow the strap 206 to be placed onto the lockrod 200 while being capable of being swung or otherwise rotated to a position where it may engage with the security link 208*a*. The security link 208*a* has a passage 212 that permits the security link to slide along the latch handle 202 to retain adjustability along the long axis of the handle. The strap 206 may include a cutout 209 that allows portions of the hasp mechanism 204 to protrude and be used with seals and or padlocks as is conventional practice today. After the strap 206 is hooked around the vertical lockrod 200, it may be swung inward toward the container to engage or nest with the security link 208*a*, which includes portions that extend through apertures 214*a*, 214*b*, and 214*c*, extending through the strap. As will be discussed, it will be appreciated that the strap may be configured in non-planar sections to closely align with the handle, such that the lock is offset toward the door.

Figure 17:
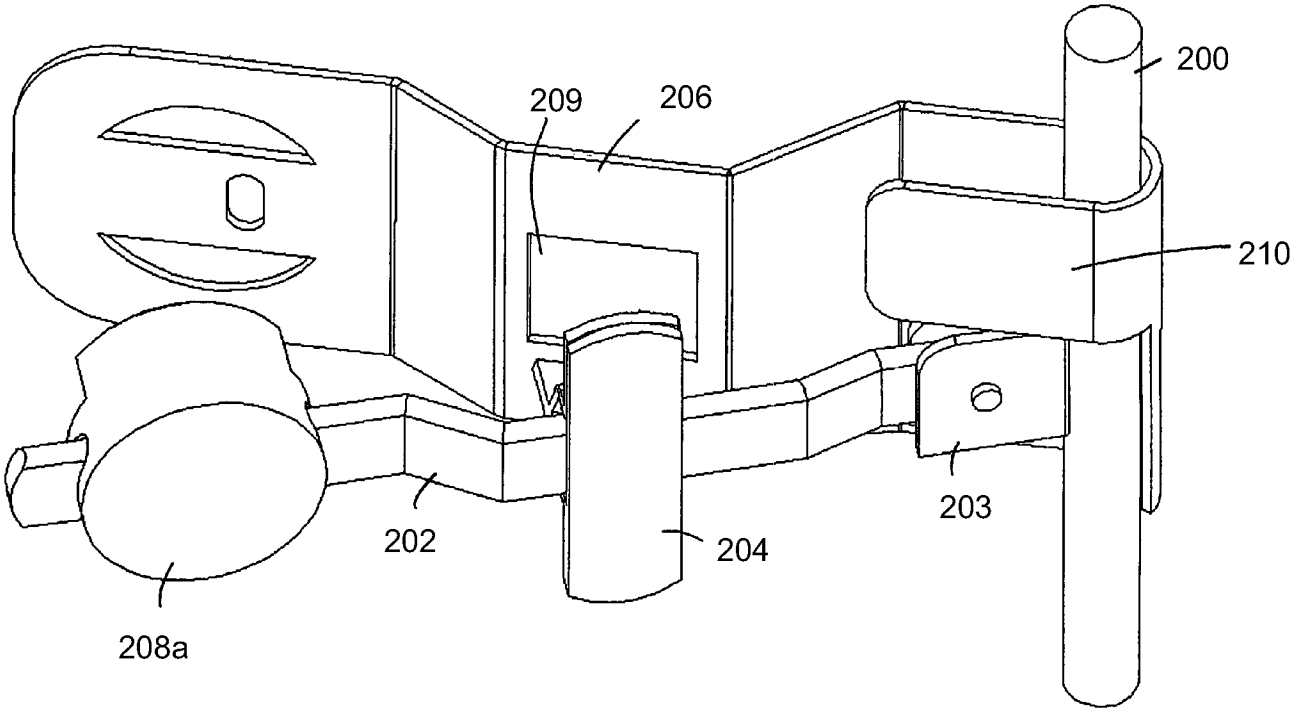
FIG. 17 depicts a rear perspective view of the link system and locking assembly shown in FIG. 16.

FIG. 17 depicts a rear view of the strap 206 showing hook element 210 in greater detail. As shown, the hook 210 may be configured to be sized smaller than the remainder of the strap 206, such that the hook will not interfere with the hinge 203, when the strap is rotated.

Figure 18:
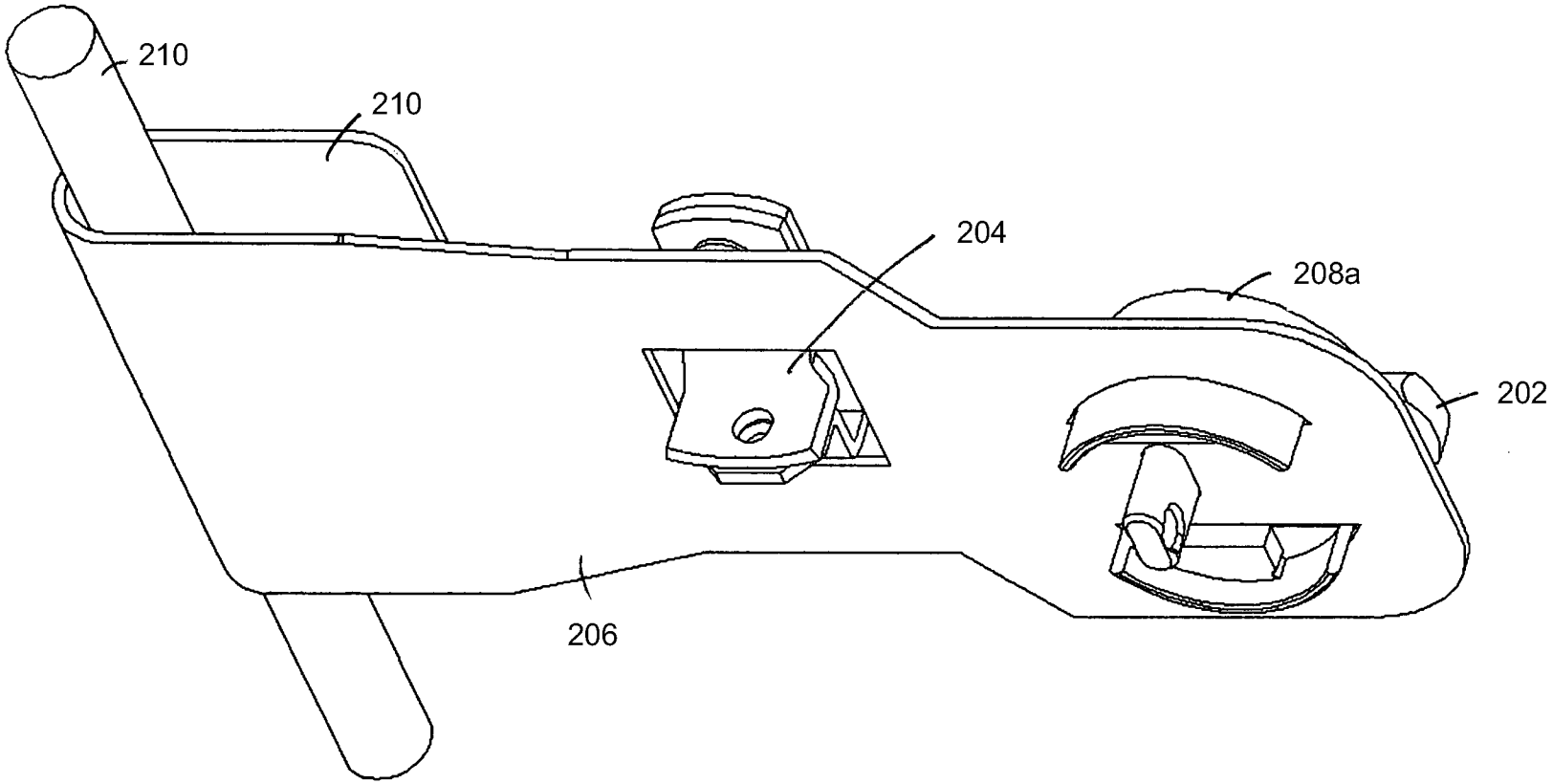
FIG. 18 depicts a frontal perspective view of the link system and locking assembly shown in FIG. 16, with the link system in a partially secured condition.

FIG. 18 depicts a perspective view of the strap 206 fully engaged/nested into the hasp mechanism 204 and the security link 208*a*.

Figure 19:
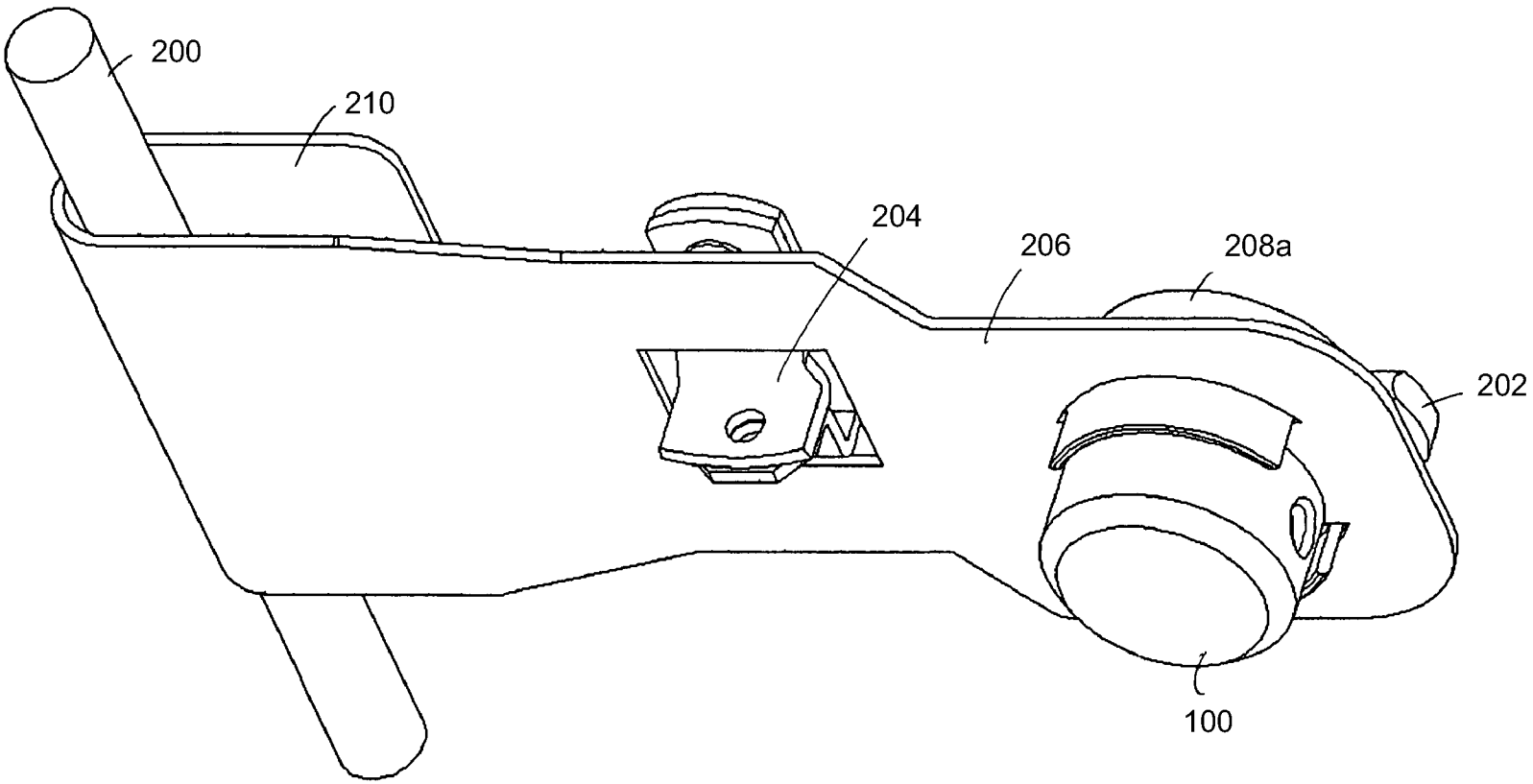
FIG. 19 depict a frontal perspective view of the link system and locking assembly shown in FIG. 18, with the link system in a fully secured condition.

FIG. 19 depicts a perspective view of the system shown in FIG. 16, along with a hockey puck lock 100 in place. As previously indicated, this is the locked condition of the system. If desired, a conventional padlock may also be utilized on the hasp 204.

Figure 20:
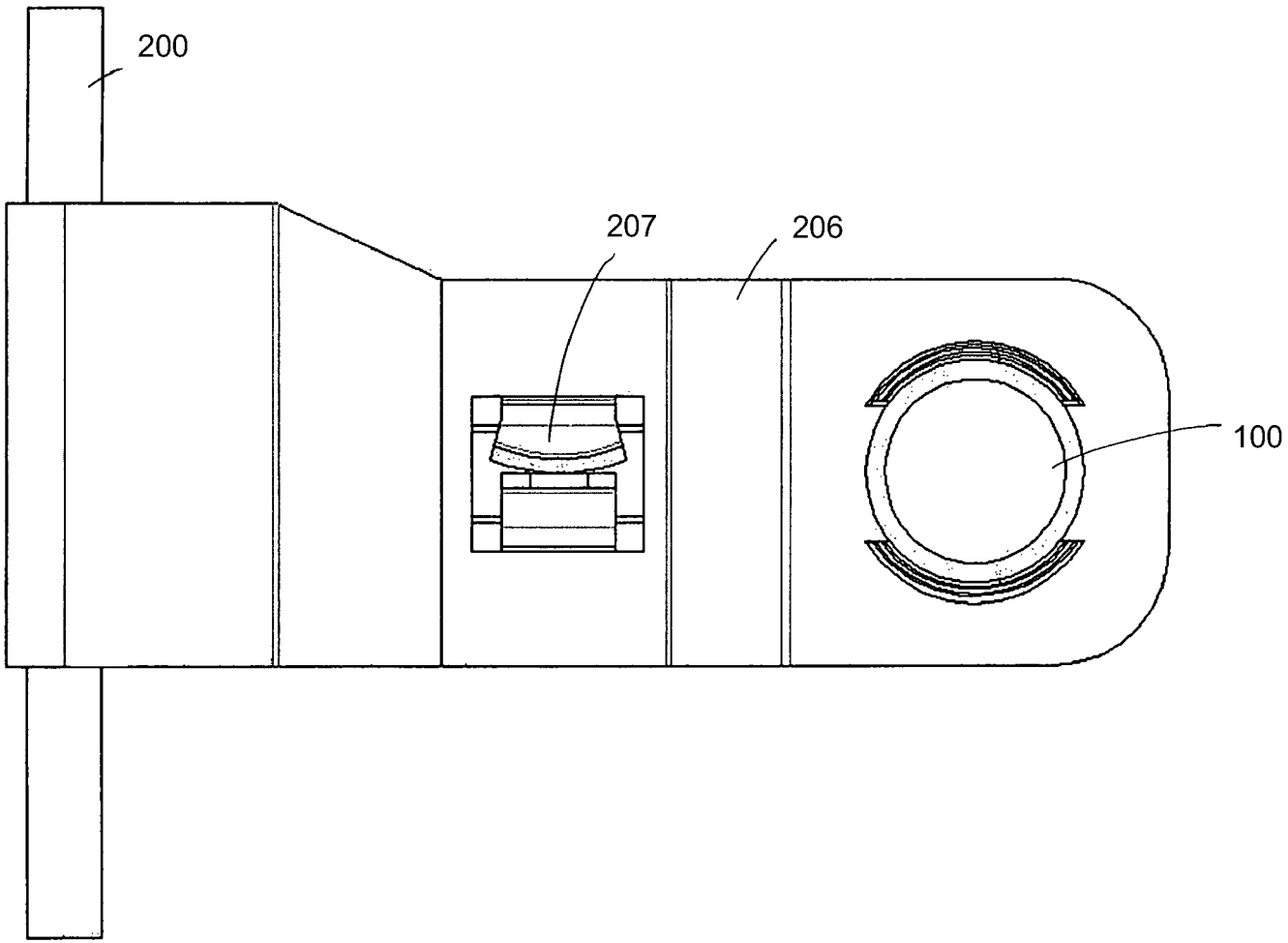
FIG. 20 depicts a frontal view of the link system and locking assembly of FIG. 19.

FIG. 20 depicts a front view of the system shown in FIG. 16.

Figure 21:
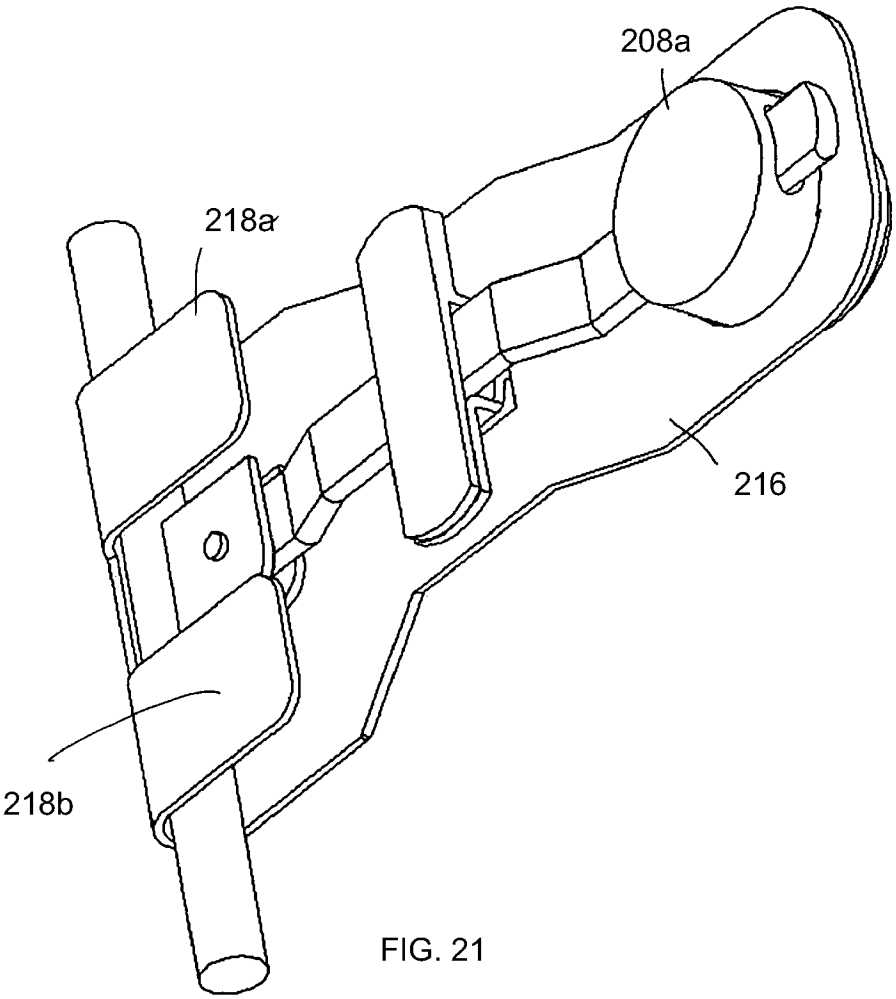
FIG. 21 depicts a rear perspective view of a link system in accordance with still further aspects of the present invention in conjunction with the conventional locking assembly shown in FIG. 15.

FIG. 21 depicts a rear perspective view of strap 216 in accordance with a further aspect of the present invention, wherein the strap includes two hook tabs 218*a*, 218*b*, bracketing the hinge 203. Strap 216 otherwise may be operable in the same manner as strap 206, discussed previously.

Figure 22:
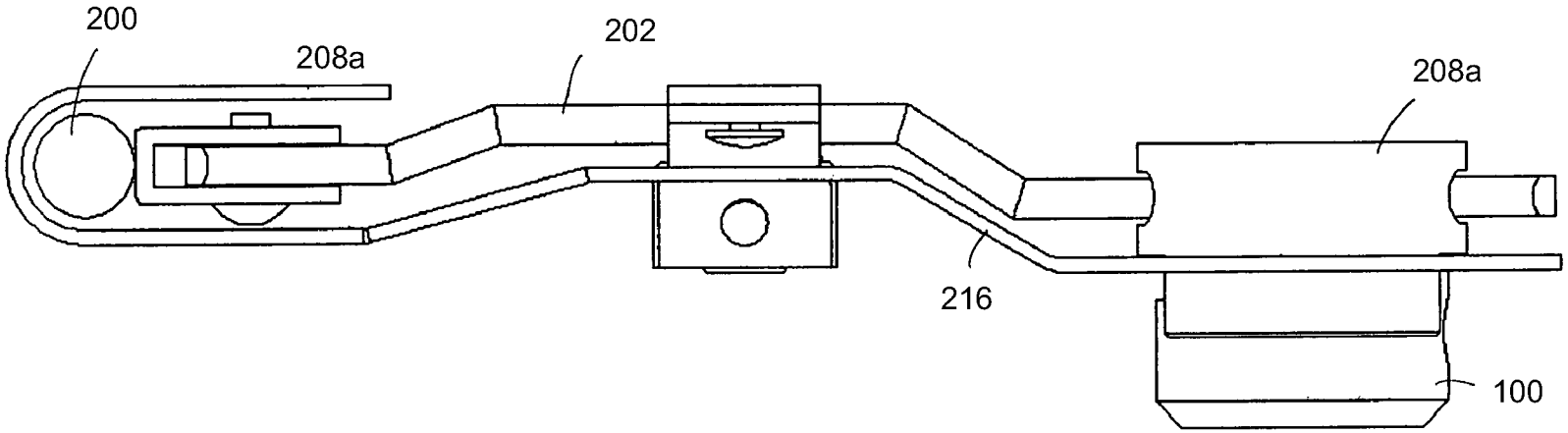
FIG. 22 depicts a top view of the link system and locking assembly shown in FIG. 21.

FIG. 22 depicts a top view of the strap assembly shown in FIG. 21, with a hockey puck lock installed. It will be noted that in the previous aspects of the invention, the straps have provisions such that the hasp 204 is permitted to penetrate through the strap, such that it may be used. Even so, it is preferred that the rivets 205 securing the hasp to the door remain covered. In this manner, the rivets are then difficult for the malfeasant to attack. Similarly, it is preferred that the rivet 207 forming a portion of the hinge 203 also be protected. In accordance with further aspects of the present invention, as shown in FIG. 23, additional safety features may be incorporated.

Figure 23:
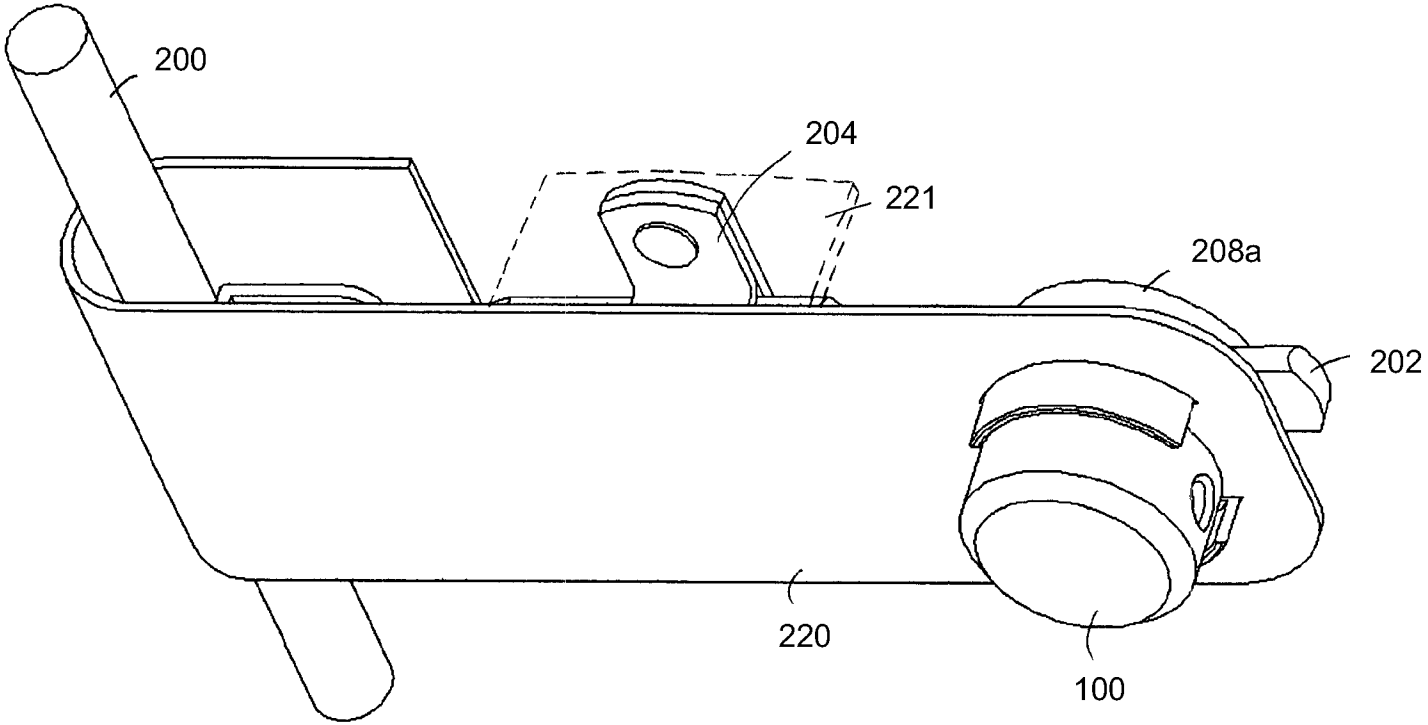
FIG. 23 depicts a perspective view of a link system in accordance with additional aspects of the present invention in conjunction with the conventional locking assembly shown in FIG. 15.

FIG. 23 depicts a perspective view of a further aspect of a strap in accordance with the present invention. In this aspect, a strap 220 does not have a cutout for the hasp assembly 204. The hasp assembly 204 is therefore completely covered and protected when the strap 220 is closed and the conventional hockey puck lock 100 is in place. In this regard, the strap may include additional extensions 221 (shown in dashed form for clarity) which may completely cover the hasp 204.

Figure 24:
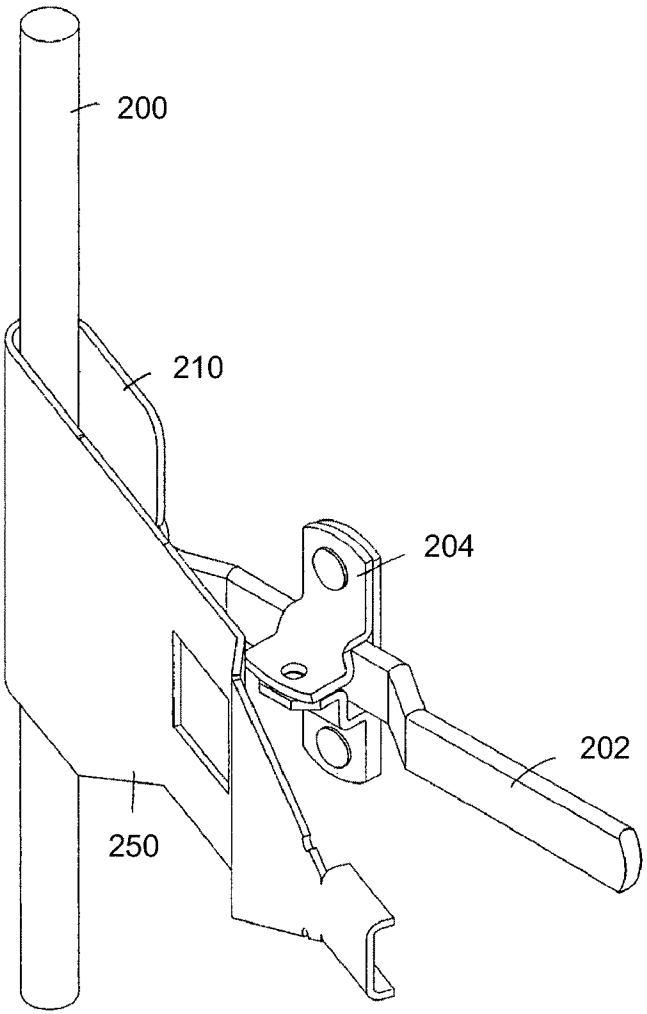
FIG. 24 depicts a perspective view of portions a link system in accordance with a still further aspect of the present invention, in a partially installed position.

FIG. 24 depicts a strap 250 in accordance with a further aspect of the present invention. In this aspect, the strap 250 may be constructed with less material, to save cost and weight. The strap 250 may be similar to the previous straps discussed, including the provision of strap hook 210. As shown in FIG. 24, strap hook 210 may be secured around the vertical support 200 of a conventional intermodal container type lock mechanism. The strap may then be swung inward, toward the door, into the position shown in FIG. 25. It is there more clearly shown that the strap 250 may include a tapered section 252 culminating at a distal end 254 with a squared section 256. The squared section may include extensions 258 to partially encircle the handle 202.

Figure 25:
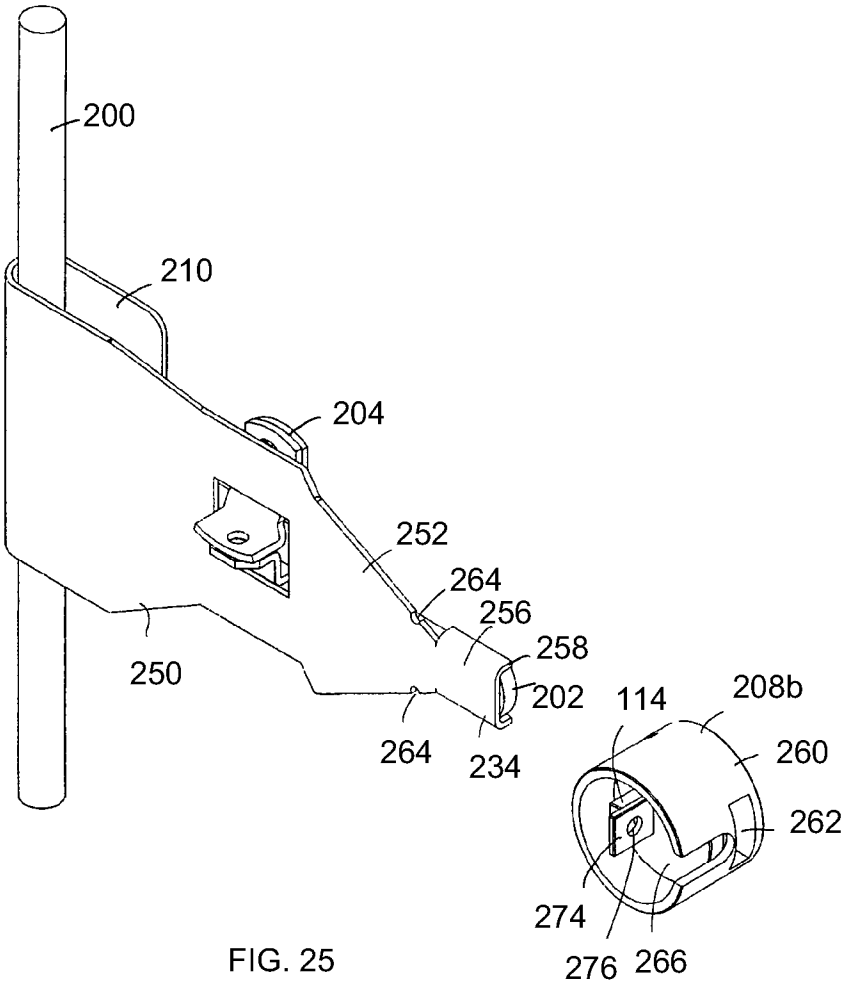
FIG. 25 depicts a perspective view of portions of the link system of FIG. 24 in a more fully installed position.
Figure 26:
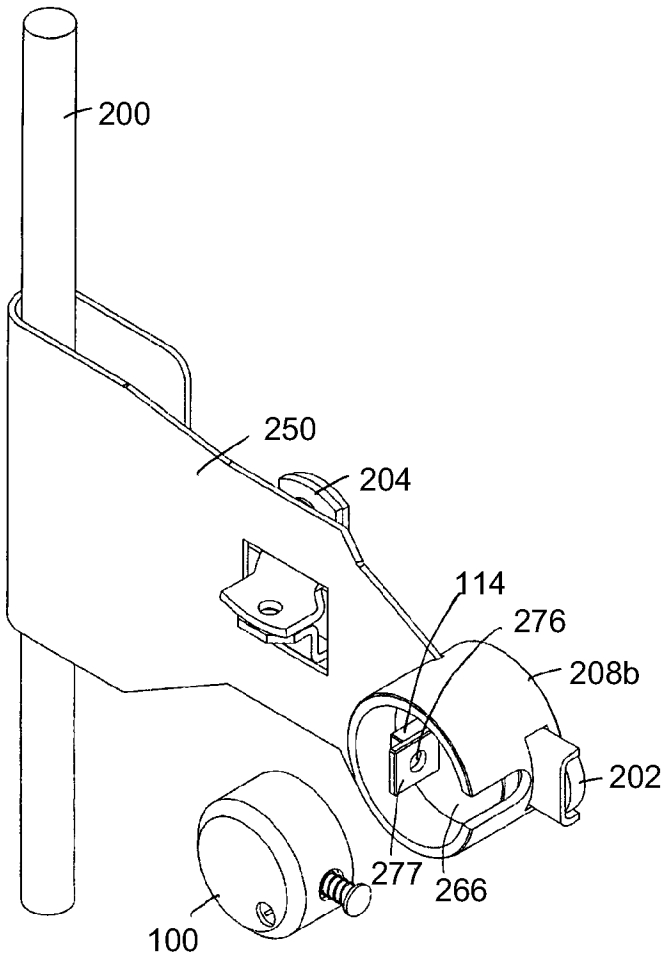
FIG. 26 depicts a perspective view of portions of the link system of FIG. 25 in a still more fully installed position.

Also shown in FIG. 25 is a link 208*b*. Link 208*b* is similar to link 208*a*, except link 208*b* includes a deeper base section 260 with an aperture 262. The aperture 262 is sized and configured to accept the distal end of the strap 250 and the handle 202, as shown in FIG. 26.

Also shown in FIG. 25, it will be appreciated that the strap 250 includes notches 264 in its tapered section 252. The notches, as will be discussed, help to prevent the hockey puck lock 100 and link 208*b* from being slid off the handle 202, when the hockey puck lock is installed.

Figure 27:
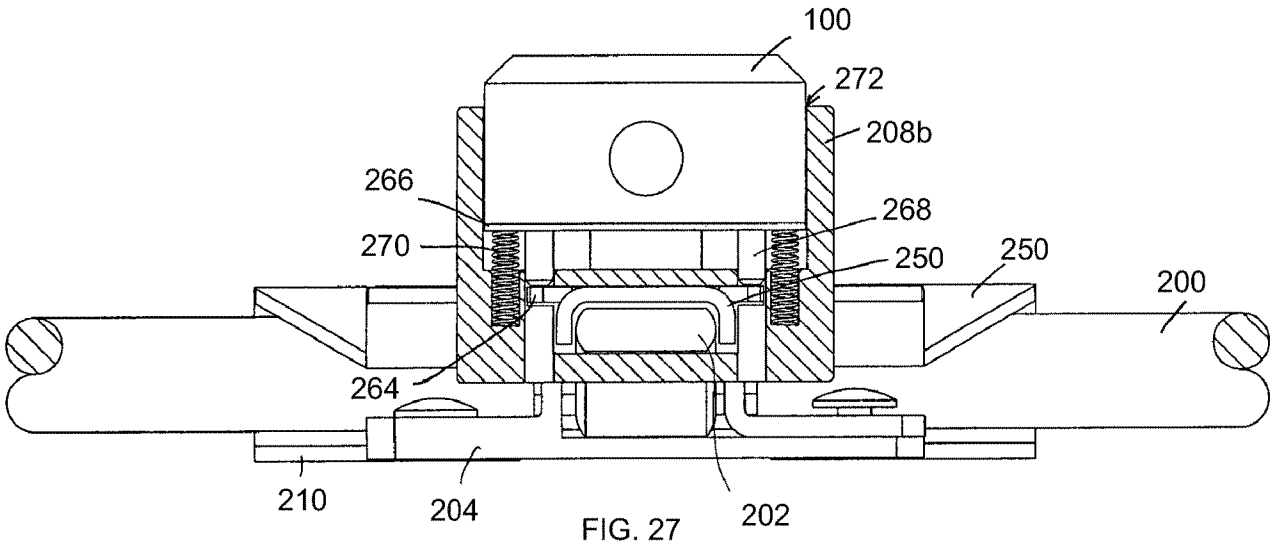
FIG. 27 depicts a cross section the link system of FIG. 24 in a nearly installed position.

In this regard, the link 208*b* may be provided with a moveable plate 266. The plate 266 may include the post 114 on one side that the hockey puck lock 100 attaches to, and pins 268 (FIG. 27) on the other. The pins 268 associate with the notches 264 to prevent the link 208*b* from being slid off the handle when the hockey puck lock is installed. FIG. 26 depicts a perspective view of a link 208*b* installed on the strap 250. FIG. 27 depicts a cross section of this arrangement. As shown in FIG. 27, springs 270 may serve to push plate 266 up toward the open end 272 of link 208*b*. In this position, it is shown that the pins 268 are clear of the notches 264, such that the link 208*b* may freely slide along the squared section 256 of the strap 250. Once in this position, the hockey puck lock 100 may be lowered, compressing springs 270, and pushing pins 268 into notches 264.

Figure 28:
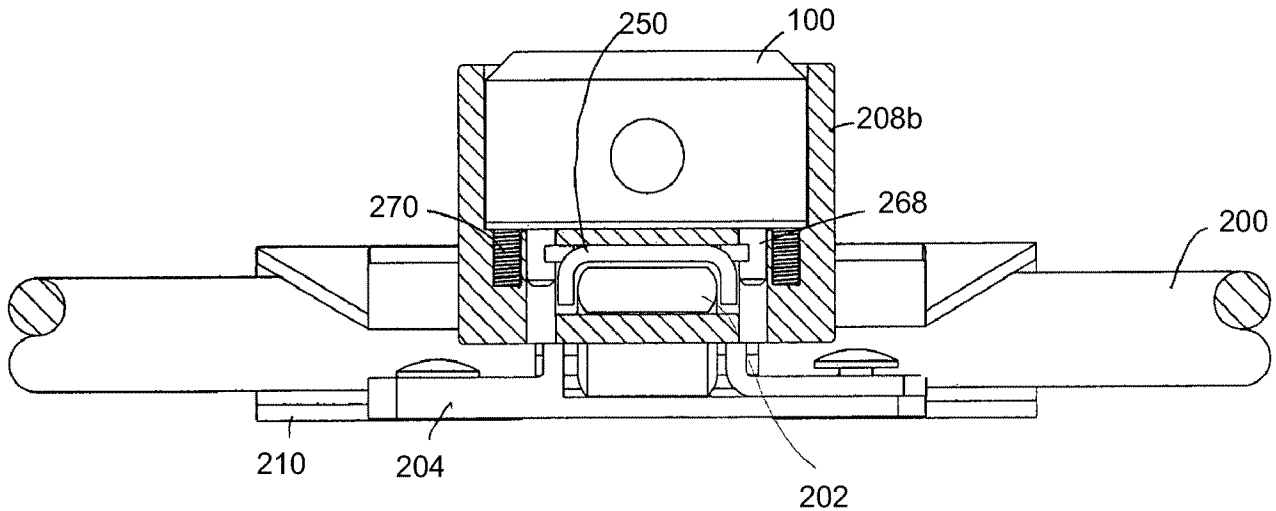
FIG. 28 depicts a cross section of the link system of FIG. 24 in a fully installed position.
Figure 29:
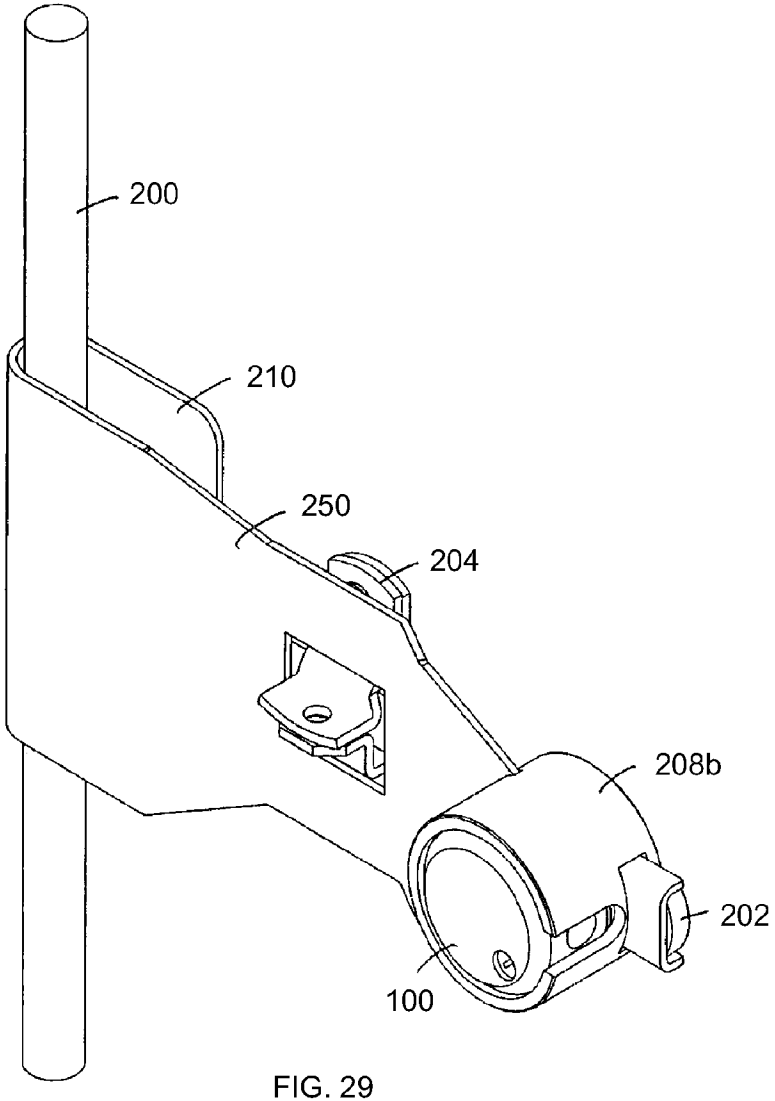
FIG. 29 depicts a perspective view of the link system of FIG. 24 in a fully installed position.

To maintain the hockey puck lock 100 in this lowered position, the plate 266 may include a post 274 extending adjacent to the post 114 associated with the link 208*b*, and permitted to penetrate the plate. The post 274 may include an aperture 276 which aligns with through channel 101 when the hockey puck lock 100 is pressed into the link 208*b*, such as shown in FIG. 28. The shackle of the hockey puck lock 100 may then be threaded through the through channel 101 of post 114 as well as the aperture 276 of post 274. FIG. 29 depicts a link 208*b* with strap 250 in the fully installed position.

Further embodiments of the links previously discussed may also incorporate provisions to secure the hockey puck lock within the link body even when the lock is unlocked. In this regard, the further embodiments contemplate features adapted to retain the hockey puck lock within the link when in the unlocked position. These retention components may be in the form of roll pins, threaded fasteners, a retention ring, or other barrier or retaining member. Although retained, the hockey puck lock is permitted to move up and down within the link such that the retained components, whether chain, cable, or similar items, may be unsecured from the link.

Figure 30:
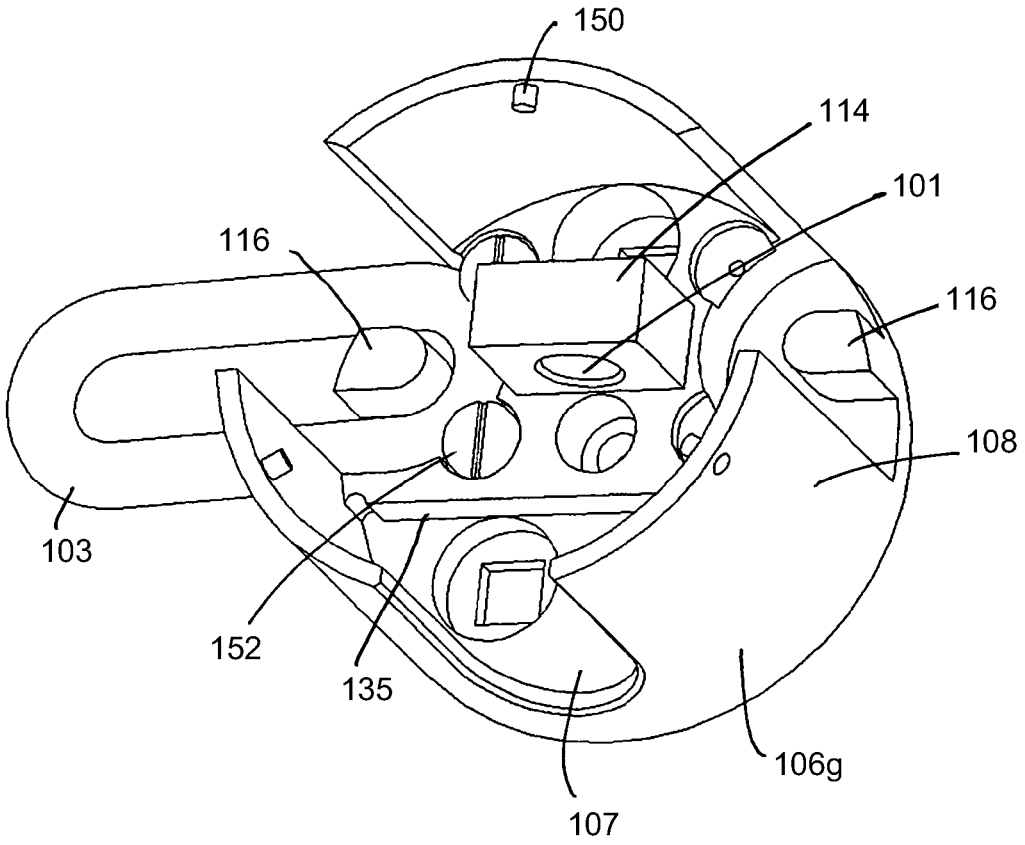
FIG. 30 depicts a perspective view of a link system in accordance with additional aspects of the present invention.

FIG. 30 depicts a perspective view of a link 106*g* which includes features to retain either shackle or hockey puck style locks, after the locks are unlocked. For clarity, FIG. 30 is shown without any lock. However, it will be appreciated that, for example, a hockey puck lock may be placed within the raised lip 108 of the link 106*g* below the level of a lock retention component or components 150, such that the hockey puck lock is free to shift between the base 107 of the link 106*g* and the lock retention components 150. In the present embodiment, the lock retention components 150 are simple pins, which are attached to and protrude from the raised lip 108 into the cavity of the link 106*g* above where the hockey puck lock (not shown) would normally reside. It will be appreciated that the height of the raised lip 108 and placement of the lock retention components 150 are such that the hockey puck lock can be lifted a sufficient distance to permit the chain 103 to fit between the bottom of the hockey puck lock and the post 116, such that the chain 103 may be removed form the link 106*g*.

As previously discussed, links may include retaining mechanisms to hold the chain 103 in place. For example, link 106*g* includes a pair of set screws 152 for securing the chain 103. Accordingly, the portion of the chain 103 held by the set screws 152 will be retained within the link 106*g*, even when the hockey puck lock is unlocked and lifted toward the lock retention components 150. In the meantime, the other end of the chain 103 will be permitted to fit between the bottom of the hockey puck lock and the post 116.

Link 106*g* is shown with an anti-rotation step 135, but link 106*g* could accommodate stepped and flat bottom hockey puck locks.

Figure 31:
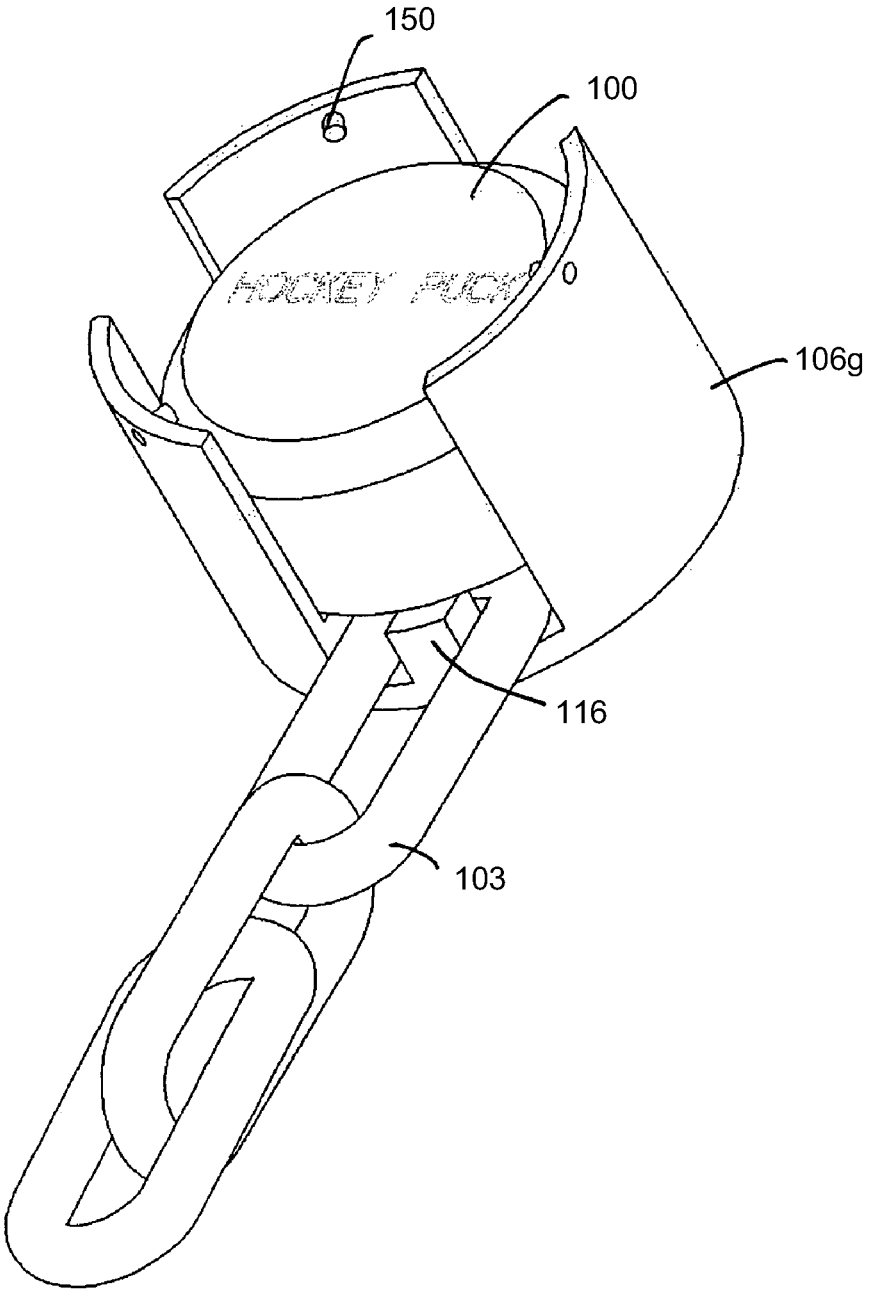
FIG. 31 depicts a perspective view of the link system of FIG. 30 with a hockey puck lock installed.

FIG. 31 depicts a link 106*g* of the type shown in FIG. 30, with a hockey puck lock installed. Note that there is space between the upper surface of the hockey puck lock and the lock retention members 150 for the lock to shift when in the unlocked position.

Figure 32:
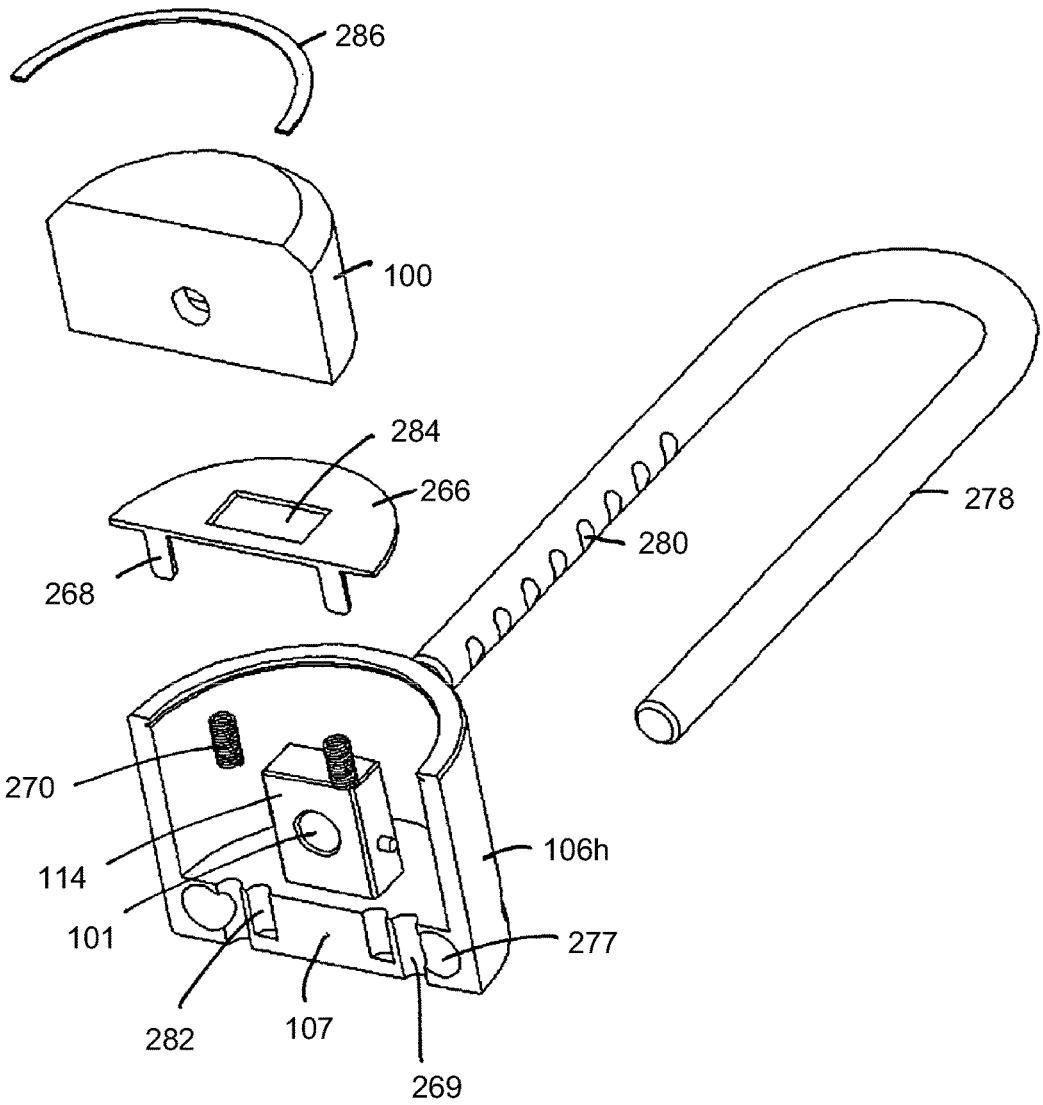
FIG. 32 depicts a partially cut-away exploded view of a link system in accordance with additional aspects of the present invention.

FIG. 32 depicts an exploded cut-away perspective view of another embodiment of a link 106*h*. This embodiment expands the use and applications for hockey puck style padlocks by incorporating a plate member 266 between the hockey puck lock and the base 107. The plate member 266 may include extension pins 268 which retain a shackle 278 when the hockey puck lock 100 is in the locked position. The shackle 278 may have a cylindrical cross-section as shown or square cross-section, or other shaped cross-section.

The shackle 278 is shown as a rigid shackle, with engagement elements shown as notches 280 adapted to accept the pins 268 when the plate 266 is dropped down against the base 107. The shackle 278 enters the link through apertures 277 extending through the base 107. When the shackle 278 is inserted the requisite amount, the pins 268 of the plate 266 drop to fit within the appropriate notches 280 of the shackle 278 to secure the shackle 278.

In other aspects of the invention, the shackle 278 may be configured to include a pair of rigid sections with notches 280 connected by a second section, which may be flexible as in a wire or chain. In this case, the rigid sections could fit within the link 106*h* through apertures 277 while the flexible section could secure the object desired to be secured.

When the plate 266 is lowered into the cavity of the link 106*h*, the pins 268 extend into the notches 280 of the shackle 278. The pins may thereafter enter shafts 269 formed in the base 107 of the link 106*h*, such that the plate 266 may lower fully against the base 107. Although shown as extending completely through the base 107 of the link 106*h*, it will be appreciated that the shafts 269 may extend only partially and not completely extend through the base. In this regard, additional protection against forced attack, such as by drilling of the pins 268, will be provided, as the exact location of the pins 268 may be difficult to ascertain if hidden. It will also be appreciated that the plate 266 includes an aperture 284 through which the post 114 may fit.

When in the unlocked state, the shackle 102 of the hockey puck lock 100 may be disengaged from the post 114 allowing the hockey puck lock to lift. This movement could be spring assisted, for example with springs 270. The springs may fit within spring recesses 282 formed within the base 107 of the link 106*h*. The springs 270 may therefore function to lift the plate 266 and the hockey puck lock 100, once the lock is unlocked. When the plate 266 lifts, the pins 268 lift and clear the notches 280 of the shackle 278, allowing the shackle 278 to move in an un-locked manner.

Additional features may include provisions to retain the hockey puck lock when in the unlocked state, in the form of lock retention components 150, as previously discussed. One such lock retention component 150 may be a retaining ring 286. A retaining ring 286 is shown in FIG. 32. Lock retention may also be achieved using roll pins, threaded fasteners, surface irregularities, or other means. If the lock retention provisions are removable, such as with the use of set screws, the user of the system may replace the lock when in the unlocked position, when and if required.

Figure 33:
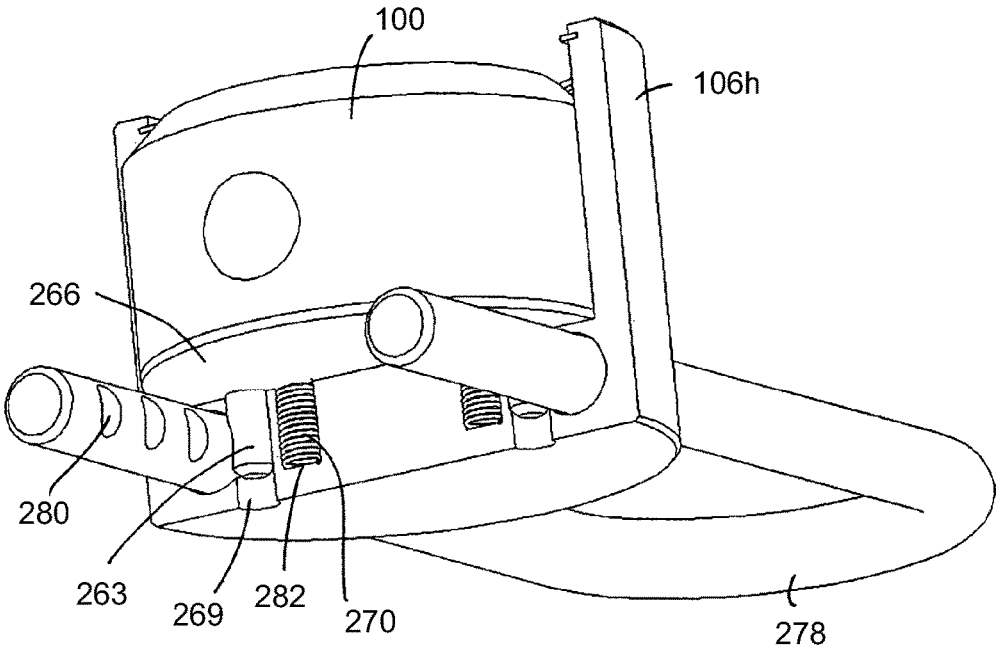
FIG. 33 depicts a perspective partially cut-away view of the link system of FIG. 32, in an assembled condition with a hockey puck lock.

FIG. 33 depicts the link 106*h* and related components in a locked condition, such that the hockey puck lock 100 is lowered in the link cavity, the plate 266 is lowered against the base 107, the pins 268 are fitted through the notches 280 of the shackle 278 and within the shafts 269, the springs 270 are compressed into the spring cavities 282, and the shackle 278 is fully retained.

Figure 34:
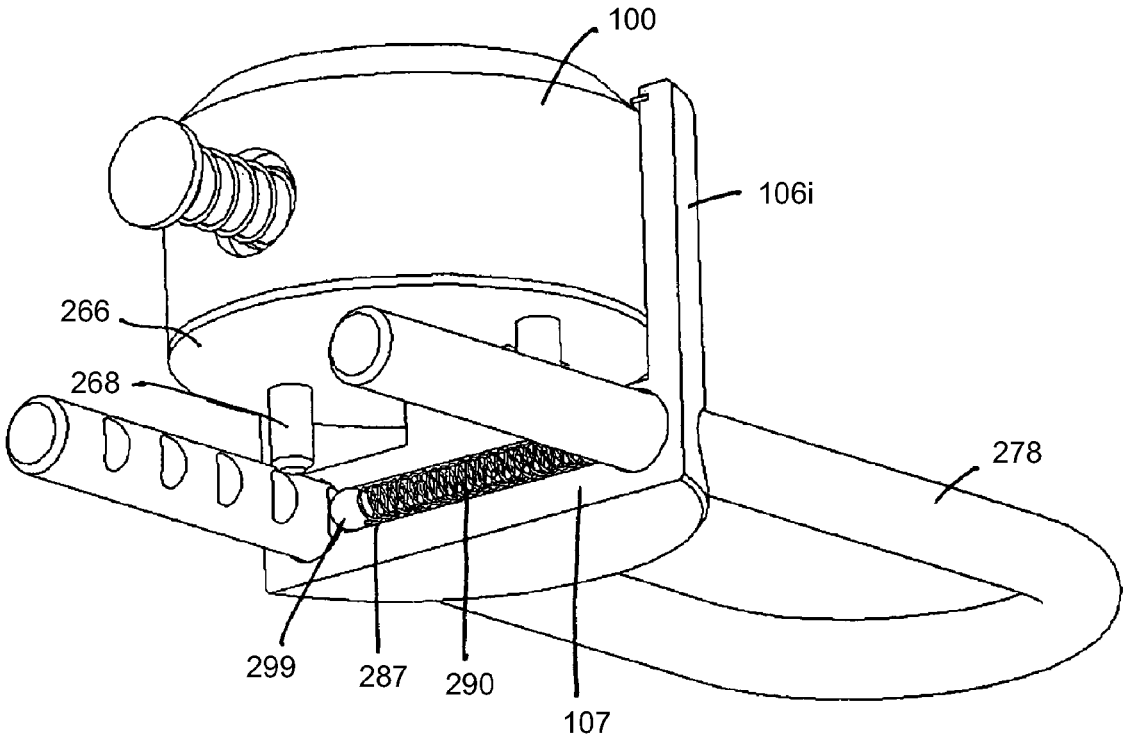
FIG. 34 depicts a partially cut-away perspective view of a link system in accordance with still further aspects of the present invention.

FIG. 34 depicts yet another embodiment of a link 106*i*, in accordance with certain aspects of the present invention. In this embodiment, which is similar to the link 106*h* embodiment, the link 106*i* includes a mechanism to impair movement of the shackle 278 when the lock is unlocked. The mechanism includes a channel 287 formed within the base 107 of the link 106*i*, the channel spanning between the openings for the two legs of the shackle 278. The channel 286 includes a pair of displaceable elements, such as ball bearings 288, forced apart by a spring 290. The ball bearings 288 are sized to fit within the notches 280 of the shackle 278. In particular, the ball bearings 288 fit within the notch 280 of the shackle 278 adjacent to the particular notches 280 directly beneath the pins 266 at the given moment. The spring 290 separates the ball bearings 288 and forces each into a respective notch 280. When the lock 100 is unlocked and raised, the ball bearings 288 and spring 290 serve to prevent the shackle 278 from easy removal from the link 106*i*. Nevertheless, it is preferred that the spring 290 be sized and configured to permit compression upon attempted removal of the shackle 278, such that the ball bearings 288 will ratchet within each successive pair of notches 280 as the shackle 278 is withdrawn or inserted into the link 106*i*, to impair movement thereof. It will be appreciated that the spring 290 mechanism shown in FIG. 34 with respect to link 106*i* may also be utilized with link 106*h* shown in FIG. 32, or other links, so long as there is sufficient space allotted in the base 107.

Figure 35:
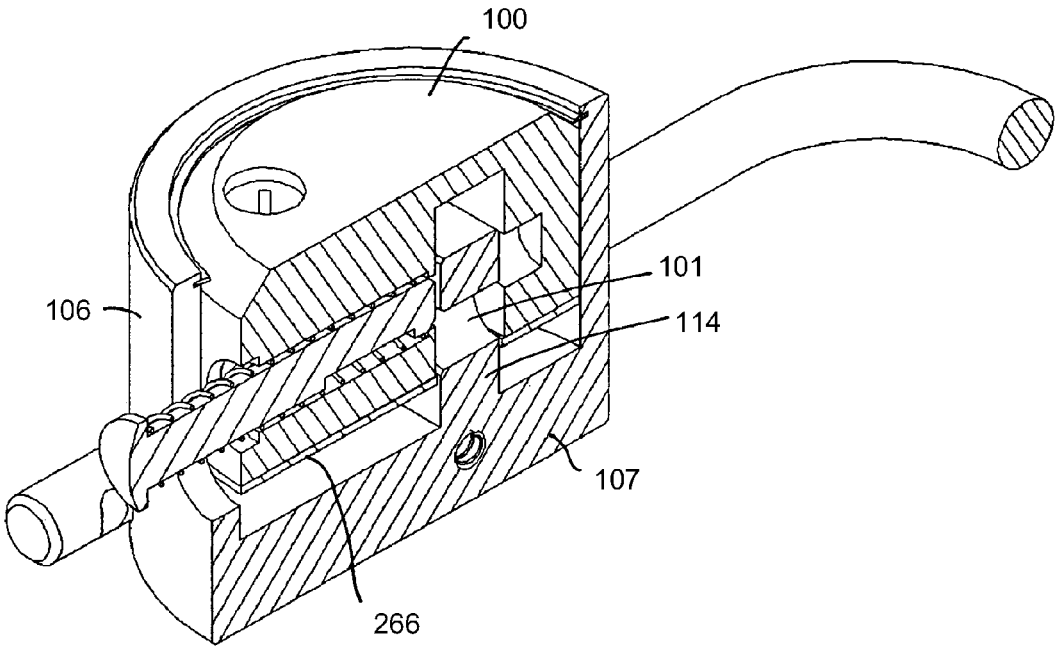
FIG. 35 depicts a cut-away perspective view of a link system in accordance with further aspects of the present invention in an unlocked condition.
Figure 36:
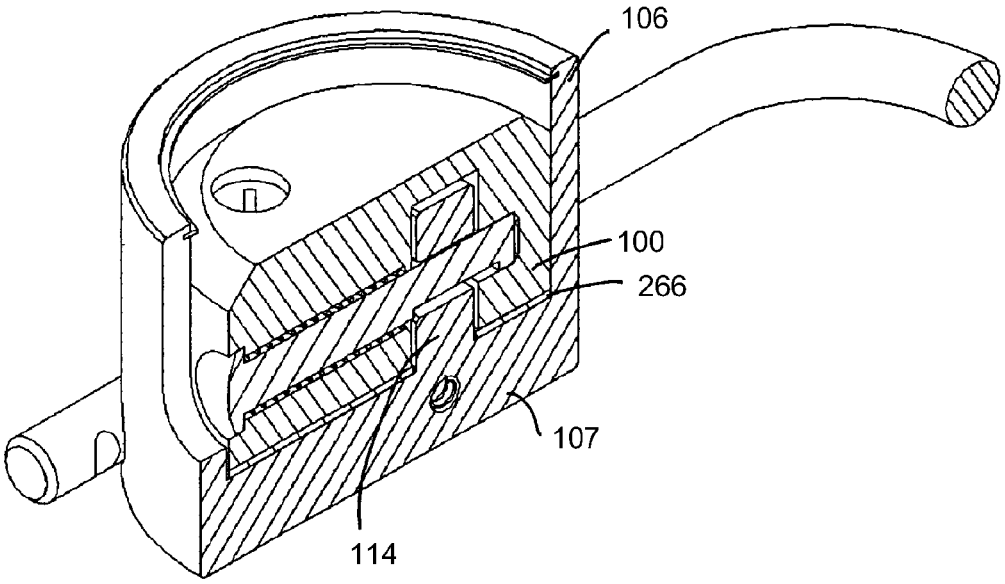
FIG. 36 depicts a cut-away perspective view of the link system of FIG. 35 in a locked condition.

FIG. 35 depicts a partially cut-away view of a link 106 with hockey puck lock 100 in the unlocked position. It is clearly shown in this view that the hockey puck lock 100 and plate 266 are displaced upwardly from the base 107 of the link 106. FIG. 36 depicts a partially cut-away view of a link 106 with hockey puck lock 100 in the locked position, with the hockey puck lock 100 and plate 266 dropped down against the base 107 of the link 106.

In accordance with other aspects of the present invention, the shackle 278 may have one leg shorter than the other, such that the shorter leg may be released from the hockey puck lock and swung into an unlocked and open position. One particular form of such a shackle 278 is shown in FIGS. 37 and 38.

Figure 37:
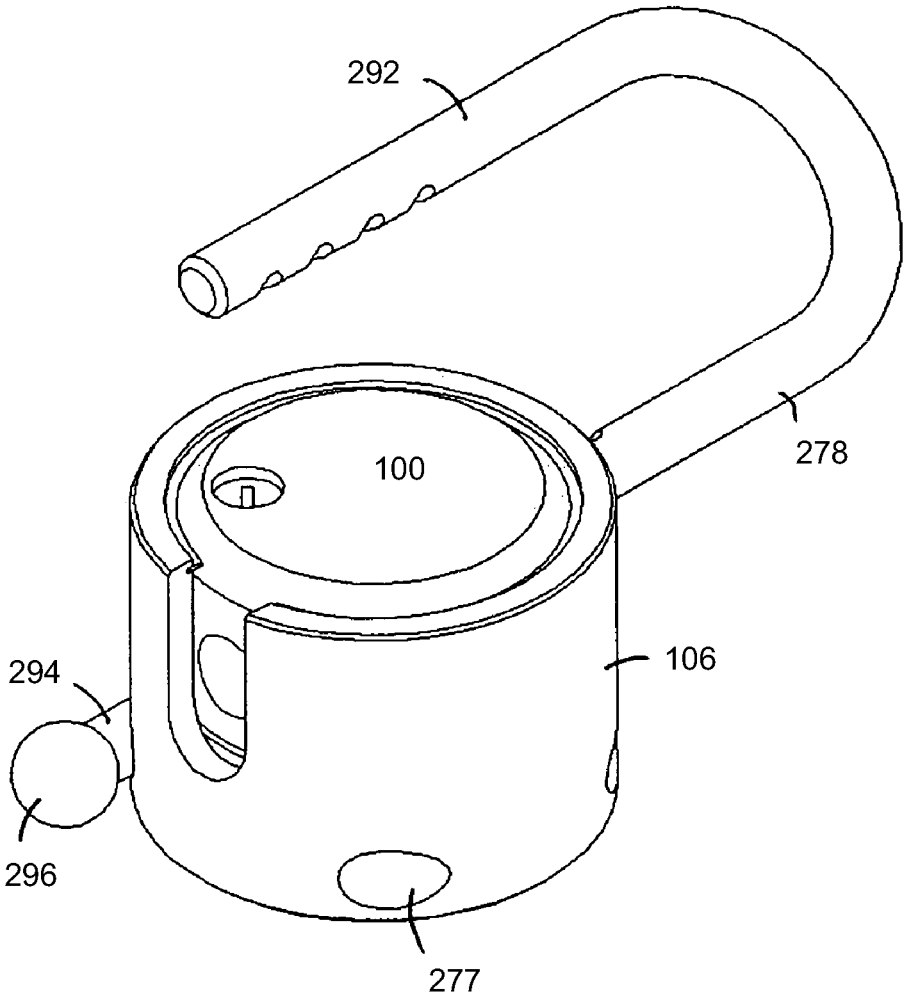
FIG. 37 depicts a perspective view of a link system in accordance with additional aspects of the present invention in an opened condition.
Figure 38:
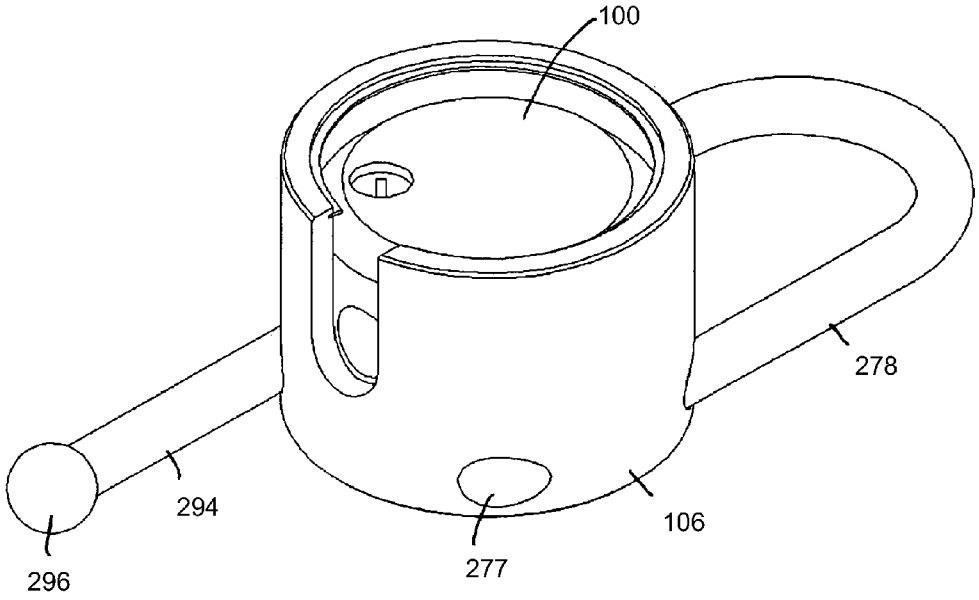
FIG. 38 depicts a perspective view of the link system of FIG. 37 in a locked condition.

In FIGS. 37 and 38, it is clear that the first end 292 of the shackle 278 is shorter than the second end 294. In such case, when the first end 292 is freed and the second end 294 retained within the link 106, the first end 292 may rotate such that items intended to be secured may be more easily attached to the shackle 278.

In addition, it will be noted that the second end 294 of the shackle 278 includes a restrictive element in the form of a ball 296. This ball prevents the second end 294 of the shackle 278 from being removed from the link 106. Other restrictive elements may also be provided, so long as they are larger than the aperture in the base 107 of the link 106 through which the shackle 278 moves. The restrictive elements may also be removable. For example, the restrictive element may be internally threaded so as to be threaded upon a threaded portion of the second end 294 of a shackle 278.

FIG. 37 depicts the lock in an open position while FIG. 38 depicts the lock in a locked position, such that the first end 292 of the shackle 278 is secured within the link 106.

Figure 39:
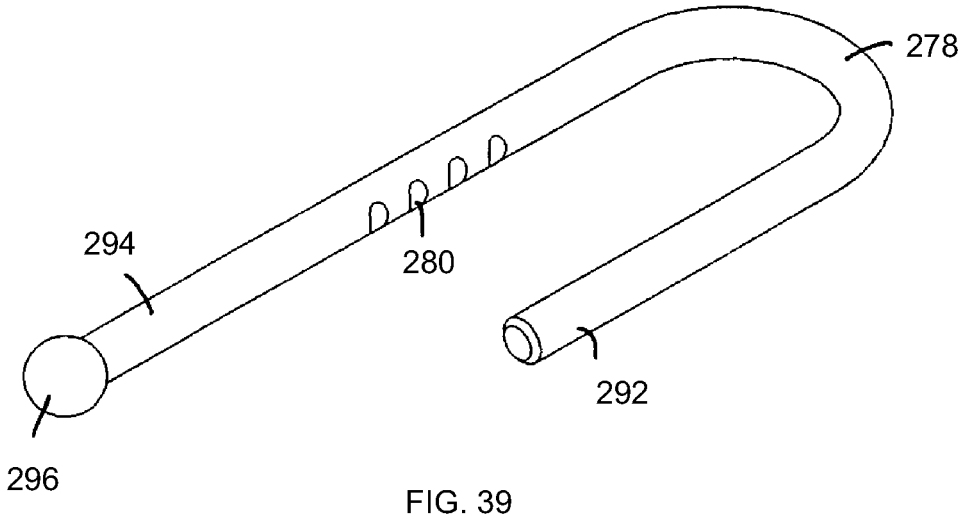
FIG. 39 depicts a perspective view of a shackle in accordance with certain embodiments of the present invention.
Figure 40:
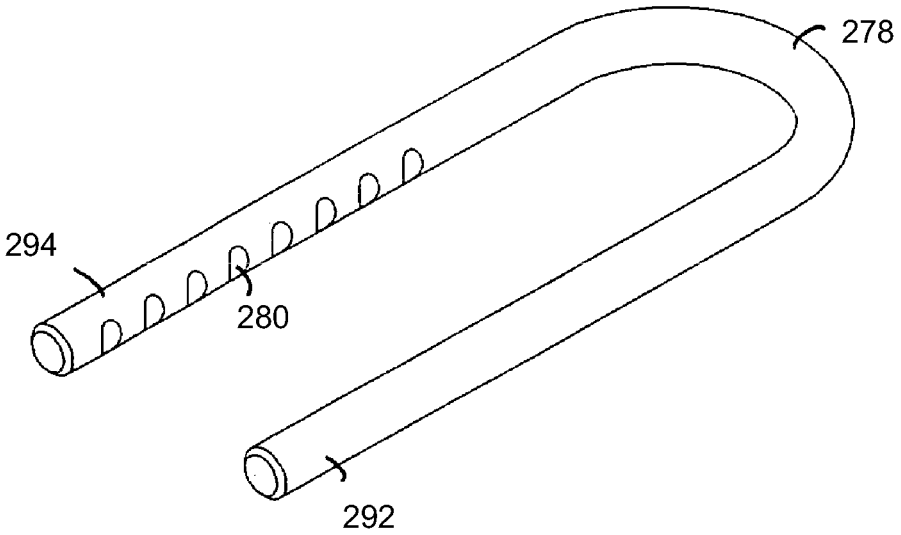
FIG. 40 depicts a perspective view of a shackle in accordance with certain embodiments of the present invention.
Figure 41:
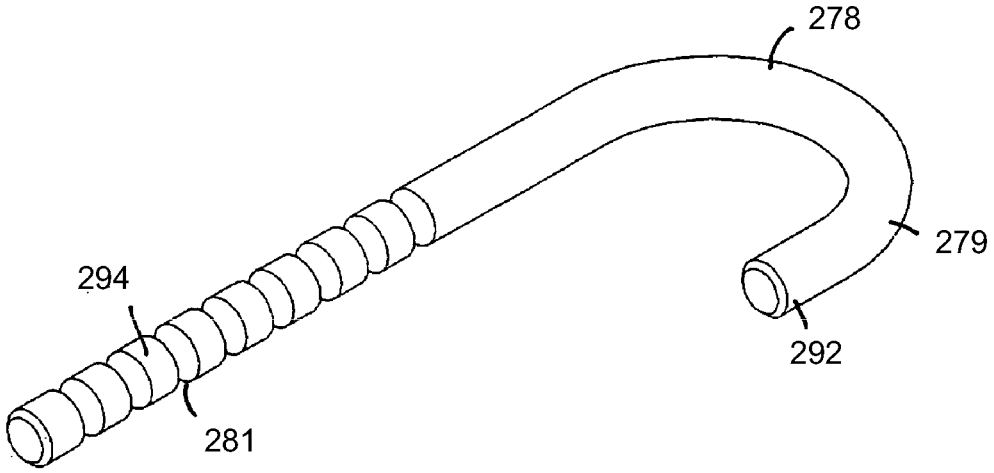
FIG. 41 depicts a perspective view of a shackle in accordance with certain embodiments of the present invention.

FIG. 39 depicts a perspective view of the shackle 278 of FIGS. 37 and 38, alone. FIG. 40 depicts a standard shackle 278, with both the first and second legs 292, 294 of equal length. FIG. 41 depicts another shackle 278 that may be utilized with the present invention. In this configuration, the shackle includes a very short first end 292, which may in fact be too short to enter the link 106. Nevertheless, the shackle 278 may find utility in certain applications, for example when securing taut chain. The first end of this shackle 278 depicted in FIG. 41 is also curved to form a hook 279, while the second end 294 is configured in the more conventional, straight configuration. Although not including notches 280, it will be appreciated that the adjacent channels 281 of the second leg 294 depicted in FIG. 41 serve the same purpose, and may be used interchangeably with notches 280. One feature of the adjacent channels is that the shackle 278 may freely rotate, even when the hockey puck lock 100 is locked.

Figure 42:
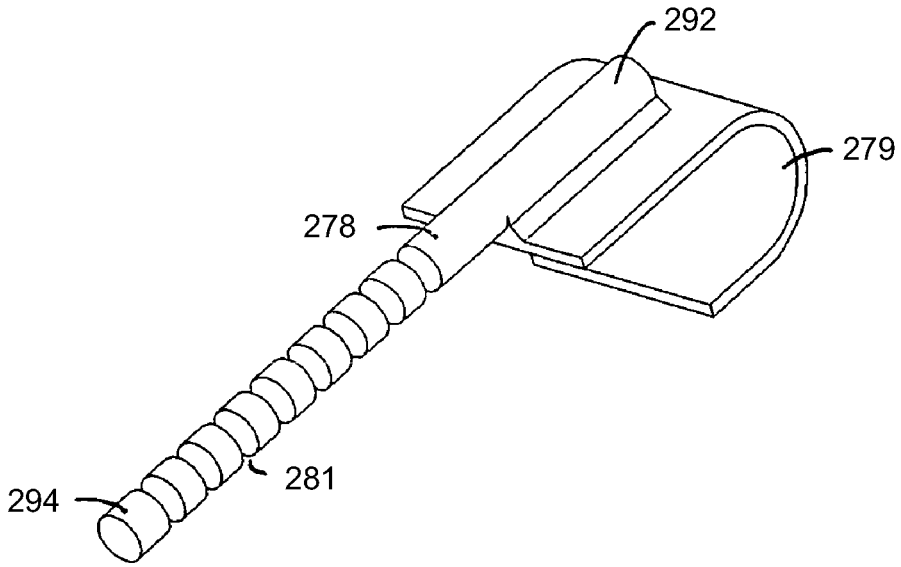
FIG. 42 depicts a perspective view of a shackle in accordance with certain embodiments of the present invention.

As similar shackle 278 is shown in perspective in FIG. 42. In this embodiment, the shackle 278 includes a wide-based hook 279 attached to its first end 292. It will be appreciated that this wide-based hook 279 is particularly adapted to be attached to vertical rods of container locks, as discussed previously and as will be further discussed. It will also be appreciated that each of the shackles may be configured to various lengths, such that each include a various number of notches 280 or channels 281, depending on the desired configuration. Obviously, the more notches 280 or channels 281, the more combinations of locking arrangements available. However, although the shackles 278 may be configured from hardened materials, the notches 280 and channels 281 may be targeted attack points, and are thus advantageously kept to a minimum in high security applications. Particularly, in certain applications, it is important that the notches 280 and channels 281 be limited to only the number that can fit within the link 106, such that none are exposed when the lock is locked.

Figure 43:
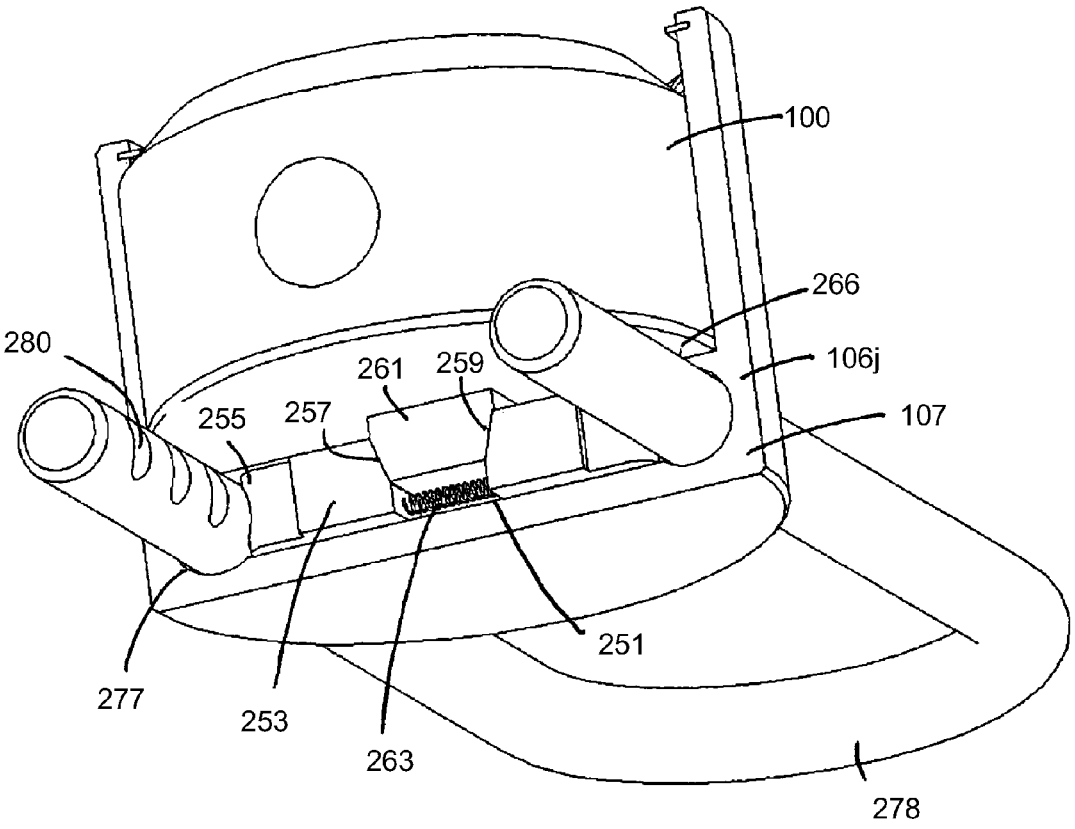
FIG. 43 depicts a partially cut-away perspective view of a link system in accordance with yet another aspect of the present invention in a locked condition.
Figure 44:
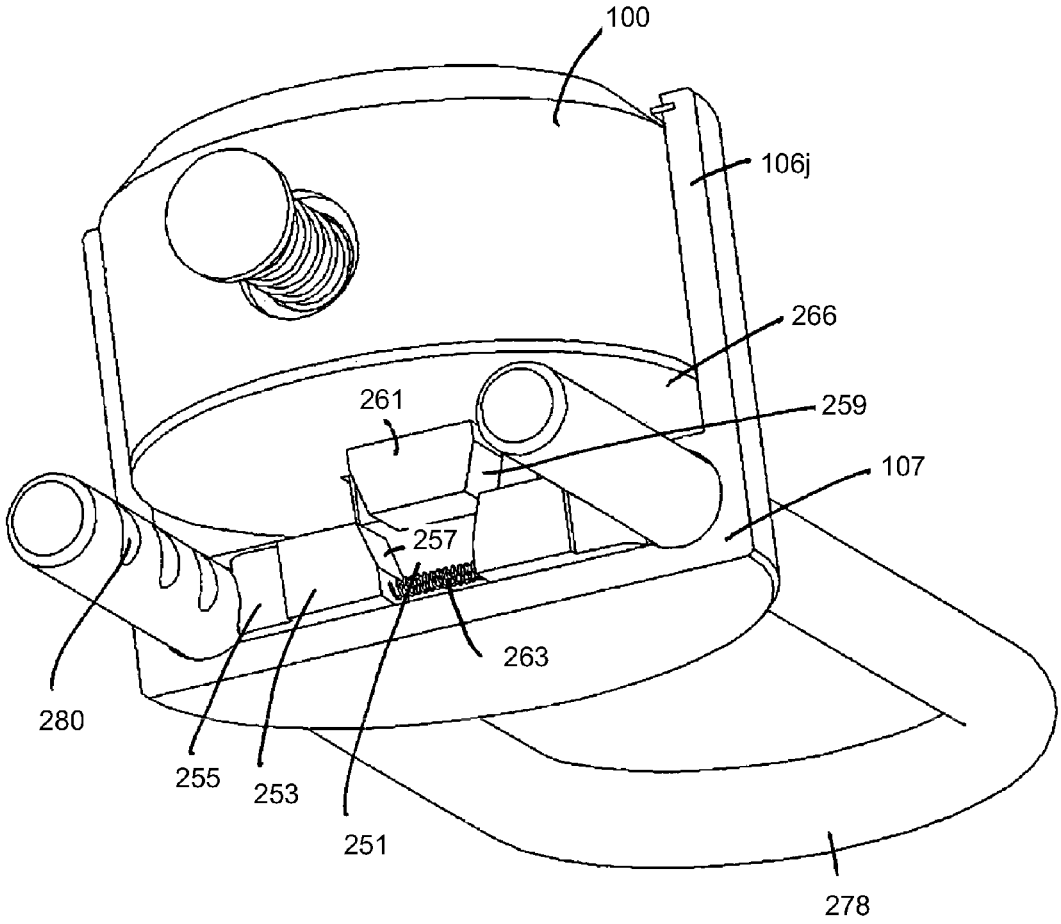
FIG. 44 depicts a partially cut-away perspective view of the link system of FIG. 43 in an unlocked condition.

FIG. 43 depicts a link comprising features in accordance with further aspects of the present invention. As shown in FIG. 43, the link 106*j* includes a novel shackle retention system. Within the base 107 of link 106*j*, the link 106*j* includes a channel 251 spanning between the apertures 277 through which the ends of the shackle 278 enter. The channel includes a pair of blocks 253 each having an element 255 adapted to mate with either a notch 280 or channel 281, as the case may be, on one end and a cammed surface 257 on the other end. The cammed surfaces 257 each face each other and are positioned to cooperate with the cammed surfaces 259 of a displacer 261, attached to the bottom of the plate 266. As the lock 100 is moved down toward the base 107 of the link 106*j*, the displacer 261 drops and its cammed surfaces 259 abut the cammed surfaces 257 of the blocks 253, to drive the elements 255 into the notch 280 or channel 281, as the case may be. A spring 263 may also be provided to pull the blocks together, such that the elements 255 are moved out of engagement with the notch 280 or channel 281, when the displacer 261 is lifted. FIG. 44 depicts the link 106*j* with lock 100 in the unlocked position, such that the displacer 261 is lifted and the blocks 253 are generally brought together by action of the spring 263.

Another feature contemplated for the link inventions is an inclined surface on the outer diameter that would minimize the impact of a hammer blow. Hammer blows are a common method of attack for locks and lock attachments. If the link was conical shaped, rather than cylindrical as shown, a hammer blow may be deflected to limit its impact. Such conical shaped links may be provided in accordance with certain aspects of the present invention.

Figure 45:
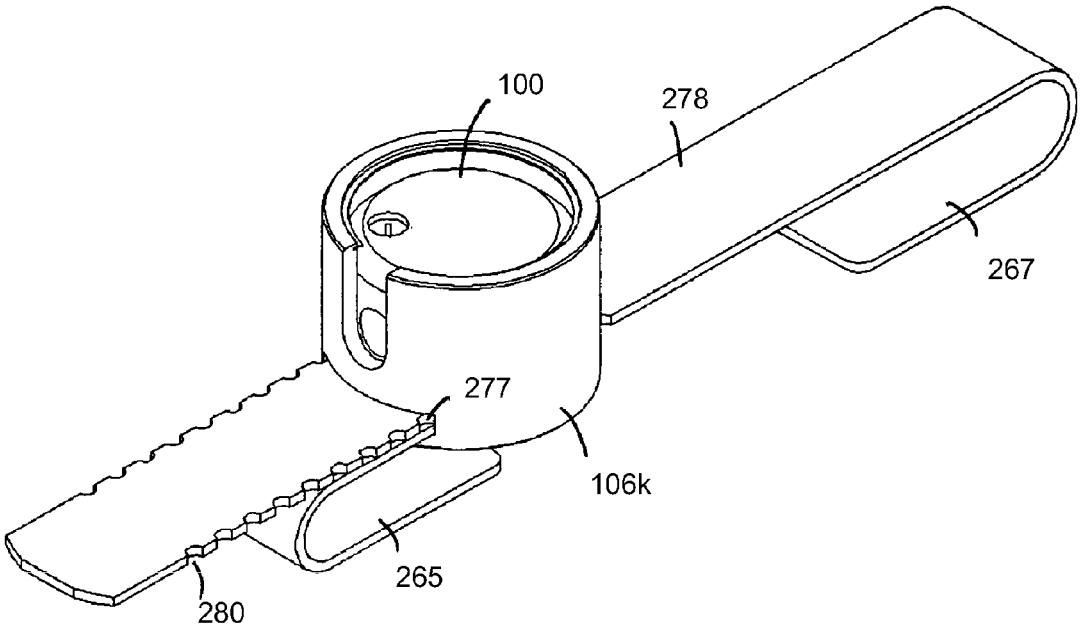
FIG. 45 depicts a perspective view of a link in accordance with a still further embodiment of the present invention.

FIG. 45 depicts a link in accordance with yet another aspect of the present invention. In accordance with this aspect, the link 106*k* may include provisions for use with a flat shackle 278, such as a single aperture 277 within which the shackle may enter. The aperture 277 is appreciably configured to accept the flat shackle 278. In addition, the link may include a hook portion 265 affixed to the base 107. The hook portion 265 may be opposed by a shackle hook 267 forming a portion of the shackle 278, such that the two hook portions 267, 269 face each other and may be utilized to capture items, particularly vertical rods of a container locking mechanism. The shackle may include notches 280 for sizing the distance between the hook portions 267, 269, the notches being adapted to capture pins (not shown) connected to a plate (not shown), which drops into locking association with the shackle 278 when the lock 100 is locked, as previously discussed.

Figure 46:
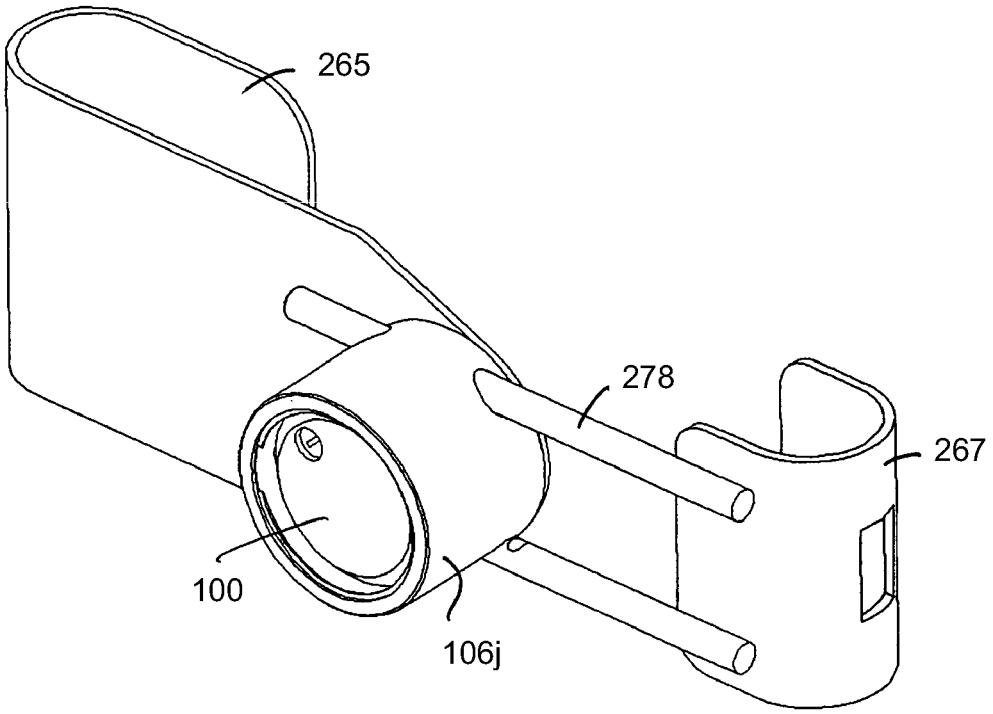
FIG. 46 depicts a perspective view of a link in accordance with another embodiment of the present invention.

FIG. 46 depicts a similar link 106*l*. As with link 106*k*, link 106*l* includes a hook portion 265 in fixed relation with the link 106*l*. Meanwhile, the shackle 278 includes a shackle hook 267 which is opposed with the hook portion 265 of the link 106*l*. The shackle hook 267 may move relative to the link 106*l*, such that the distance between the two hooks 265, 267 may be adjusted.

In either of the links 106*k*, 106*l*, the hook portion 265 may be formed integrally with the link 106*k*, 106*l*, or may be welded or otherwise attached thereto. It is preferred that the attachment method, and materials utilized, be appropriate for the strength level intended.

Figure 47:
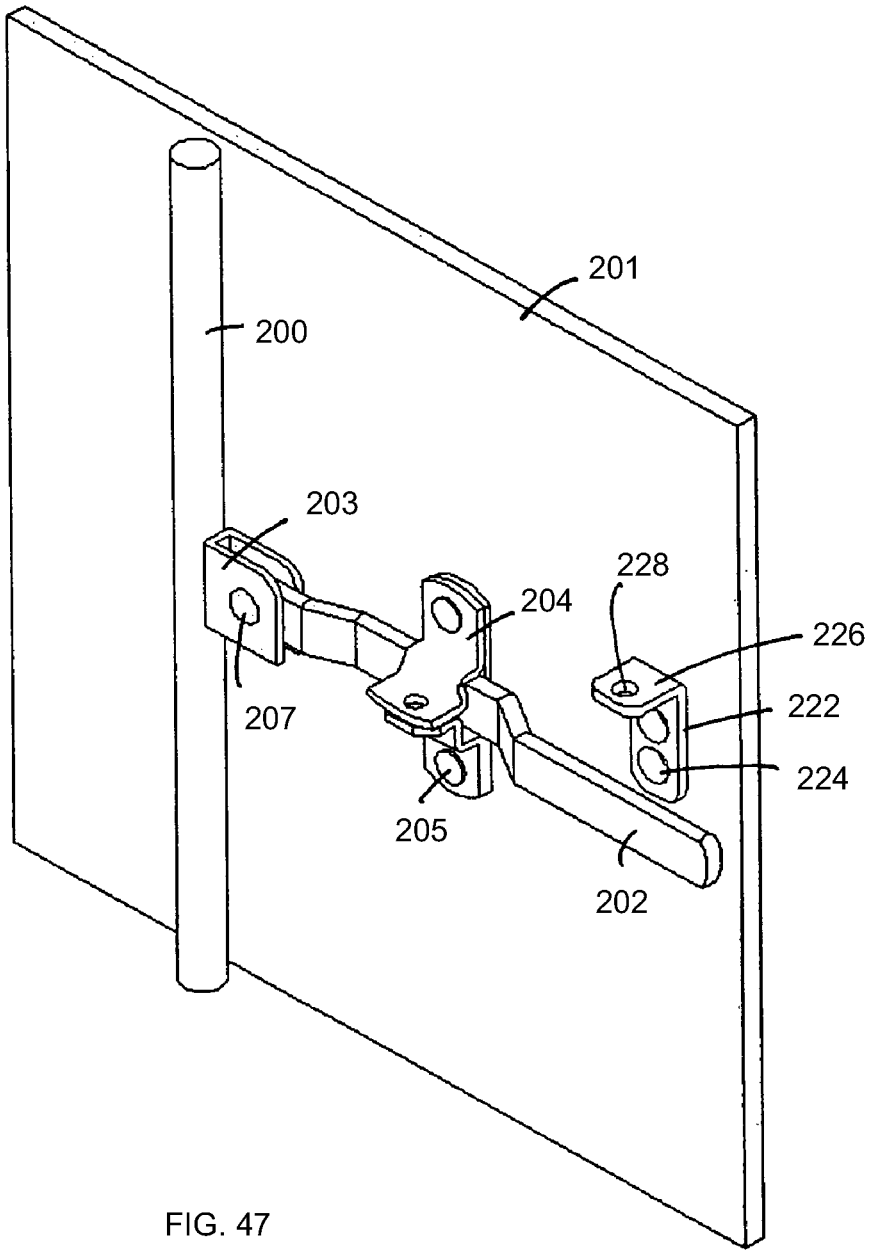
FIG. 47 depicts a perspective view of a conventional locking assembly used on barn-style doors of intermodal containers, trailers, and the like, with the addition of a bracket or hasp connected to the door in accordance with certain aspects of the present invention.

Moving along to other aspects of the invention, FIG. 47 primarily depicts a conventional arrangement of a vertical lockrod 200, handle 202, and hasp mechanism 204, commonly used on intermodal containers and barn door style doors found on truck trailers, where the handle is connected to the lockrod by a hinge 203, as previously discussed with respect to at least FIG. 15. Use of these conventional systems is well known in the industry. It is also well known that common attack points for forced entry are the rivets 205 holding the hasp mechanism 204 to the door and the rivets 207 of the hinge 205.

In accordance with the present invention, a bracket 222 may be attached to a container door 201, for example by rivets 224. The bracket may include a shelf portion 226 with an aperture 228. This bracket may be provided in addition to the conventional hasp mechanism 204.

Figure 48:
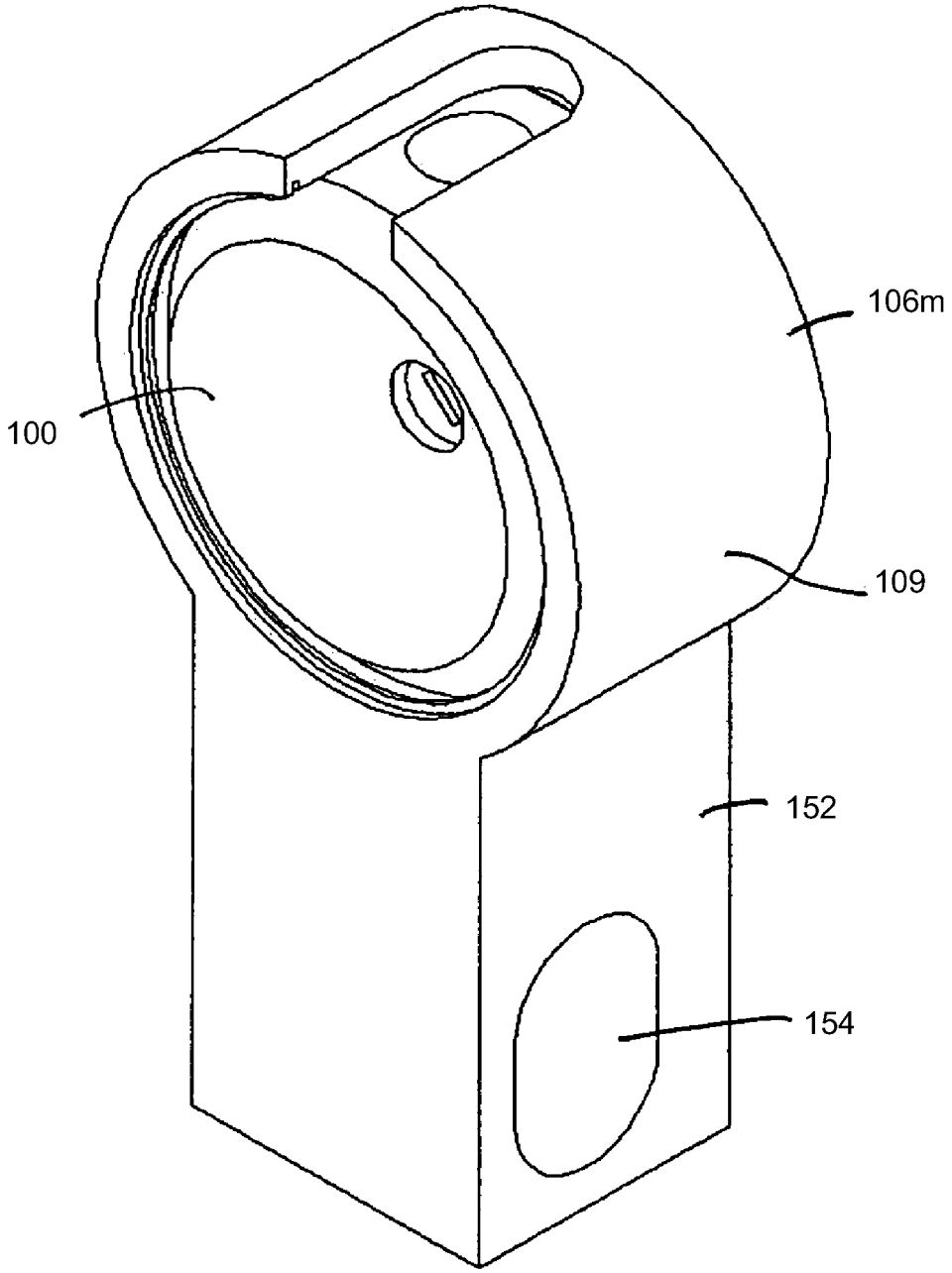
FIG. 48 depicts a perspective view of a link in accordance with further aspects of the present invention.
Figure 49:
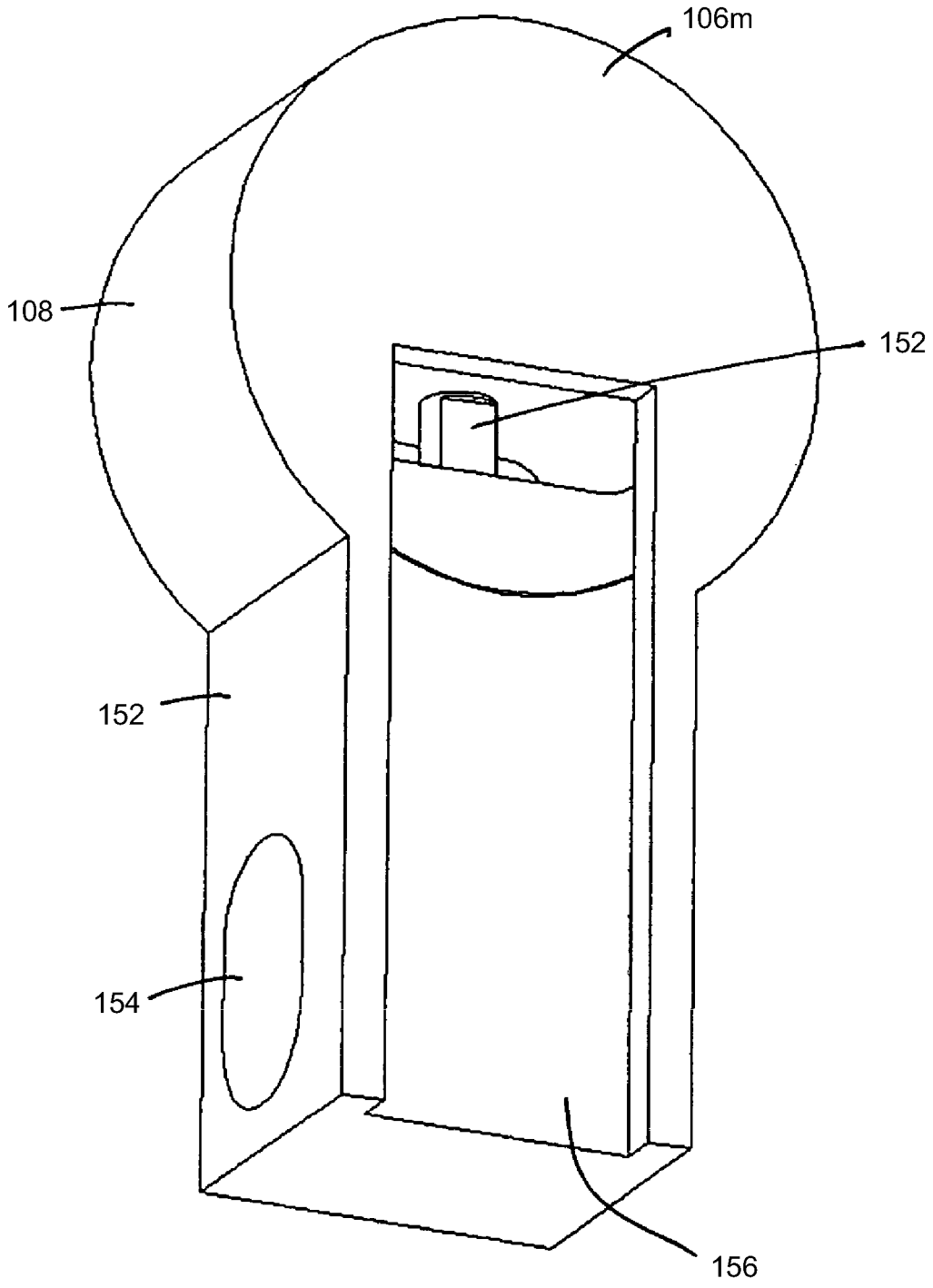
FIG. 49 depicts a rear perspective view of the link of FIG. 48.

A link 106*m* may be adapted to fit over the bracket 222 to secure the handle 202 in the locked position. Such a link is shown in perspective view in FIG. 48. As shown in FIG. 48, the link 106*m* may include an extension member 152 extending from the raised lip 108. The extension member 152 includes an aperture 154, which is sized and shaped to accept the handle 202. Further, the extension member 152 is sized and shaped to permit the shackle 102 (FIG. 2) of a hockey puck lock 100 to fit within the aperture 228 of the bracket 222 when the handle 202 is within the aperture 154 of the extension member 152. As shown in FIG. 49, a rear perspective view of the link 106*m*, the base 107 may be configured with a groove 156 within which portions of the bracket 222 (portions other than the shelf portion 226) may reside to ensure that the link 106*m* is flush against the door 201 when locked. The shelf portion 226 of the bracket 222 will therefore fit within the link 106*m* and hockey puck lock 100 such that the shackle 152 of the hockey puck lock 100 can fit through the aperture 228 of the bracket 222. It will be appreciated that in this configuration, the handle 202 cannot be rotated to open the door 201. In addition, it will be appreciated that the function of the conventional hasp mechanism 204 is fully retained and not interfered with.

Figure 50:
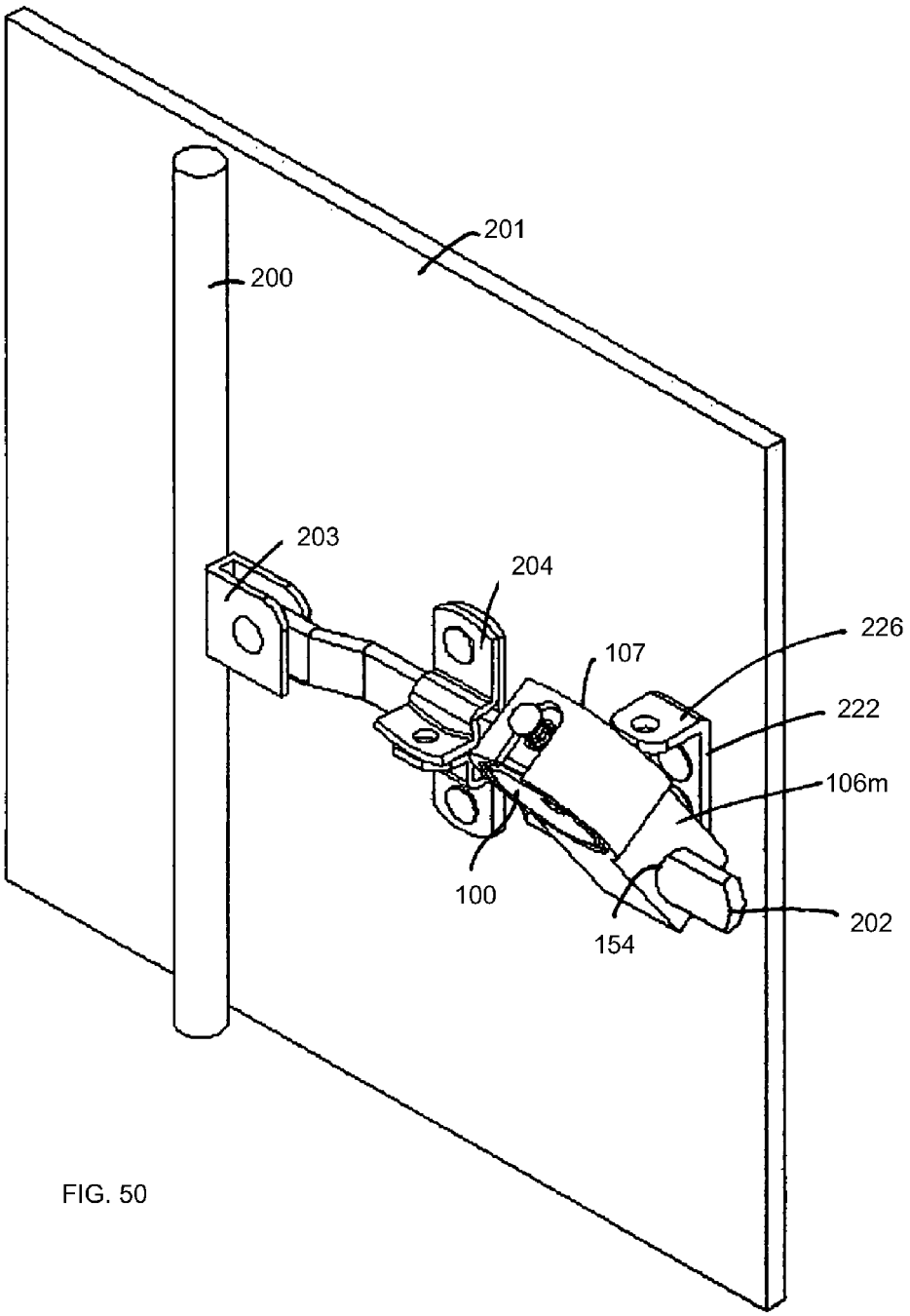
FIG. 50 depicts a perspective view of one step in the assembly in the link of FIG. 48 on the locking assembly of FIG. 47.

The aperture 154 of the extension member 152 is preferably over-sized compared to the handle 202 such that the link 106*m* may rotate when the handle 202 is placed through the aperture 152. FIG. 50 depicts a first step in the process of locking the link 106*m* on a door 201. In this figure, it is shown that the handle 202 is in the locked position and the hasp 204 is closed. Although the hasp 204 does not include a lock or seal, it could if desired by user.

Figure 51:
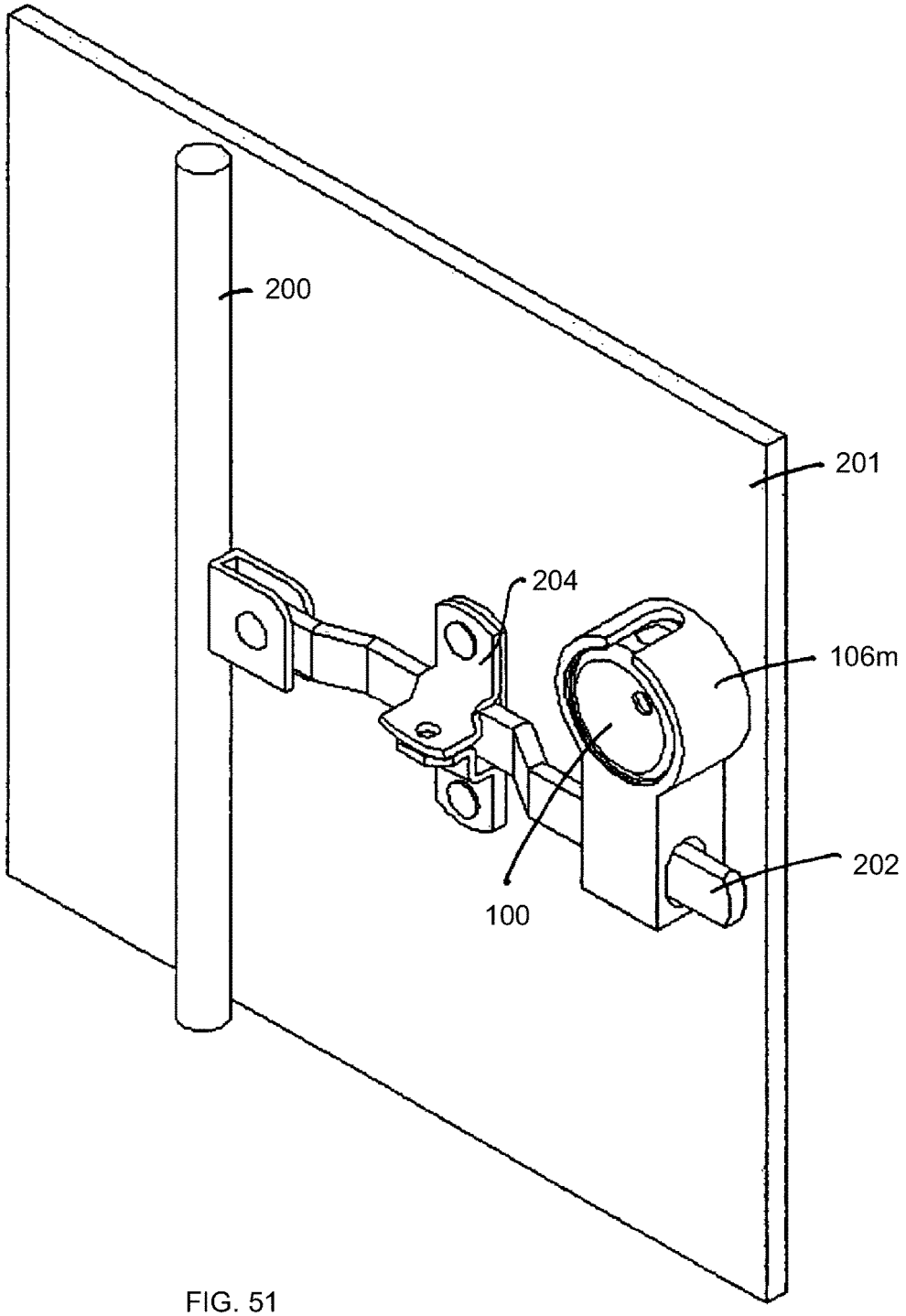
FIG. 51 depicts a second step in the assembly of the link of FIG. 48 upon the locking assembly of FIG. 47.

Even when in this locked position, the link 106*m* may be utilized to further secure the door 201. The link 106*m* may be slid over the handle 202 by inserting the handle 202 into the aperture 154. It will be appreciated that the link 106*m* must be tilted forward slightly such that the base 107 clears the shelf portion 226 of the bracket 222. Once the link 106*m* is properly aligned over the bracket 222, the link 106*m* may be rotated back toward the door 201, and into the position shown in FIG. 51. In this position, the lock 100 may be locked to further secure the handle 202.

Figure 52:
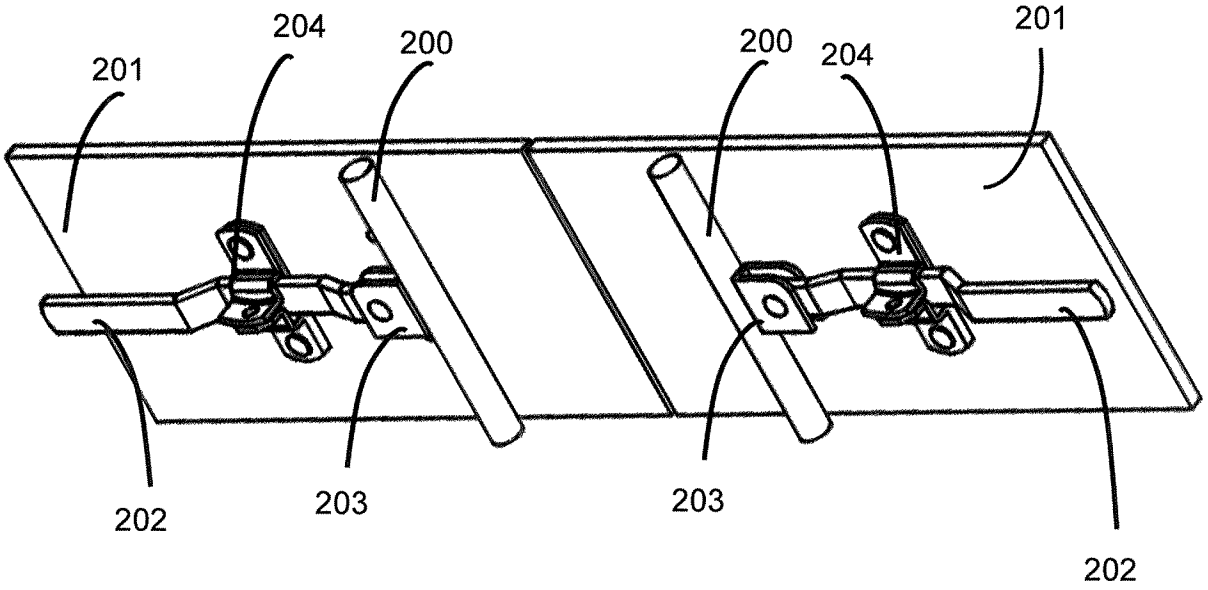
FIG. 52 (prior art)

Further aspects of the invention are adapted to secure container doors of the type having a pair of locking mechanisms of the type shown in FIG. 15, one on each adjacent door. For example, FIG. 52 depicts conventional container doors 201 locked by vertical lockrods 200. As is conventionally known, the locking mechanisms include a pair of handles 202, hasp mechanisms 204, and hinges 203 connecting the handles to the respective lockrods.

In previous embodiments of the invention, links and straps may be utilized, alone or in combination, to secure one or both container doors of the type shown in FIG. 52. In some conventional systems, one of the doors must be opened prior to the other being opened. In such systems, only one of the previously disclosed links and/or straps need be applied, although they may be applied, as required, to both doors for added security. In other systems, the doors may operate independently from each other. In such cases, a pair of links and/or straps should be provided to fully secure the doors.

In addition, and as will be discussed, straps may be provided with or without links, depending on the particular arrangement of the strap as required by the application, desired security level, and the like.

In most of the previous embodiments, the link and straps have focused on securing the handle such that the handle cannot move relative to the vertical lockrod once secured by the link or strap. In other embodiments, the links have been provided with elements to permit attachment between two vertical lockrods. The following embodiments build on the teachings of providing a strap between two vertical lockrods, to secure the container doors.

Figure 53:
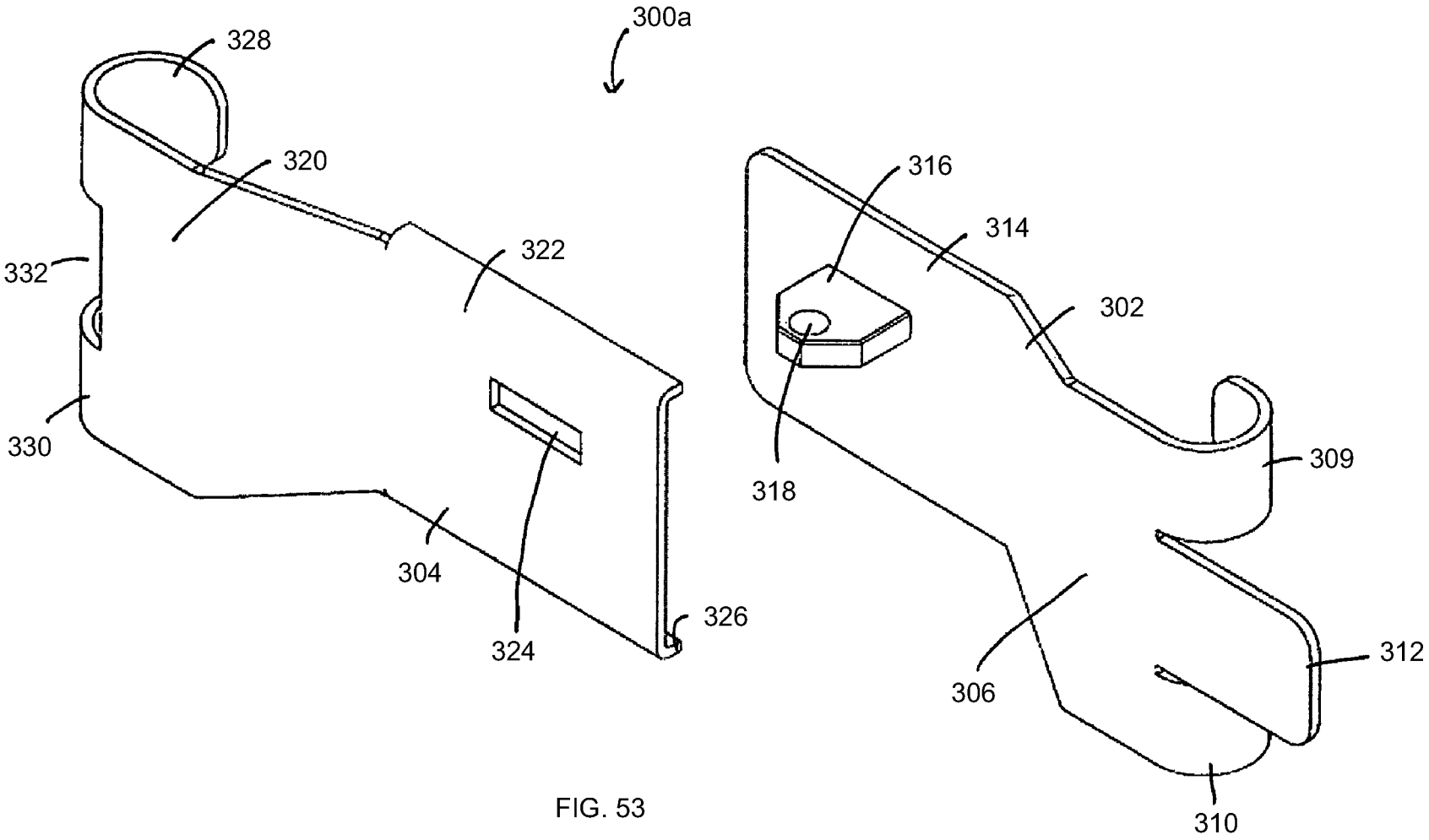
FIG. 53 depicts an exploded perspective view of a strap in accordance with certain aspects of the present invention.

FIG. 53 depicts an exploded perspective view of a strap 300*a* configured to lock a pair of adjacent lockrods 200. The strap includes a base section 302 and a cover section 304. The base section includes a finger portion 306 having three fingers, two of the fingers 308, 310 are curved and the third finger 312 is straight. The curved fingers 308, 310 are adapted to mate with the vertical lockrod 200 of a conventional door lock. In this regard, the curvature of the curved fingers 308, 310 should be such that the fingers neatly secure the vertical lockrod. The straight finger 312, meanwhile, is located between the curved fingers 308, 310 and is adapted to cover the hinge 203 associated with the lockrod 200. It will be appreciated that the curved fingers 308, 310 are separated a sufficient distance to bracket hinge 203, such that base member 302 may rotate about the vertical lockrod 200 once installed.

The base member also includes a main portion 314 adjacent to the finger portion 306. The main portion 314 includes a protruding hasp 316 having an aperture 318. As will be discussed, the hasp 316 and aperture 318 are configured to accept a variety of lock shackles.

It will be appreciated that the main portion 314 may be offset from the finger portion 306, such that the base portion 314 is substantially between a plane formed through the vertical lockrods 200 and the adjacent doors 201. Preferably, the base section 314 is configured to be very close to the doors 201, such that an attack by prying between the doors 201 and the base section 314 may be eliminated. In addition, the offset serves to locate the lock closer to the doors and within the protective envelope of the vertical lockrods, such that accidental damage to the lock can be avoided.

The offset distance will of course depend on the particular arrangement of the lockrods 200 and doors 201, but is typically on the order of 1 to 2 inches.

Like the base 302, the cover 304 includes a finger portion 320 and a main portion 322. The base portion 322 includes an aperture 324 sized and configured to permit passage of the hasp 316 when the base portion 322 of the cover 304 is placed over the base portion 314 of the base 302. The main portion 322 of the cover 304 may also include rounded portions 326 to partially extend over the base portion 314 of the base 302.

The finger portion 320 of the cover includes two curved fingers 328, 330 separated by an open area 332. The curved fingers 328, 330 are adapted to fit partially around a lockrod 200, to secure the cover 304 to the lockrod 200. The open area 332 is typically mounted over the hinge 203, and permits the cover 320 to rotate around the lockrod 200 without interference from the hinge 203.

In a similar manner to the base 302, the main portion 322 of the cover 304 is offset from the finger portion 320, to move the main portion 322 closer to the doors 201.

Figure 54:
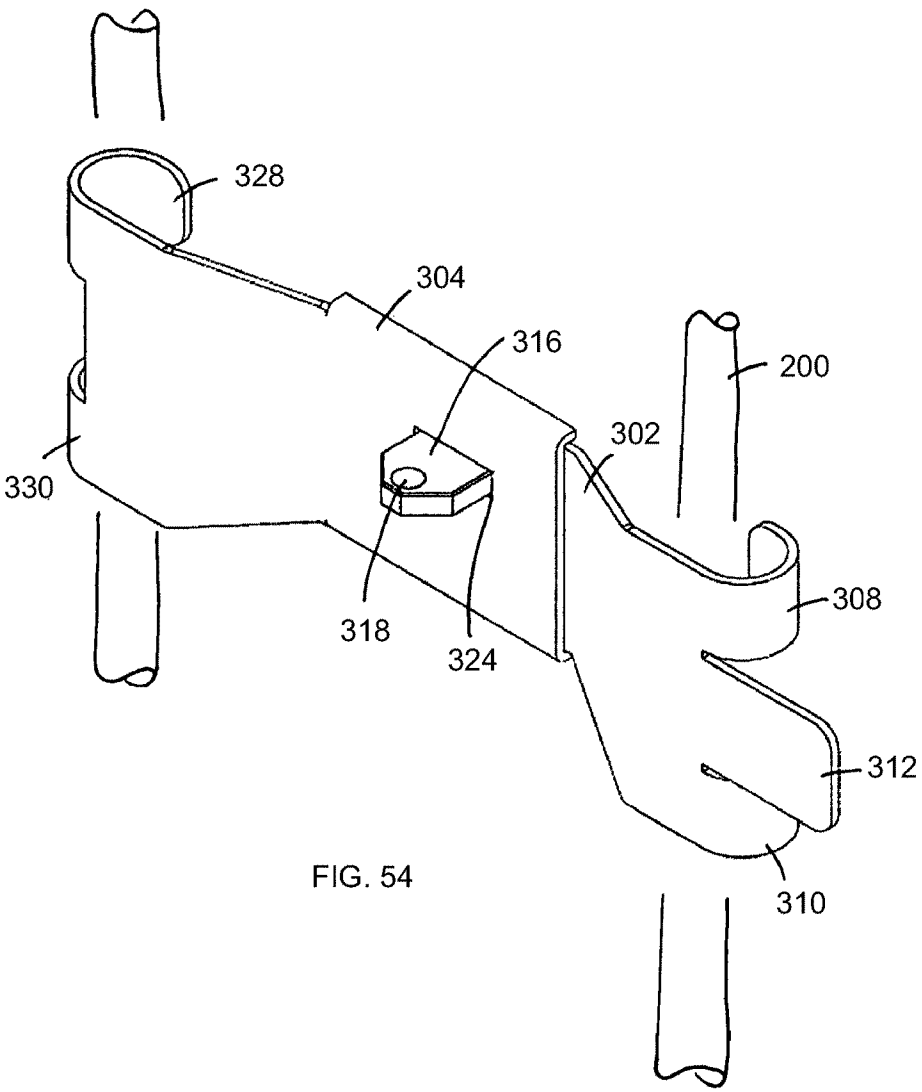
FIG. 54 depicts a perspective view of the strap of FIG. 53 assembled upon the locking assembly of FIG. 52 with certain elements not shown for clarity.

FIG. 54 depicts a perspective view of a strap 300*a* in a fully assembled condition, in place securing a pair of vertical lockrods 200. For clarity, the hinges 203 are not shown. As shown, the cover 304 may be placed over the base 302 such that the hasp 316 of the base 302 protrudes from the aperture 324 of the cover 304. It will be appreciated that the distance between the vertical lockrods 200, and thus the overall dimensions of the strap 300*a*, are fixed, such that the strap 300*a* associated with this particular aspect of the invention is limited to use with lockrods 200 spanning a particular distance apart. Other embodiments of straps include means for adjusting the span distance, such that the strap may be utilized with a variety lockrod configurations. Once the strap 300*a* is positioned as shown in FIG. 54, a lock or seal may be inserted through the aperture 318 of the hasp.

To place the strap 300*a* in the locked position shown in FIG. 54, one may first lock the doors 201 in the conventional manner. One may then place the fingers 308, 310 of the base 302 around one of the vertical lockrods 200, such that the main portion 314 of the base 302 is adjacent to the door with its hasp 316 facing outward. The fingers 328, 330 of the cover 304 may then located on the other vertical lockrod 200 with the main portion 322 of the cover 304 away from the face of the doors 201. The main portion 322 of the cover 304 may then be swung inward toward the doors 201 such that the hasp 316 of the base 302 penetrates the aperture 324 of the main portion 322 of the cover 304. A suitable lock or seal may then be utilized to lock the strap 300*a* in place.

Figure 55:
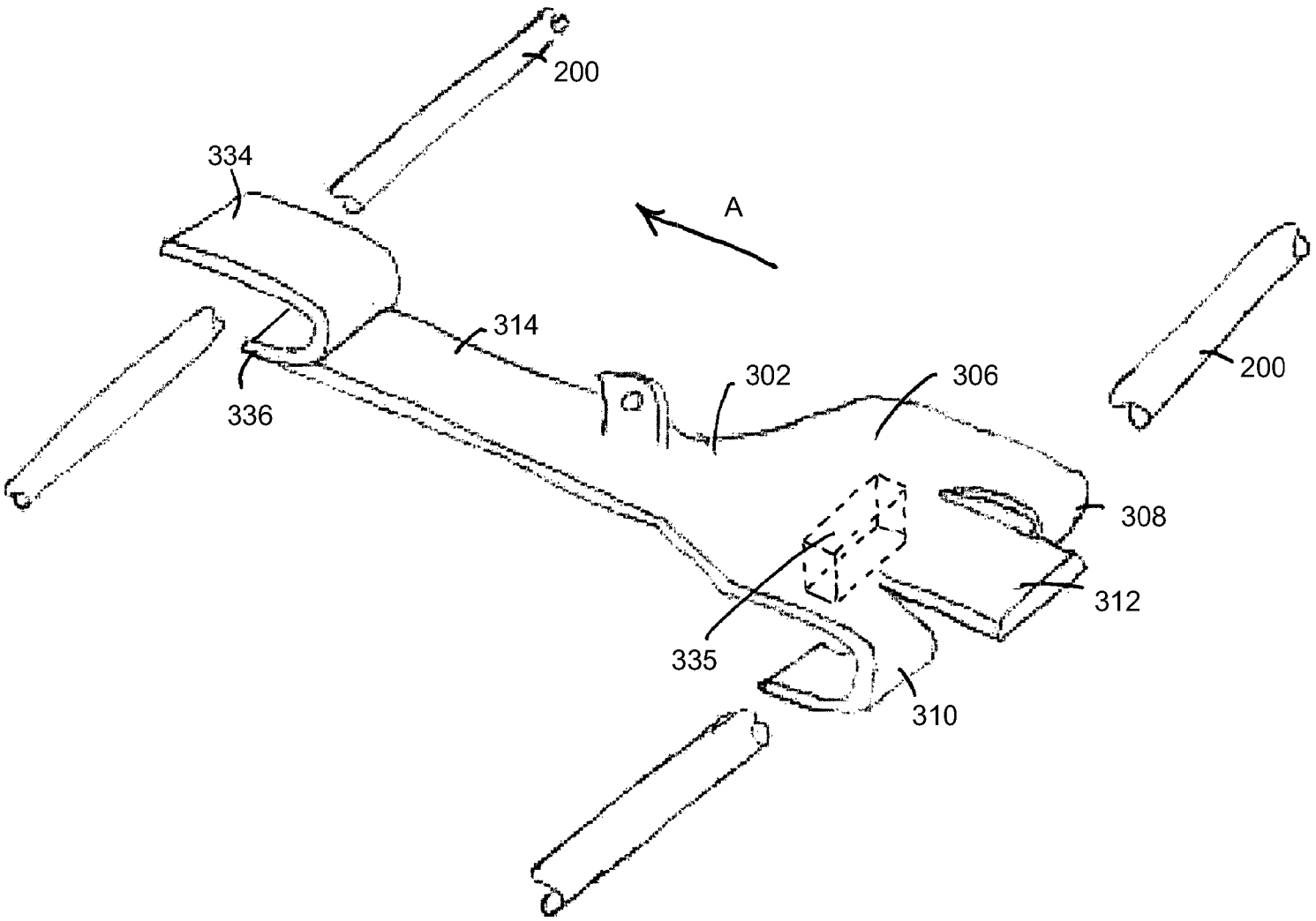
FIG. 55 depicts a perspective view of a portion of a strap in accordance with still further aspects of the present invention, with portions of the locking assembly of FIG. 52 shown.

In another strap embodiment, a strap 300*b* may be configured similarly the strap 300*a*, but may include a third finger 334 located within the open area 332. As shown in FIG. 55, the third finger 334 may be formed from an extension of the main portion 314 of the base 302. This third finger 334 may be adapted to cover the hinge 203 associated with the vertical lockrod 200 to which it is attached.

Figure 56:
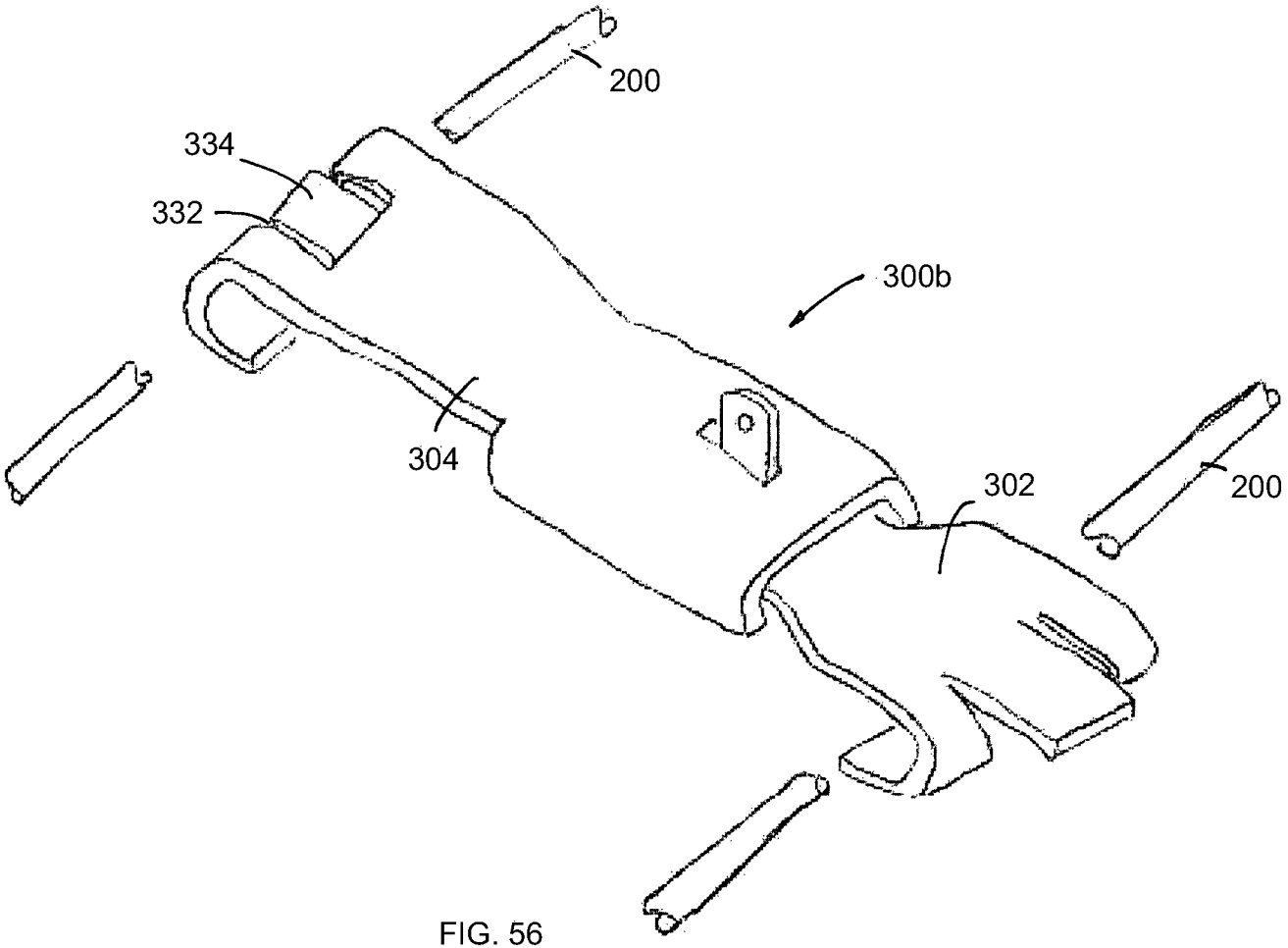
FIG. 56 depicts a perspective view of a fully assembled strap in accordance with still further aspects of the present invention with portions of the locking assembly of FIG. 52 shown.

Preferably, the base 302 includes a short finger portion 336 associated with the finger 334 such that the two elements form a J configuration, as shown in FIG. 55. In order to install the base 302 on the lockrods 200, one then preferably places the finger portion 306 of the base 302 against a lockrod 200, and slides the base 302 in the direction of arrow A until the fingers 308, 310 of the finger portion, and 334 of the main portion 314, contact the respective lock rods. Thereafter, a cover, such as cover 304, may be placed over the base 302 in the manner previously described, to arrive at the fully assembled strap shown in FIG. 56. Note that the finger 334 fits neatly within the open area 332 of the cover 304.

One method of attacking a vertical lockrod system of the type discussed herein is to wrap a tensioning element around the two adjacent rods and tension a member to draw the rods together. An example of this technique is where the attacker uses chain wrapped around the bars, where the chain is brought into a taut condition and then pulled more and more until the bars deflect, or bend. In order to combat this method of attack, the base 302 of the strap 300*a* may be configured with a stop-block 338. The stop-block may extend down from the finger portion 306 toward the tips of the fingers 308, 310, as if being held in the palm of a hand. It will be appreciated that the combination of the stop-block member 338, and the J-shaped configuration of the finger 334 and the short finger portion 336 prevent the lockrods from being bent toward each other, as the bars 200 will hit the stop-block 338 and J-shaped finger portion upon bending. It is preferred that the stop-block member 338 be positioned such that the lockrod 200 may still easily fit between the stop-block 338 and the limits of the fingers 308, 310.

Figure 57:
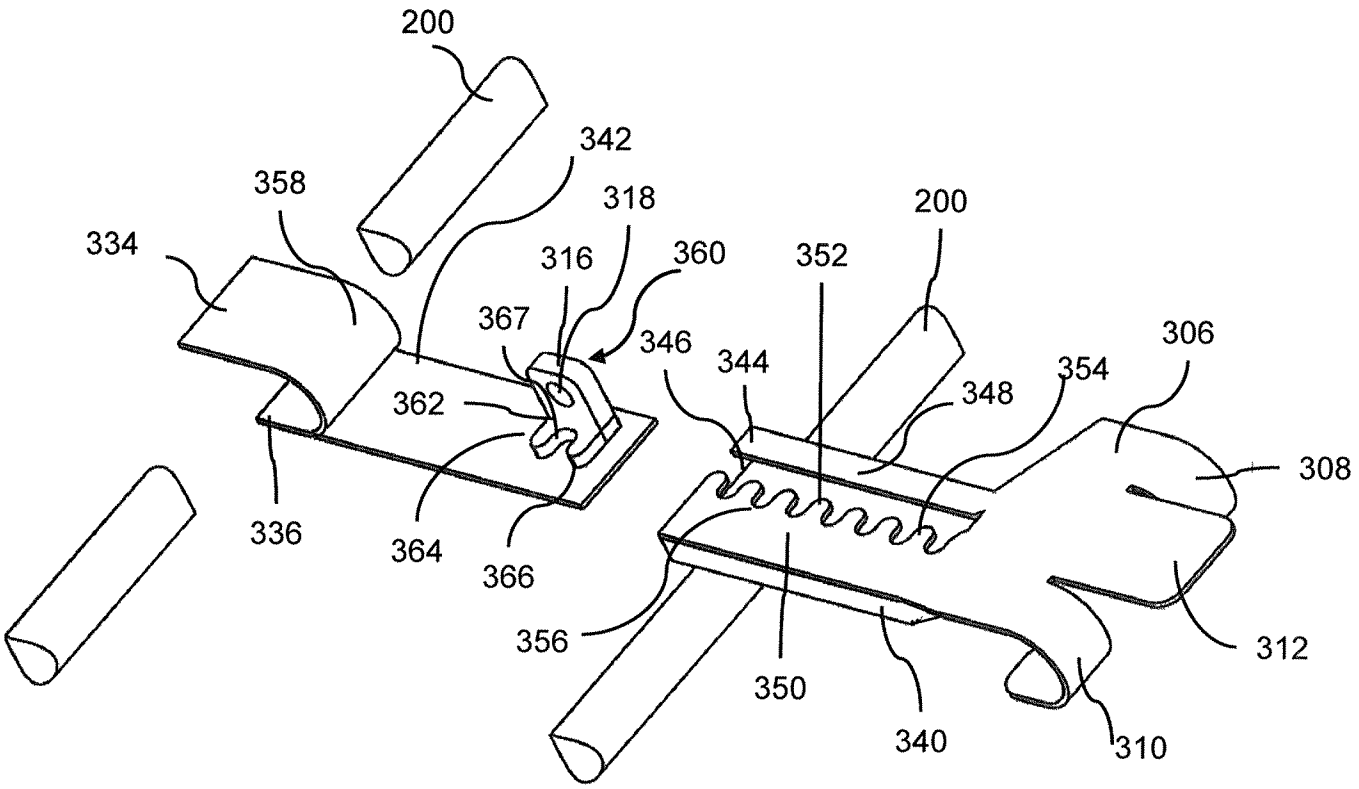
FIG. 57 depicts a exploded perspective view of portions of a strap in accordance with still further aspects of the present invention with portions of the locking assembly of FIG. 52 shown.

In order to make the strap adjustable, such that it may fit lockrods separated by different distances, the base of the strap may be made adjustable. One such adjustment mechanism is shown in FIG. 57. As shown in FIG. 57, the adjustment mechanism may replace the base 302 with a first base 340 and a second base 342, with the second base 342 adapted to fit within the first base 340, as will be discussed.

The first base 340 may include a finger portion 306 which is substantially similar to the finger portion 306 of base 302, inclusive of the fingers 308, 310, 312. However, in the main portion 314, the first base 340 may include a size adjustment mechanism 344. The size adjustment mechanism 344 embodied comprises a channel 346 bound at an upper limit by a straight segment 348 and at a lower limit by a grooved segment 350. The grooved segment 350 may be created by a repeating series of tab members 352 forming peaks 354 and valleys 356.

The second base 342 includes a finger portion 358 having a finger 334 and short finger portion 336 substantially similar to those of strap 300*a*. Opposite the finger portion 358, the second base 342 includes an adjustment portion 360 sized and configured to fit within the channel 346. The adjustment portion 360 includes a hasp 316 with an aperture 318 in the conventional manner. However, the hasp 316 also includes a base forming a grooved segment 362 configured to mate with the grooved segment 350 of the first base 340. The grooved segment 362 of the hasp 316 includes a pair of tabbed members 364 with two peaks 366 and a single valley 367 therebetween.

Once the second base 360 is fitted within the channel 346 of the first base 340, the peaks 366 of the hasp 316 may be fitted within the valleys 356 of grooved segment 350 of the first base 340, to size the first base and second base 340, 342. It will be appreciated that when appropriately sized, the first base 340 and second base 342 essentially form the base 302 of the previous embodiment. A cover 304 may then be fitted over the first base 340 and second base 342 to finish the strap (referenced as 300*c* although not shown). As the location of the aperture 324 of the cover 304 is fixed in relation to the location of the hasp 316 of the second base 342, the aperture 324 may be consistently located, as the hasp 316 does not move in relation to the aperture 324 (only the first base 340 moves).

As discussed, adjustable straps may be utilized to fit lockrods of varying dimensions. For example, typical lockrods may typically span between 10 and 15 inches apart. It is preferred that the adjustable straps be manufactured to accommodate this span. Such adjustable straps may find utility in the general marketplace, where lockrod dimensions between different containers are variable. Alternatively, there are many fleet owners that may have containers with lockrods that are consistently sized. Rather than being burdened with the expense and added sophistication of an adjustable strap, the fleet owner may simply utilize a non-adjustable strap sized and configured for the particular specification of the fleet.

Figure 58:
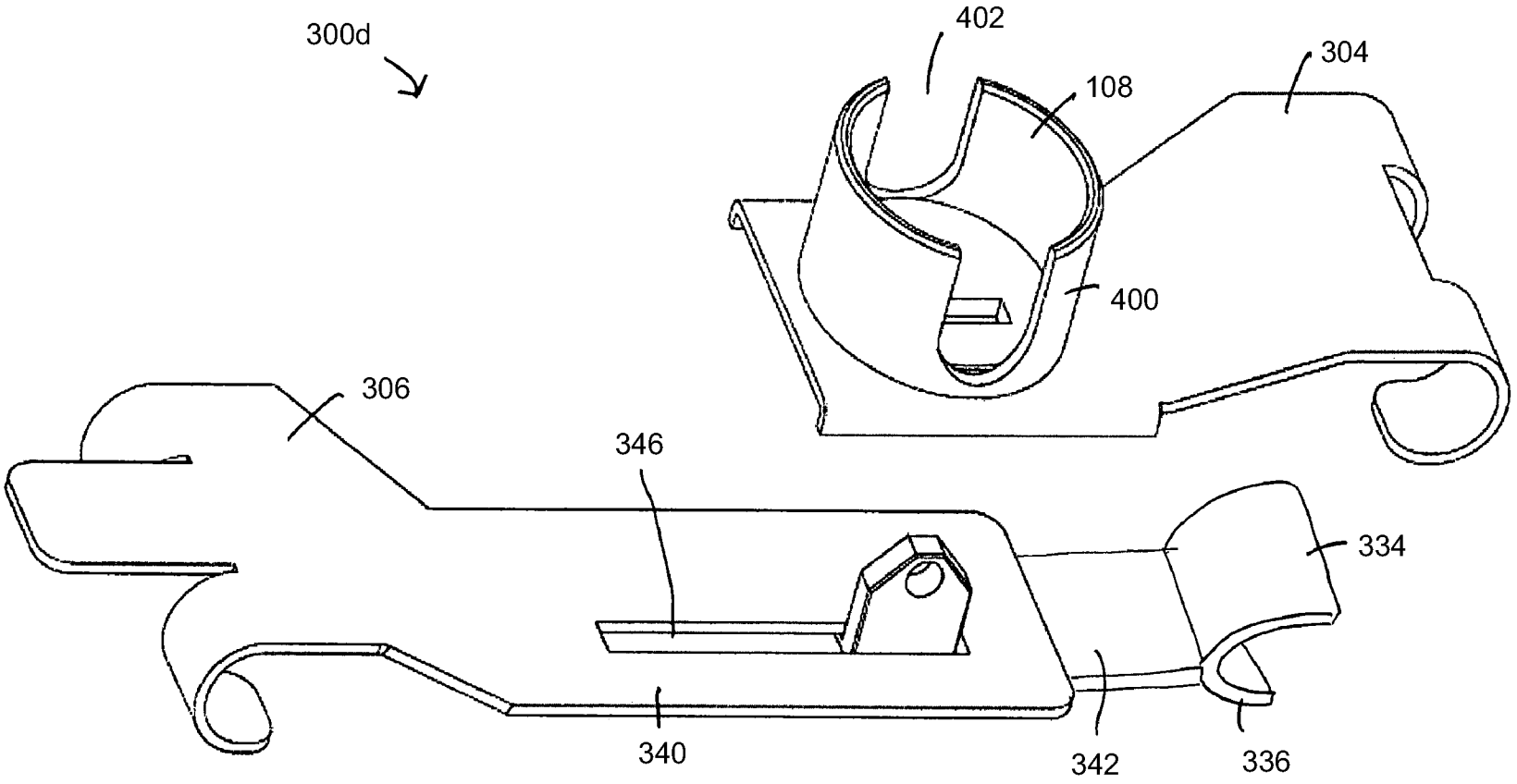
FIG. 58 depicts a partially exploded perspective view of an adjustable strap in accordance with yet another aspect of the present invention.

FIG. 58 depicts a strap 300*d* in accordance with further aspects of the present invention. The strap 300*d* shown in FIG. 58 is substantially similar to strap 300*b* referenced with respect to FIG. 57, with the addition of a link 400, of the types previously discussed. The link 400 is adapted to secure a hockey puck style lock primarily, but may include features such as openings 402 in its raised lip 108, which enable additional styles of locks to be utilized. It will be appreciated that the link 400 adds extra measures of security not realized in straps 300*a*, 300*b*, 300*c*, which all have exposed hasps 316.

Figure 59:
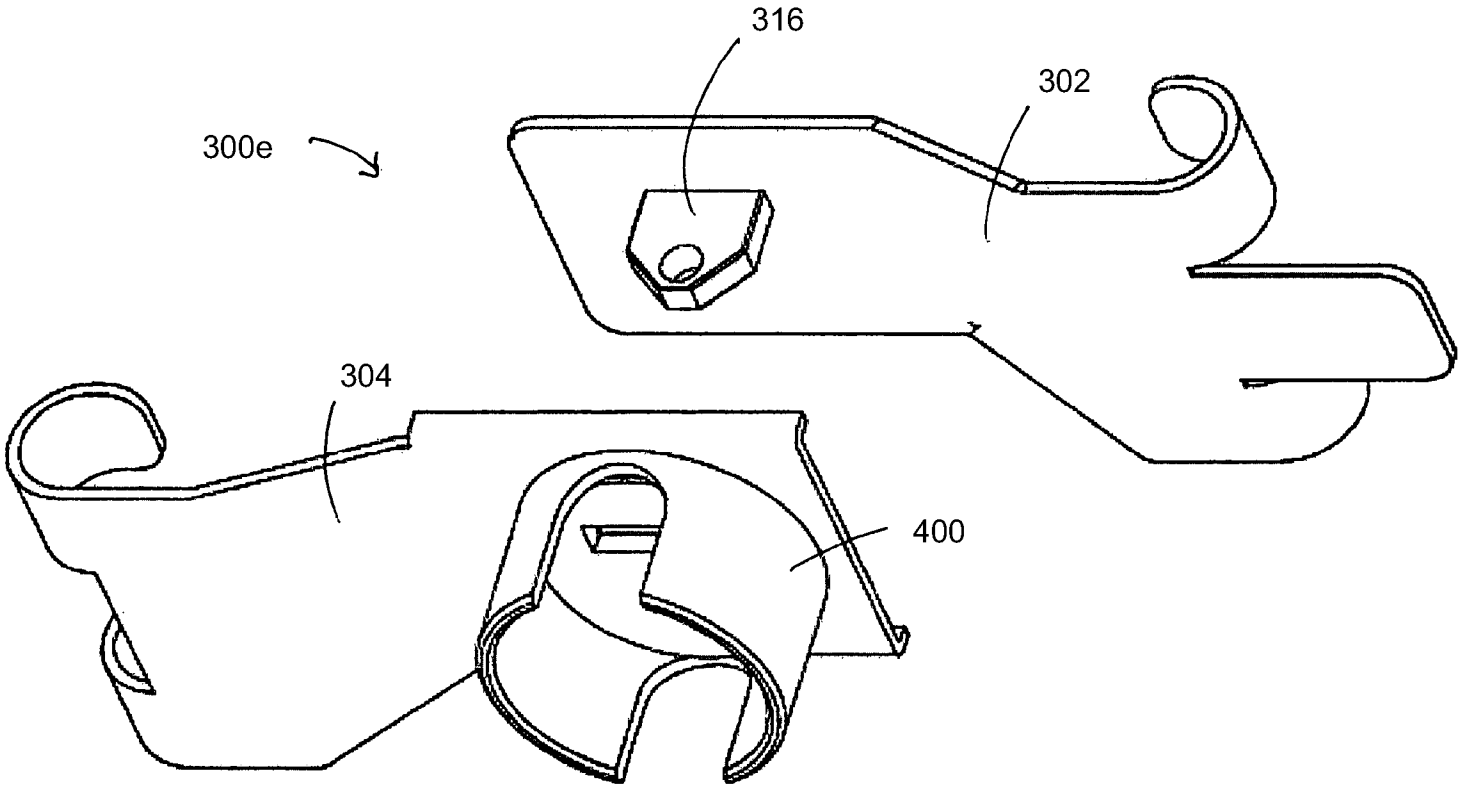
FIG. 59 depicts an exploded perspective view of a non-adjustable strap in accordance with certain aspects of the present invention.

While FIG. 59 depicts an adjustable strap 300*e*, the grooved segments being beneath the first base 340 and therefore hidden from view in the perspective shown, the strap 300*e* depicted in perspective view in FIG. 59 is of a non-adjustable strap 300*e*. Strap 300*e* shares many of the features of strap 300*a* shown in FIGS. 53 and 54, with the addition of a link 400 attached to the cover 304 for added protection against attack.

Figure 60:
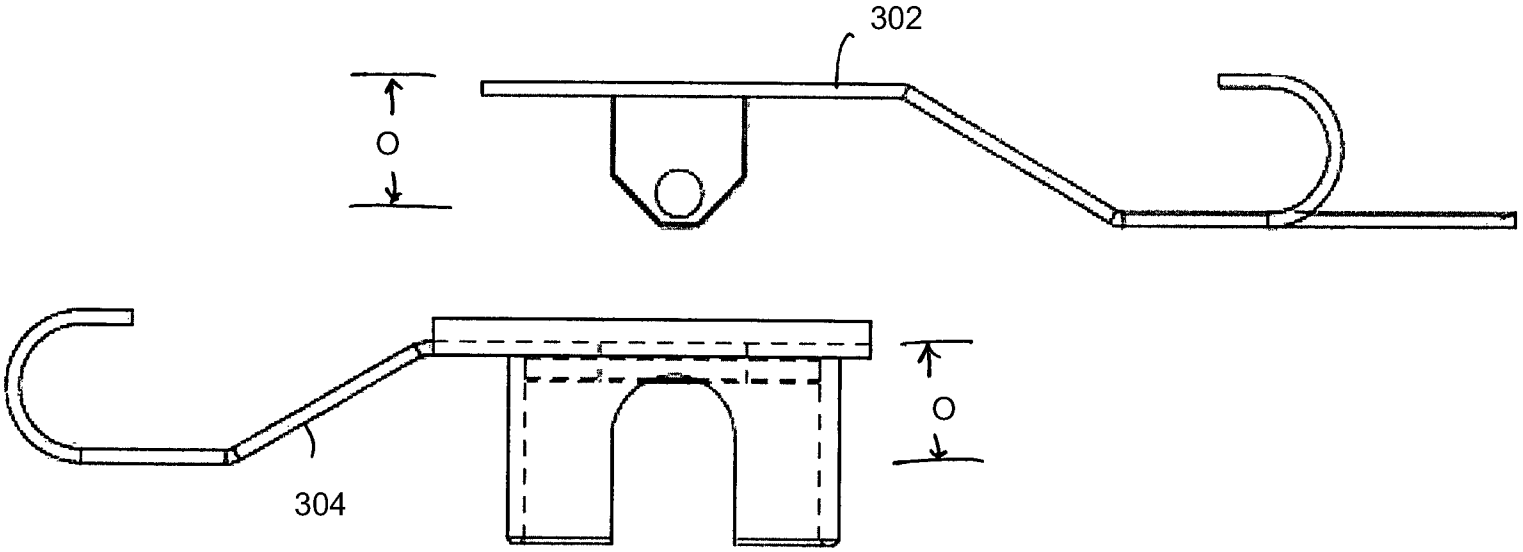
FIG. 60 depicts a top plan view of the strap of FIG. 59.

FIG. 60 depicts a top view of the link 300*e* of FIG. 59. In this view, the offset "O" is clearly shown. Again, by offsetting the strap elements, the device locates the lock closer to the doors than is possible without the offset "O." This protects the lock against accidental damage by ensuring that it is somewhat protected by the bars, but also helps to prevent levered attacks against the strap by levering a bar between the strap and the doors. It will be appreciated that the various links and straps may be provided with or without this offset.

Figure 61:
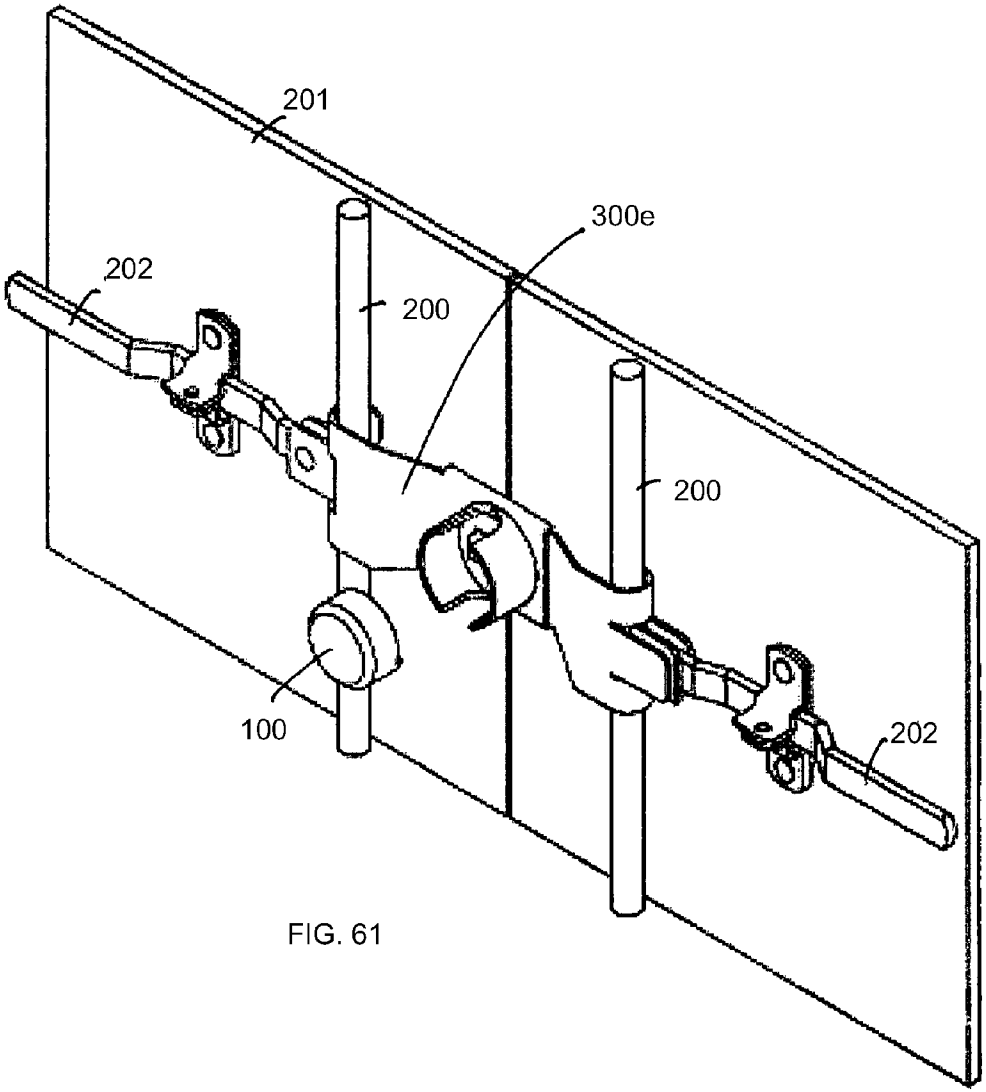
FIG. 61 depicts a strap with link assembled upon the locking assembly of FIG. 52, in accordance with certain aspects of the present invention together with a hockey puck lock outside the link.
Figure 62:
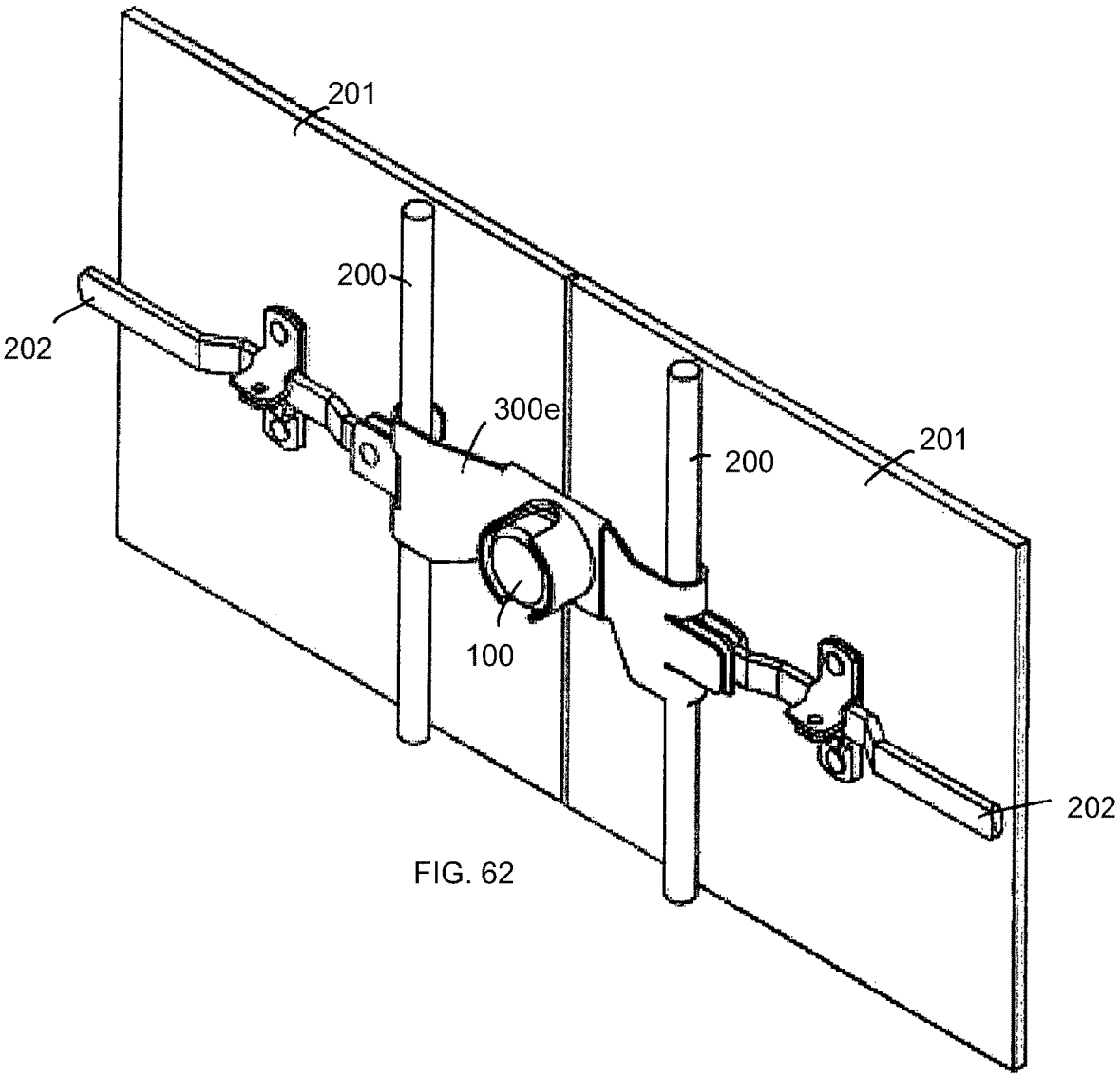
FIG. 62 depicts a strap of FIG. 61 in a fully locked condition with a hockey puck lock installed.
Figure 63:
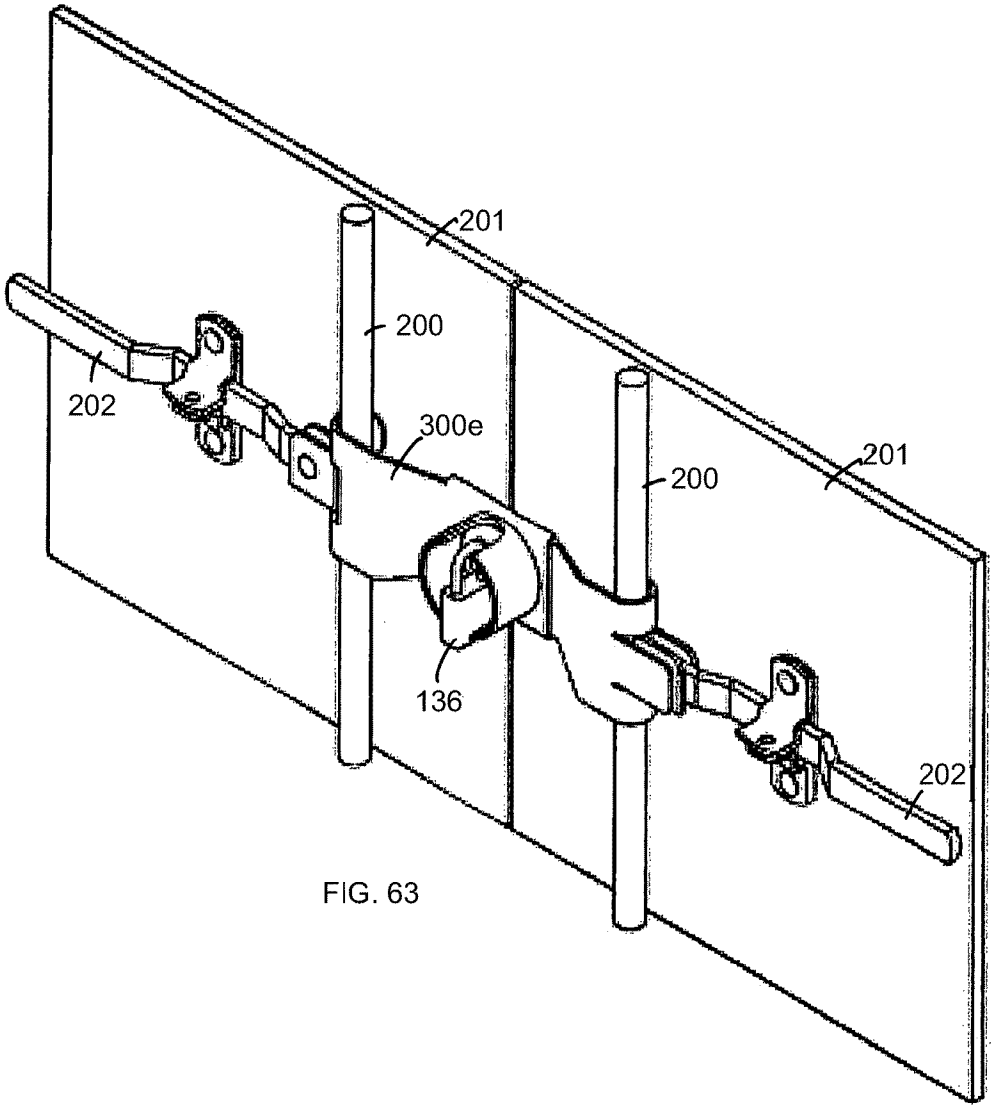
FIG. 63 depicts the strap of FIG. 61 in a locked condition with a conventional pad lock installed.

FIG. 61 depicts a perspective view of a link 300*e* of the type shown in FIG. 59 assembled upon the locking assembly of FIG. 52 in accordance with certain aspects of the present invention, together with an unassembled hockey puck lock 100. FIG. 62 depicts a perspective view of the link 300*e* and locking assembly of FIG. 61, with the hockey puck lock 100 in the locked position. FIG. 63 depicts a perspective view of the link 300*e* and locking assembly of FIG. 61 with a padlock 136 in a locked position in lieu of a hockey puck lock. It will be appreciated that the link 300*e* may be adapted for use with other styles of locks or seals, including straight shackle padlocks and circular shackle padlocks. It will also be appreciated that the orientation of the link 300*e*, or other links herein described, may be rotated 180 degrees from that shown in FIG. 63. However, the orientation shown in FIG. 63 is the preferred orientation because the bracket associated with the right-hand door (as viewed) is commonly an attacked point, and the orientation shown provides added protection to that bracket.

Figure 64:
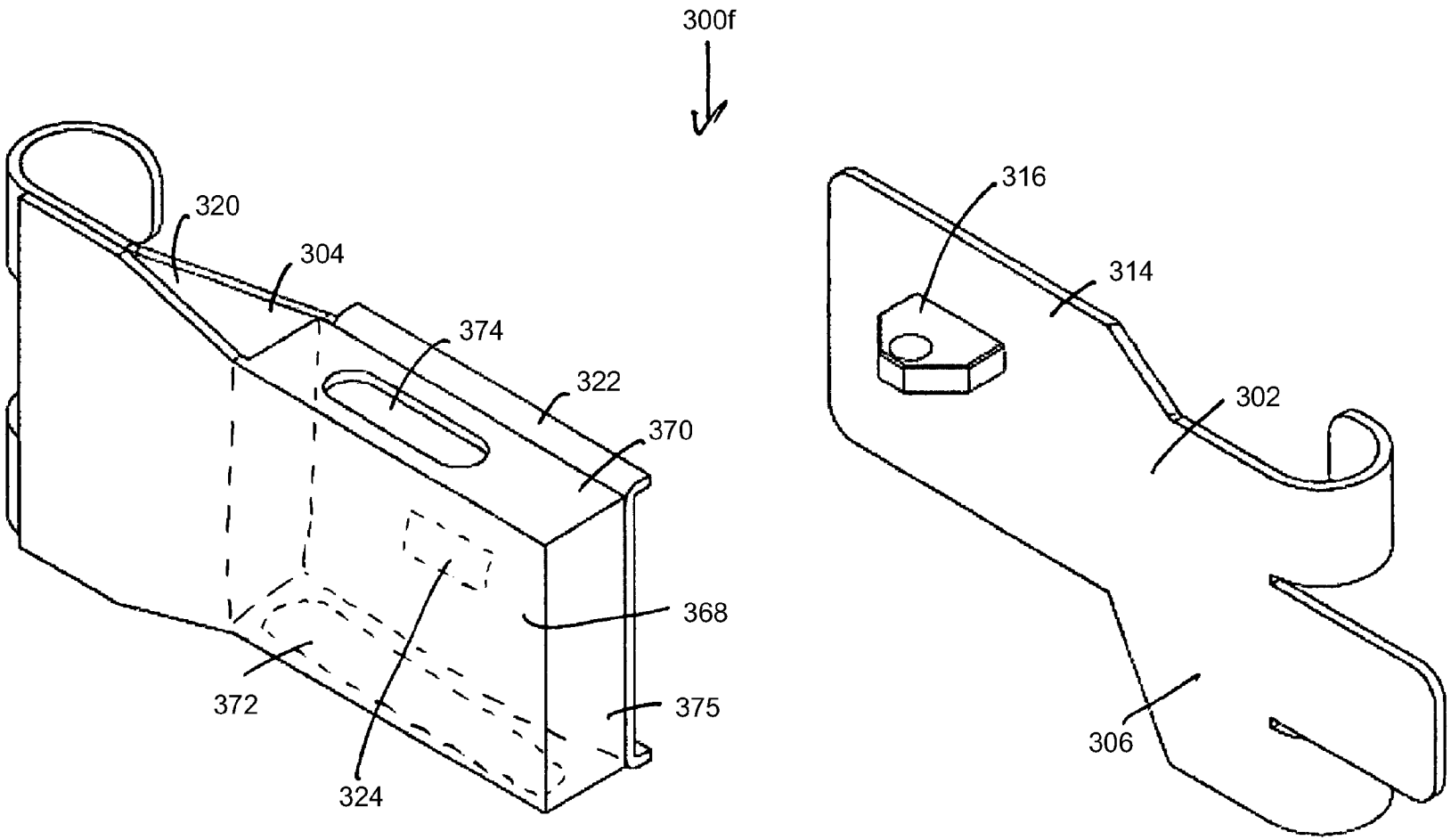
FIG. 64 depicts an exploded perspective view of a strap in accordance with still further aspects of the present invention.

FIG. 64 depicts an exploded perspective view of a non-adjustable strap 300*f* sharing many of the features of strap 300*a* shown in FIG. 53, with the addition of a protective shroud 368 associated with the cover 304.

With respect to the base 302, it will be appreciated that the base 302 of strap 300*f* shown in FIG. 64 may be identical to the base 302 of strap 300*a* shown in FIG. 53, including the finger portion 306, main portion 314, and hasp 316.

The cover 304 may also be substantially similar, including the finger portion 320 and main portion 322. However, the cover 304 of strap 300*f* includes a protective shroud 368. The protective shroud 368 is adapted to be attached to the cover 304 such as by welding, or may be formed integral therewith. The protective shroud 368 includes a generally closed top 370 with an open bottom 372. The generally closed top 370 may include an aperture 374. A first side of the protective shroud 368 may end-abruptly with an end cap 375 such that the protective shroud 368 forms a box with a depth approximately equal to the offset of the strap 300*f*. A second side of the protective shroud 368 may taper toward the finger portion 320 of the cover 304.

Figure 65:
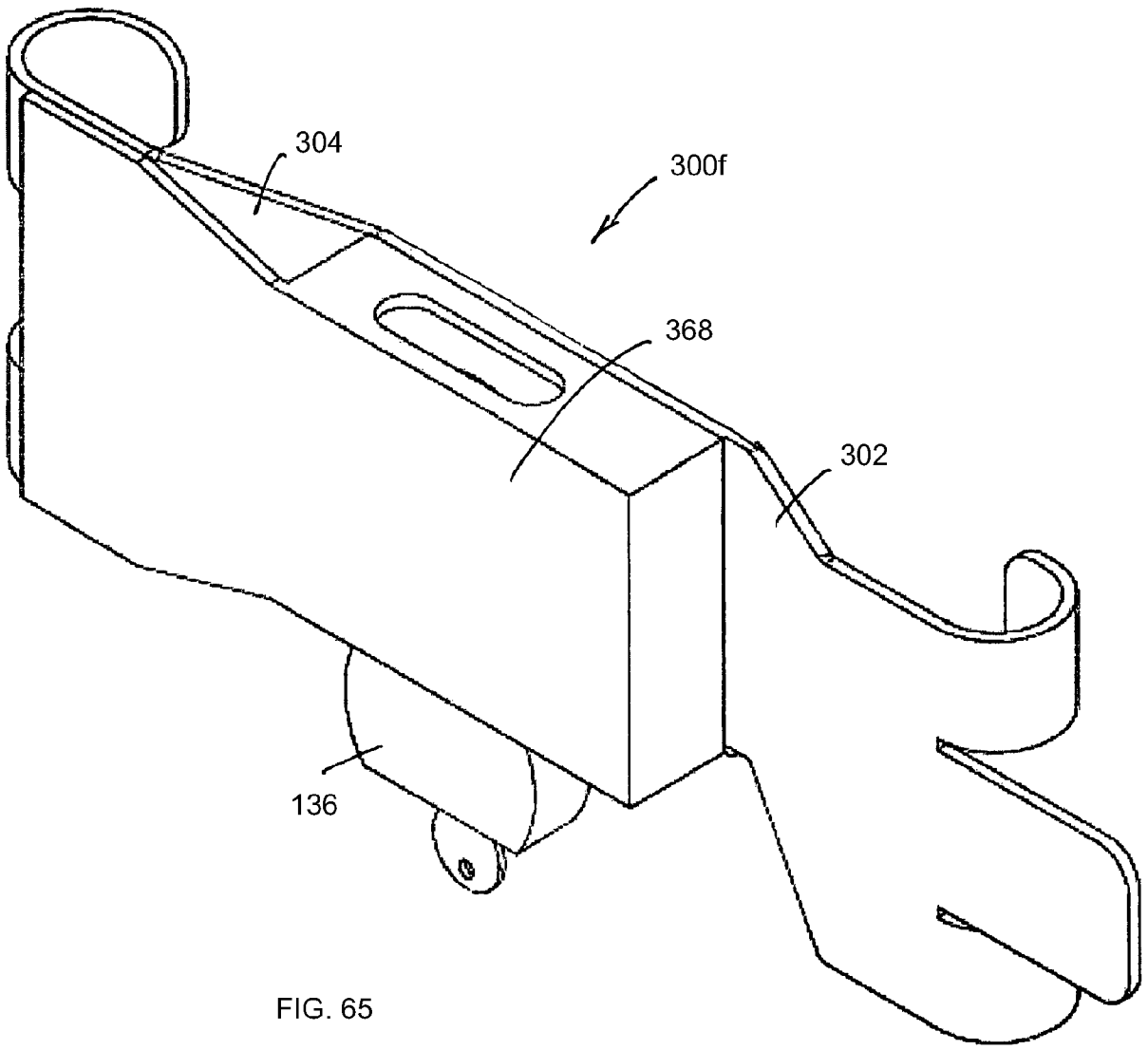
FIG. 65 depicts a fully assembled perspective view of the strap of FIG. 64 with a padlock installed; and, FIG. 66 depicts a fully assembled perspective view of a strap in accordance with still further aspects of the present invention in a fully assembled condition.

As shown in FIG. 65, when fully assembled, a lock, such as padlock 136 may be inserted into the open bottom 372 and fitted over the hasp 316 to lock the strap 300*f*. It will be appreciated that in order to fit the padlock 136, it is important that the protective shroud 368 include a sufficient internal area for manipulation of the lock body and shackle. Such manipulation is aided by the aperture 374 in the closed top 370, through which a user may view the happenings and through which the shackle of the padlock 136 may fit if necessary or desired to assist with positioning. In addition, the aperture 374 may be sized such that the shackle of the padlock may penetrate the aperture 374 to allow easier fitment over the hasp 316. For example, the lock may be inserted through the open bottom 372 and partially through the aperture 374. The lock may then be shifted to the side such that the open shackle is aligned with the aperture 318 of the shaft, and then dropped down such that the open shackle penetrates the aperture 318.

Figure 66:
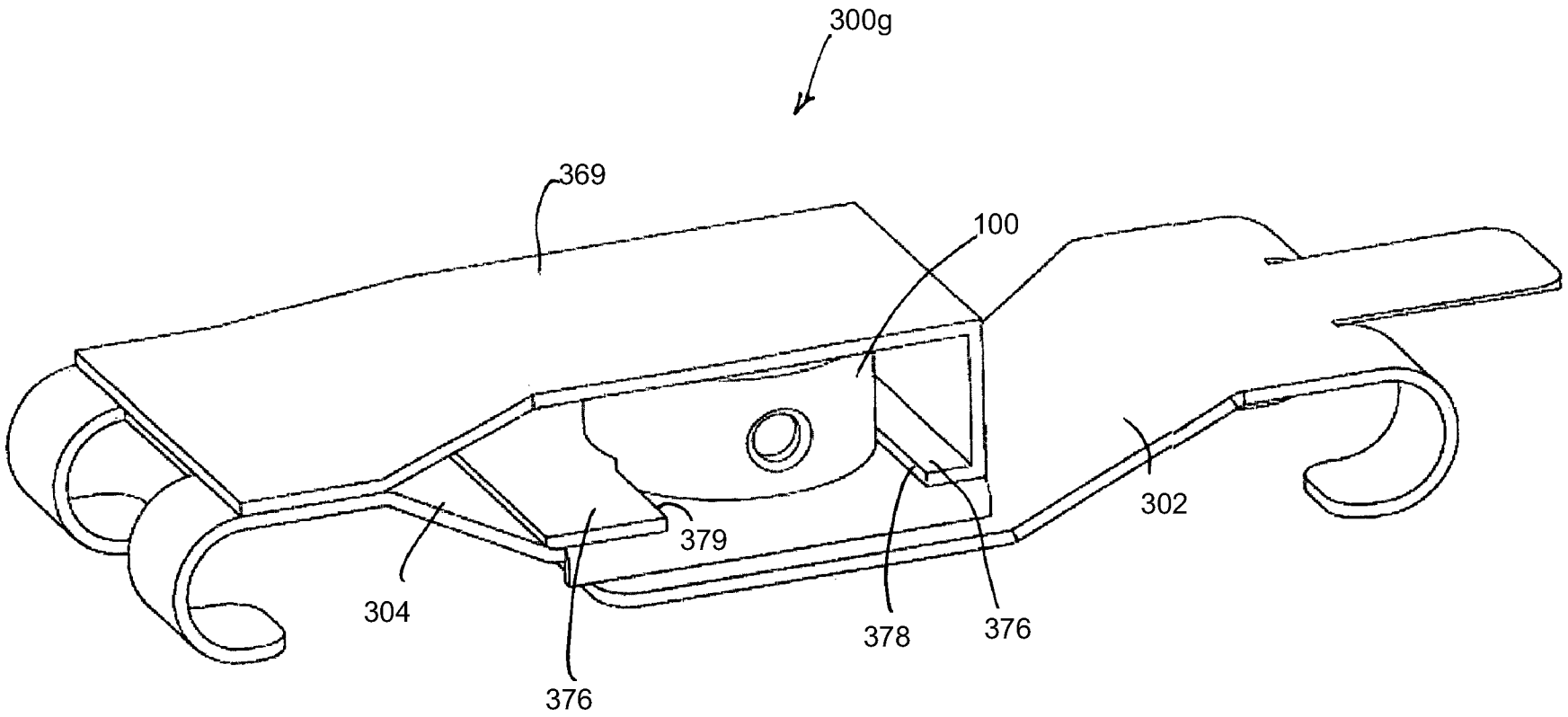

As shown in FIG. 66, a perspective view of a strap 300*g* sharing many of the features of strap 300*f* of FIG. 64, the protective shroud may include internal guide channels 376 extending from the open bottom 372 toward the closed top 370 to guide a lock, such as a hockey puck lock 100, into position. If so provided, the lock 100 may be guided by the edges 378 of the guide channels 376.

In order to install such a lock 100, one would first position the base 302 appropriately upon a first lockrod. One would then position the cover 304 appropriately on a second lockrod, but would not engage the cover 304 with the base 302. Rather, one would insert the lock 100 into the guide channels 376 until the lock was properly positioned in its final position, such that the shackle of the lock is over the aperture 324 (shown in FIG. 64). The cover 304 may then be engaged upon the base 302 by rotating the cover 304 into position. Such action will force the hasp 316 through the aperture 324 and into the body of the lock 100, whereupon the lock may be locked. In other embodiments, it will be appreciated that the lock 100 may be permanently affixed to the cover 304, such that it cannot be removed. Nevertheless, when the lock is unlocked, the cover would be permitted to swing away from the base to unlock the strap system.

The links 106 generally shown and discussed in relation to the present invention have been round. However, it will be appreciated that the link 106 may also be rectangular or any other shape with a circular internal cavity for accepting the hockey puck lock.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A link system, comprising:

a single body with no movable parts and comprising first and second opposing arms, each arm being formed by a protruding part of the single body bent into a concave shape, the first arm defining a first holding space between the first arm and a first part of the single body and the second arm defining a second holding space between the second arm and a second part of the single body, the first holding space and the second holding space comprising opposing concave shapes to one another, the single body comprising an entry space formed between an end point of the first arm and an end point of the second arm, the entry space being connected to the first and second holding spaces, the single body also comprising an aperture;

a first and a second chain member, the first chain member being threaded onto the first arm of the single body to occupy the first holding space and the second chain member being threaded onto the second arm of the single body to occupy the second holding space, wherein the first and second chain members do not occupy the same holding space;

a padlock with a lock body and a shackle, the shackle being threaded through the aperture in the single body, the lock body occupying the entry space, and the shackle being locked to the lock body; and wherein the lock body cannot be removed from the entry space, the first chain member cannot be removed from the first arm and the second chain member cannot be removed from the second arm;

wherein a tension caused by a load transferred through the first and second chain member is borne by the single body, the first arm, and the second arm, and not borne by the padlock.

2. The link system of claim 1, wherein the body of the padlock has a thickness substantially equal to a distance between the end point of the first arm and the end point of the second arm.

3. The link system of claim 1, wherein the padlock is separate from and unconnected to the single body prior to being threaded through the aperture.

4. The link system of claim 1, wherein the first and second chain members are separate from and unconnected to the single body prior to being threaded onto the first and second arms, respectively.

5. The link system of claim 1, wherein the shackle comprising a heel and a toe and the shackle being rotatable around the heel when the padlock is in an unlocked condition and the shackle is not threaded through the aperture.

6. The link system of claim 1, wherein the padlock is a circular shackle padlock.

7. The link system of claim 1, wherein the padlock is a straight shackle padlock.

8. The link system of claim 1, wherein the single body has a triangular shape.

9. The link system of claim 1, wherein the single body of the link has a second aperture.

10. The link system of claim 9, wherein the second aperture is configured to receive a shackle of a differently sized padlock.

11. The link system of claim 9, wherein the shackle is threaded through the aperture and the padlock is in a locked condition and a position of the aperture places the body of the padlock in the entry space and prevents the first and second members from being removed from the first link system.

12. The link system of claim 1, wherein a tensile strength of the single body is greater than a pullout strength of the padlock.

13. The link system of claim 1, wherein the first chain member is torus shaped.

* * * * *